US008510017B2

(12) United States Patent
Sawada et al.

(10) Patent No.: US 8,510,017 B2
(45) Date of Patent: Aug. 13, 2013

(54) CYLINDER-TO-CYLINDER AIR/FUEL RATIO IMBALANCE DETERMINATION SYSTEM OF INTERNAL COMBUSTION ENGINE

(75) Inventors: Hiroshi Sawada, Gotenba (JP); Yasushi Iwazaki, Ebina (JP); Hiroshi Miyamoto, Susono (JP); Fumihiko Nakamura, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 513 days.

(21) Appl. No.: 12/847,300

(22) Filed: Jul. 30, 2010

(65) Prior Publication Data

US 2011/0054761 A1 Mar. 3, 2011

(30) Foreign Application Priority Data

Aug. 27, 2009 (JP) ..... 2009-196557

(51) Int. Cl.
*F02D 41/14* (2006.01)

(52) U.S. Cl.
USPC ..... 701/103; 701/109; 123/673

(58) Field of Classification Search
USPC ..... 701/103, 109; 123/672, 673
See application file for complete search history.

(56) References Cited

U.S. PATENT DOCUMENTS

| | | | | |
|---|---|---|---|---|
| 7,152,594 | B2 | 12/2006 | Anilovich et al. | |
| 2010/0211290 | A1* | 8/2010 | Kidokoro et al. | 701/103 |
| 2011/0295491 | A1* | 12/2011 | Kurahashi et al. | 701/103 |
| 2012/0283931 | A1* | 11/2012 | Otsuka et al. | 701/103 |

FOREIGN PATENT DOCUMENTS

| | | |
|---|---|---|
| JP | 11-72473 | 3/1999 |
| JP | 2000-65782 | 3/2000 |
| JP | 2004-69547 | 3/2004 |
| JP | 2005-133626 | 5/2005 |
| JP | 2007-154840 | 6/2007 |
| JP | 2008-144639 | 6/2008 |
| JP | 2009-013967 | 1/2009 |
| JP | 2009-30455 | 2/2009 |

OTHER PUBLICATIONS

Office Action issued Apr. 2, 2013, in Japanese Patent Application No. 2009-196557, filed Aug. 27, 2009 (3 pages).

* cited by examiner

*Primary Examiner* — Erick Solis
(74) *Attorney, Agent, or Firm* — Oblon, Spivak, McClelland, Maier & Neustadt, L.L.P.

(57) ABSTRACT

A cylinder-to-cylinder air/fuel ratio imbalance determination system obtains an imbalance determination parameter that increases or decreases as a difference between the air/fuel ratios of different cylinders increases, based on output values of an air/fuel ratio sensor, and makes a cylinder-to-cylinder A/F imbalance determination, based on the result of comparison between the imbalance determination parameter and a threshold value for imbalance determination. The determination system changes the amount of fuel injected into one or more of the cylinders so as to create a forced imbalance condition in which the air/fuel ratio of a particular cylinder deviates from the air/fuel ratio of the remaining cylinders, and obtains an air/fuel ratio sensor evaluation parameter (e.g., rate of change ΔAF of the detected air/fuel ratio) in this condition. Then, the determination system determines whether the air/fuel ratio sensor is adequate for making a cylinder-to-cylinder A/F imbalance determination, by comparing the evaluation parameter with a reference parameter (an evaluation parameter obtained based on output values of a reference air/fuel ratio sensor in the same forced imbalance condition).

12 Claims, 31 Drawing Sheets

CYLINDER-TO-CYLINDER AIR/FUEL RATIO IMBALANCE DETERMINATION SYSTEM OF INTERNAL COMBUSTION ENGINE

INCORPORATION BY REFERENCE

The disclosure of Japanese Patent Application No. 2009-196557 filed on Aug. 27, 2009 including the specification, drawings and abstract is incorporated herein by reference in its entirety.

BACKGROUND OF THE INVENTION

1. Field of the Invention

The invention relates to a cylinder-to-cylinder air/fuel ratio (A/F) imbalance determination system provided in a multi-cylinder internal combustion engine, for determining (monitoring, detecting) whether a significant imbalance occurs between the air/fuel ratios of air-fuel mixtures supplied to respective cylinders (the air/fuel ratios of respective cylinders) (i.e., whether a cylinder-to-cylinder air/fuel ratio (A/F) imbalance condition occurs).

2. Description of the Related Art

An air/fuel ratio control system is widely known which includes a three-way catalyst mounted in an exhaust passage of an internal combustion engine, and upstream air/fuel ratio sensor and downstream air/fuel ratio sensor disposed upstream and downstream, respectively, of the three-way catalyst in the exhaust passage. The air/fuel ratio control system calculates an air/fuel ratio feedback amount based on an output signal of the upstream air/fuel ratio sensor and an output signal of the downstream air/fuel ratio sensor, so that the air/fuel ratio of an air-fuel mixture supplied to the engine (the air/fuel ratio of the engine) becomes equal to the stoichiometric air/fuel ratio, and controls the air/fuel ratio of the engine in a feedback fashion, using the air/fuel ratio feedback amount. Another type of air/fuel ratio control, system has also been proposed which calculates an air/fuel ratio feedback amount based on only one of the output signal of the upstream air/fuel ratio sensor and the output signal of the downstream air/fuel ratio sensor, and controls the air/fuel ratio of the engine in a feedback fashion, using the air/fuel ratio feedback amount. The air/fuel ratio feedback amount used in the air/fuel ratio control system as described above is a control amount common to all of the cylinders of the engine.

Generally, an electronic fuel injection type internal combustion engine includes at least one fuel injection valve mounted in each cylinder or an intake port that communicates with each cylinder. Accordingly, if the fuel injection valve of a particular cylinder becomes characterized in that "the fuel injection valve injects an excessively large amount of fuel compared to an instructed fuel injection amount", only the air/fuel ratio of an air-fuel mixture supplied to the particular cylinder (the air/fuel ratio of the particular cylinder) shifts largely to the rich side. Namely, the unevenness of the air/fuel ratio among the cylinders (or variation in the air/fuel ratio among the cylinders, or air/fuel ratio (A/F) imbalance among the cylinders) increases. In other words, an air-fuel ratio (A/F) imbalance occurs between one cylinder (particular cylinder) and the other or remaining cylinders.

In this case, the average air/fuel ratio of the air-fuel mixture supplied to the engine as a whole becomes richer than the stoichiometric air/fuel ratio. Accordingly, if the air/fuel ratios of the cylinders are feedback-controlled based on the air/fuel ratio feedback amount common to all of the cylinders, the air/fuel ratio of the particular cylinder is changed to the lean side so as to be closer to the stoichiometric air/fuel ratio, and, at the same time, the air/fuel ratio of the remaining cylinders is changed to the lean side, away from the stoichiometric air/fuel ratio. As a result, the average air/fuel ratio of all of the air-fuel mixtures supplied to the engine is made substantially equal to the stoichiometric air/fuel ratio.

However, as a result of the feedback control, the air/fuel ratio of the particular cylinder is still richer than the stoichiometric air/fuel ratio, and the air/fuel ratio of the remaining cylinders becomes leaner than the stoichiometric ratio; therefore, a combustion condition of the air-fuel mixture in each cylinder differs from that of complete combustion. As a result, an increased amount of emissions (i.e., increased amounts of unburned substances and nitrogen oxides) are discharged from each cylinder. Therefore, even if the average air/fuel ratio of the air-fuel mixtures supplied to the engine is substantially equal to the stoichiometric air/fuel ratio, the three-way catalyst may not fully or completely clean the thus increased emissions, resulting in deterioration of the emissions.

Accordingly, it is important to detect the excessive unevenness or imbalance of the air/fuel ratio among the cylinders (i.e., occurrence of a cylinder-to-cylinder A/F imbalance condition), and take some measures against this situation in an attempt to avoid deterioration of the emissions. In this connection, a cylinder-to-cylinder A/F imbalance occurs due to various factors, for example, when the fuel injection valve of a particular cylinder becomes characterized by injecting an excessively small amount of fuel compared to the instructed fuel injection amount, or when EGR gas or evaporative fuel gas is unevenly distributed into the respective cylinders.

A known system that determines whether a cylinder-to-cylinder A/F imbalance condition as described above occurs is configured to obtain a trace length of the output (output signal) of an air/fuel ratio sensor (the above-mentioned upstream air/fuel ratio sensor) disposed in an exhaust collecting portion into which exhaust gases are collected from a plurality of cylinders, compares the trace length with "a reference value that varies in accordance with the engine speed and the intake air amount", and determines whether a cylinder-to-cylinder A/F imbalance condition occurs, based on the result of the comparison (see, for example, U.S. Pat. No. 7,152,594). In the following description, a determination as to whether "an excessive cylinder-to-cylinder A/F imbalance condition" occurs will be simply called "a cylinder-to-cylinder A/F imbalance determination, or an imbalance determination". The "excessive cylinder-to-cylinder A/F imbalance condition" means a cylinder-to-cylinder A/F imbalance condition in which the amount of unburned substances and/or nitrogen oxides exceeds a prescribed value.

To accurately make an A/F imbalance determination using the output of the air/fuel ratio sensor, the output characteristics of the air/fuel ratio sensor are required to match well with "the output characteristics of a standard air/fuel ratio sensor". The output characteristics of the standard air/fuel ratio sensor are those of "an air/fuel ratio sensor used when determining, in advance, a threshold value or values (e.g., the reference value used in the known system) based on which an A/F imbalance determination is made". The output characteristics of the air/fuel ratio sensor are, for example, the output gain, response, and other characteristics of the air/fuel ratio sensor. The output gain is, for example, an amount proportional to the magnitude of a difference between an output value of the air/fuel ratio sensor obtained when the air/fuel ratio is equal to the stoichiometric air/fuel ratio, and an output value of the air/fuel ratio sensor obtained when the air/fuel ratio is equal to a given air/fuel ratio. The standard air/fuel ratio sensor will also be called "reference air/fuel ratio sensor".

It is, however, to be noted that air/fuel ratio sensors have individual differences due to, for example, manufacturing variations. Also, the air/fuel ratio sensor may deteriorate with use, and the output characteristics of the sensor may change with time. Thus, if the output characteristics of the air/fuel ratio sensor noticeably differ from "the output characteristics of the reference air/fuel ratio sensor", a parameter or parameters for use in cylinder-to-cylinder A/F imbalance determination, which are obtained based on the output value of the air/fuel ratio sensor, cannot be accurately obtained, and therefore, a cylinder-to-cylinder A/F imbalance determination cannot be made with high accuracy.

SUMMARY OF THE INVENTION

The invention has been developed so as to cope with the above-described problem. Namely, the invention provides a cylinder-to-cylinder air/fuel ratio (A/F) imbalance determination system that is less likely or unlikely to make "an erroneous cylinder-to-cylinder A/F imbalance determination" even when the output characteristics of an air/fuel ratio sensor deviate from "the output characteristics of a reference air/fuel ratio sensor".

The cylinder-to-cylinder A/F imbalance determination system of the internal combustion engine of the invention (which will also be called "determination system of the invention") is used in a multi-cylinder internal combustion engine having a plurality of cylinders (generally, three or more cylinders), and includes an air/fuel ratio sensor, a plurality of fuel injection valves, and an imbalance determination device.

The air/fuel ratio sensor is disposed in an exhaust passage of the engine, more specifically, in an exhaust collecting portion of the exhaust passage into which exhaust gases emitted from combustion chambers of "at least three cylinders (for example, all of the cylinders in the case of a four-cylinder engine, three cylinders of each of the right and left banks in the case of a V-type six-cylinder engine, four cylinders of each of the right and left banks in the case of a V-type eight-cylinder engine, etc.), out of the above-indicated plurality of cylinders" are collected. Alternatively, the air/fuel ratio sensor is disposed in a portion of the exhaust passage downstream of the exhaust gas collecting portion. The air/fuel ratio sensor generates an output value commensurate with the air/fuel ratio of exhaust gas that reaches a portion of the exhaust passage in which the sensor is mounted.

The above-indicated plurality of fuel injection valves are provided in conjunction with the above-indicated at least three cylinders, respectively, and each of the fuel injection valves is adapted to inject fuel contained in "an air-fuel mixture supplied to each of the combustion chambers of the three or more cylinders". Namely, one or more fuel injection valves are provided with respect to one cylinder.

The imbalance determination device obtains "an imbalance determination parameter that increases or decreases" as "a difference between the air/fuel ratio of an air-fuel mixture supplied to one of the above-indicated at least three cylinders and the air/fuel ratio of air-fuel mixtures supplied to the remaining ones of the at least three cylinders (cylinder-to-cylinder air/fuel ratio difference)" increases, based on "at least the output value of the air/fuel ratio sensor", and makes an imbalance determination as to "whether a cylinder-to-cylinder air/fuel ratio imbalance condition occurs", based on "the result of comparison between the obtained imbalance determination parameter and a given threshold value for use in imbalance determination".

In the case where the imbalance determination parameter increases as the air/fuel ratio difference among the cylinders increases, the imbalance determination device may be configured to determine that a cylinder-to-cylinder A/F imbalance condition occurs when the imbalance determination parameter is equal to or larger than the threshold value for imbalance determination. Also, where the imbalance determination parameter decreases as the air/fuel ratio difference among the cylinders increases, the imbalance determination device may be configured to determine that a cylinder-to-cylinder A/F imbalance condition occurs when the imbalance determination parameter is equal to or smaller than the threshold value for imbalance determination.

The imbalance determination parameter is a parameter "that increases or decreases as a degree of imbalance among the air/fuel ratios of air-fuel mixtures supplied to the respective ones of the three or more cylinders increases". For example, the imbalance determination parameter may be a trace length of "the output value of the air/fuel ratio sensor or the air/fuel ratio (detected air/fuel ratio) represented by the output value", a value corresponding to a rate of change (a differential value, a rate of change of the detected air/fuel ratio) of "the output value of the air/fuel ratio sensor or the detected air/fuel ratio" with respect to time, a value corresponding to a rate of change (a second-order differential value, a rate of change of the detected air/fuel ratio change rate) of the rate of change of "the output value of the air/fuel ratio sensor or the detected air/fuel ratio" with respect to time, etc. These values increase as the air-fuel ratio difference among the cylinders increases. Also, the imbalance determination parameter may be the inverse of any of these values. In this case, the imbalance determination parameter decreases as the air/fuel ratio difference among the cylinders increases.

In addition, the imbalance determination device is characterized by including a forced imbalance condition creating device, an evaluation parameter obtaining device, an air/fuel ratio sensor evaluation device, and an imbalance determination executing/inhibiting device.

The forced imbalance condition creating device changes the amount(s) of fuel injected from one or more of the fuel injection valves, so as to create a condition (i.e., a forced imbalance condition) in which "the air/fuel ratio of an air-fuel mixture supplied to one of the three or more cylinders" deviates from "the air/fuel ratio of an air-fuel mixture supplied to each of the remaining ones of the three or more cylinders", before the process of making an A/F imbalance determination is executed.

In the case where the engine is a four-cylinder engine, and one air/fuel ratio sensor is mounted in a collecting portion of exhaust gases emitted from all of the cylinders, for example, the forced imbalance condition creating device creates the forced imbalance condition, by increasing or reducing the amount of fuel injected into a particular cylinder (e.g., a first cylinder) to be larger or smaller than the amount of fuel injected into the remaining cylinders (e.g., second through fourth cylinders).

Thus, the cylinder for which the air/fuel ratio of the air/fuel mixture supplied is forced to be different from the air/fuel ratio of air-fuel mixtures supplied to the remaining cylinders may also be called "forced imbalance cylinder". Also, the remaining cylinders may also be called "non-forced-imbalance cylinders or normal cylinders". Further, the air/fuel ratio of the air-fuel mixture supplied to the forced imbalance cylinder may also be called "the air/fuel ratio of the forced imbalance cylinder", and the air/fuel ratio of the air-fuel mixture supplied to each of the non-forced-imbalance cylinders may also be called "the air/fuel ratio of the non-forced-imbalance cylinder". In addition, when the air/fuel ratio of the forced imbalance cylinder is set to an air/fuel ratio that is richer than the air/fuel ratio of the non-forced-imbalance cylinders, the forced imbalance cylinder may also be called "forced rich imbalance cylinder". When the air/fuel ratio of the forced imbalance cylinder is set to an air/fuel ratio that is leaner than the air/fuel ratio of the non-forced-imbalance cylinders, the forced imbalance cylinder may also be called "forced lean imbalance cylinder".

The evaluation parameter obtaining device obtains "an air/fuel ratio sensor evaluation parameter indicative of an output characteristic of the air/fuel ratio sensor", based on the output value of the air/fuel ratio sensor in a condition where the forced imbalance condition is established.

The air/fuel ratio sensor evaluation parameter may be, for example, a trace length of "the output value of the air/fuel ratio sensor or the air/fuel ratio (detected air/fuel ratio) represented by the output value", a value corresponding to a rate of change of "the output value of the air/fuel ratio sensor or the detected air/fuel ratio" with respect to time, a value corresponding to a rate of change of the rate of change of "the output value of the air/fuel ratio sensor or the detected air/fuel ratio" with respect to time, "the maximum value or minimum value" of "the output values of the air/fuel ratio sensor or the detected air/fuel ratios" obtained over a unit combustion cycle period, etc. The air/fuel ratio sensor evaluation parameter indicative of the output characteristic of the air/fuel ratio sensor is preferably the same kind of parameter as the imbalance determination parameter. The above-mentioned "unit combustion cycle period" is "a period of time corresponding to a crank angle required to complete single combustion cycles in all of the cylinders from which exhaust gases that will reach one air/fuel ratio sensor are emitted". Where the engine is a four-cycle, four-cylinder engine, the unit combustion cycle period" is a period corresponding to a crank angle of 720°.

The air/fuel ratio sensor evaluation device makes "a sensor adequacy determination" as to "whether the output characteristic of the air/fuel ratio sensor is adequate for making an imbalance determination", by comparing "the obtained air/fuel ratio sensor evaluation parameter" with "a predetermined reference parameter". The reference parameter is an air/fuel ratio sensor evaluation parameter obtained when the air/fuel ratio sensor is a reference or standard air/fuel ratio sensor. "Comparing the obtained air/fuel ratio sensor evaluation parameter with the predetermined reference parameter" includes determining whether an absolute value of a difference between these parameters is larger than a given threshold value (including "0"), or determining whether the ratio of these parameters is larger than a given threshold value, for example.

The imbalance determination executing/inhibiting device inhibits the imbalance determination device from making an imbalance determination or makes the result of the imbalance determination invalid when the air/fuel ratio sensor evaluation device determines that "the output characteristic of the air/fuel ratio sensor is not adequate for making an imbalance determination". The statement that "the output characteristic of the air/fuel ratio sensor is not adequate for making an imbalance determination" may be replaced by a simple statement that "the air/fuel ratio sensor is inadequate" or "the air-fuel sensor is not adequate".

With the cylinder-to-cylinder A/F imbalance determination system constructed as described above, a forced imbalance condition similar to a condition in which an inherent A/F imbalance among cylinders occurs is forcedly created, and an air/fuel ratio sensor evaluation parameter indicative of the output characteristic of the air/fuel ratio sensor is obtained in the forced imbalance condition. Then, a determination on the adequacy of the air/fuel ratio sensor is made based on whether the air/fuel ratio sensor evaluation parameter is close to or substantially equal to the reference parameter. Accordingly, a determination as to whether the output characteristic of the air/fuel ratio sensor is not adequate for "making a cylinder-to-cylinder A/F imbalance determination" can be made with high accuracy. Furthermore, if it is determined that the output characteristic of the air/fuel ratio sensor is not adequate for making a cylinder-to-cylinder A/F imbalance determination, the process of making an A/F imbalance determination will not be carried out. This leads to a reduced possibility of making an erroneous cylinder-to-cylinder A/F imbalance determination, due to, for example, a change in the output characteristics of the air/fuel ratio sensor.

In a preferred embodiment of the invention, the forced imbalance condition creating device changes the amount(s) of fuel injected from one or more of the fuel injection valves, so as to create a forced rich imbalance condition in which the air/fuel ratio of the air-fuel mixture supplied to the above-indicated one cylinder is set to a first air/fuel ratio that is richer than the air/fuel ratio of the air-fuel mixtures supplied to the remaining cylinders, and a forced lean imbalance condition in which the air/fuel ratio of the air-fuel mixture supplied to the one cylinder is set to a second air/fuel ratio that is leaner than the air/fuel ratio of the air-fuel mixtures supplied to the remaining cylinders (without overlapping with each other in time), as the forced imbalance condition.

The output characteristics of the air/fuel ratio sensor may be different between the case where the air/fuel ratio to be detected changes from a rich air/fuel ratio to a lean air/fuel ratio, and the case where the air/fuel ratio changes from a lean air/fuel ratio to a rich air/fuel ratio. Accordingly, if the air/fuel ratio of the air-fuel mixture supplied to one cylinder (the air/fuel ratio of the forced imbalance cylinder) is set to the first air/fuel ratio and the second air/fuel ratio, as in the above embodiment, variations in the air/fuel ratio of exhaust gas that reaches the air/fuel ratio sensor can be set in various patterns, and therefore, it can be determined with high accuracy whether the output characteristics of the air/fuel ratio sensor are adequate for "making a cylinder-to-cylinder A/F imbalance determination", namely, the adequacy of the air/fuel ratio sensor can be determined with high accuracy. The cylinder for which the first air/fuel ratio is set may be the same as or different from the cylinder for which the second air/fuel ratio is set.

In this case, the air/fuel ratio sensor evaluation parameter obtained during the period in which the air/fuel ratio of the forced imbalance cylinder is set to the first air/fuel ratio may be obtained as a first evaluation parameter, and the air/fuel ratio sensor evaluation parameter obtained during the period in which the air/fuel ratio of the forced imbalance cylinder is set to the second air/fuel ratio may be obtained as "a second evaluation parameter to be distinguished from the first evaluation parameter". It is preferable to make a determination on the adequacy of the air/fuel ratio sensor, based on the results of comparisons between the first evaluation parameter and the second evaluation parameter, and "a first reference parameter and a second reference parameter" as the above-mentioned reference parameters, respectively.

Also in this case, it may be determined that the air/fuel ratio sensor is not adequate for making an A/F imbalance determination when the absolute value of a difference between the first evaluation parameter and the first reference parameter is larger than a first threshold value, AND the absolute value of a difference between the second evaluation parameter and the second reference parameter is larger than a second threshold value. Also, it may be determined that the air/fuel ratio sensor is inadequate when at least one of the conditions that the absolute value of a difference between the first evaluation parameter and the first reference parameter is larger than the first threshold value and that the absolute value of a difference between the second evaluation parameter and the second reference parameter is larger than the second threshold value is satisfied.

In addition, the output characteristics of the air/fuel ratio sensor may be different between the case where the air/fuel ratio to be detected is richer than the stoichiometric air/fuel ratio, and the case where the air/fuel ratio is leaner than the stoichiometric air/fuel ratio. Accordingly, in the above-described embodiment, if the first air/fuel ratio is set to an air/fuel ratio that is richer than the stoichiometric ratio, and the second air/fuel ratio is set to an air/fuel ratio that is leaner than the stoichiometric ratio, variations in the air/fuel ratio of exhaust gas that reaches the air/fuel ratio sensor can be set in further various patterns, and therefore, the adequacy of the air/fuel ratio sensor can be determined with high accuracy.

In the above-indicated internal combustion engine, a three-way catalyst having an oxygen storage function is often provided in a portion of the exhaust passage downstream of the air/fuel ratio sensor.

In this case, it is desirable that the forced imbalance condition creating device that creates the forced rich imbalance condition and the forced lean imbalance condition without overlapping with each other in time (without causing both of these conditions to occur within a single unit combustion cycle period) sets the first air/fuel ratio to "an air/fuel ratio richer than the stoichiometric air/fuel ratio", and sets the air/fuel ratio of the air-fuel mixtures supplied to the remaining cylinders to "a third air/fuel ratio that is equal to or leaner than the stoichiometric air/fuel ratio", in the forced rich imbalance condition, while limiting the duration of the forced rich imbalance condition so that the amount of "excessive unburned substances in the exhaust gas" emitted during the duration of the forced rich imbalance condition does not exceed an amount (a first amount) of unburned substances that can be oxidized by "an amount of oxygen smaller than the maximum oxygen storage amount of the three-way catalyst". In this connection, the excessive unburned substances in the exhaust gas means unburned substances that still remain in the case where oxygen and unburned substances in the exhaust gas fully react with each other.

In addition, it is desirable that the forced imbalance condition creating device sets the second air/fuel ratio to "an air/fuel ratio leaner than the stoichiometric air/fuel ratio", and sets the air/fuel ratio of the air-fuel mixtures supplied to the remaining cylinders to "a fourth air/fuel ratio that is equal to or richer than the stoichiometric air/fuel ratio", in the forced lean imbalance condition, while limiting the duration of the forced lean imbalance condition so that "the amount of excessive oxygen in the exhaust gas" emitted during the duration of the forced lean imbalance condition does not exceed "a second amount that is smaller than the maximum oxygen storage amount of the three-way catalyst". In this connection, the excessive oxygen in the exhaust gas means oxygen that still remains in the case where oxygen and unburned substances in the exhaust gas fully react with each other.

According to the embodiment as described above, the first air/fuel ratio is set to an air/fuel ratio richer than the stoichiometric air/fuel ratio, and the second air/fuel ratio is set to an air/fuel ratio leaner than the stoichiometric air/fuel ratio; therefore, even if the output characteristics of the air/fuel ratio sensor are different between the case where the detected air/fuel ratio is richer than the stoichiometric air/fuel ratio and the case where the air/fuel ratio is leaner than the stoichiometric air/fuel ratio, a determination on the adequacy of the air/fuel ratio sensor can be made with further improved accuracy.

Furthermore, according to the above embodiment, the total amount of excessive unburned substances that flow into the three-way catalyst in the forced rich imbalance condition can be set so as not to exceed the amount of unburned substances that can be treated or removed by the three-way catalyst. In addition, the total amount of excessive oxygen that flows into the three-way catalyst in the forced lean imbalance condition can be set so as not to exceed the amount (the maximum oxygen storage amount Cmax) of oxygen that can be adsorbed and stored in the three-way catalyst. Accordingly, it is possible to prevent emissions from deteriorating when the forced imbalance conditions are established.

In the above embodiment, it is further desirable to estimate the maximum oxygen storage amount Cmax and instantaneous oxygen storage amount OSA of the three-way catalyst, and limit the duration of the forced rich imbalance condition and the duration of the forced lean imbalance condition so that the oxygen storage amount OSA falls within a range between "a first predetermined value larger than 0" and "a second predetermined value larger than the first predetermined value and smaller than the maximum oxygen storage amount Cmax".

In another embodiment of the invention, the above-indicated at least three cylinders include a first cylinder, and a second cylinder that is different from the first cylinder, and the forced imbalance condition creating device is configured to set the first cylinder, for a set period of time, as a forced imbalance cylinder (i.e., "one of the above-indicated at least three cylinders" for which "the amount of fuel injected is changed" so that "the air/fuel ratio of the air-fuel mixture supplied to this cylinder" deviates by a given air/fuel ratio from "the air/fuel ratio of the air-fuel mixtures supplied to the remaining cylinders"), and then set the second cylinder as the forced imbalance cylinder for a set period of time.

The evaluation parameter obtaining device is configured to obtain the air/fuel ratio sensor evaluation parameter "in a first forced imbalance period in which the forced imbalance cylinder is set to the first cylinder", as "a first provisional evaluation parameter", and obtain the air/fuel ratio sensor evaluation parameter "in a second forced imbalance period in which the forced imbalance cylinder is set to the second cylinder", as "a second provisional evaluation parameter".

Furthermore, the evaluation parameter obtaining device is configured to obtain a parameter corresponding to at least one of the first provisional evaluation parameter and the second provisional evaluation parameter, as "a final air/fuel ratio sensor evaluation parameter used for making a sensor adequacy determination", when "an absolute value of a difference between the first provisional evaluation parameter and the second provisional evaluation parameter" is equal to or smaller than a given threshold value. The imbalance determination executing/inhibiting device is configured to inhibit the air/fuel ratio sensor evaluation device from making a sensor adequacy determination or make the result of the sensor adequacy determination invalid, when "the absolute value of the difference between the first provisional evaluation parameter and the second provisional evaluation parameter" is larger than the given threshold value.

According to the above embodiment, the first provisional parameter is obtained in the condition where the forced imbalance cylinder is set to the first cylinder, and then the second provisional parameter is obtained in the condition where the forced imbalance cylinder is set to the second cylinder.

If the air/fuel ratio of the air-fuel mixture supplied to, for example, the first cylinder deviates from the air/fuel ratio of the air-fuel mixtures supplied to the remaining cylinders in a condition where no forced rich imbalance condition is created (namely, if the first cylinder is an inherent imbalance cylinder), the amount of variation of the air/fuel ratio differs between the case where the forced imbalance cylinder is set to the first cylinder and the case where the forced imbalance cylinder is set to the second cylinder. As a result, a certain difference appears between the first provisional evaluation parameter and the second provisional evaluation parameter, irrespective of the output characteristics of the air/fuel ratio sensor. This also applies to the case where the second cylinder is an inherent imbalance cylinder.

In other words, if a difference between the first provisional evaluation parameter and the second provisional evaluation parameter is small, the air/fuel ratio of the air-fuel mixture supplied to the first cylinder is substantially equal to that of the air-fuel mixture supplied to the second cylinder in a condition where no forced imbalance condition is created (i.e., neither the first cylinder nor the second cylinder is an inherent imbalance cylinder). Accordingly, both of the first provisional evaluation parameter and the second provisional evaluation parameter are considered as representing "the output characteristics of the air/fuel ratio sensor" with high accuracy.

Thus, in the above embodiment, if the absolute value of the difference between the first provisional evaluation parameter and the second provisional evaluation parameter is equal to or smaller than the given threshold value, a parameter corresponding to at least one of the first provisional evaluation parameter and the second provisional evaluation parameter is obtained as "the air/fuel ratio sensor evaluation parameter (final evaluation parameter) used when making a sensor adequacy determination". In this case, the final evaluation parameter may be either of the first provisional evaluation parameter and the second provisional evaluation parameter, or may be the average value of these parameters. Consequently, the adequacy of the air/fuel ratio sensor can be determined with high accuracy.

On the other hand, if the absolute value of the difference between the first provisional evaluation parameter and the second provisional evaluation parameter is larger than the given threshold value, the first cylinder or the second cylinder may be considered as an inherent imbalance cylinder. In this case, it is difficult to determine an air/fuel ratio sensor evaluation parameter with high accuracy unless other measures are taken. In the above-described embodiment, therefore, the air/fuel ratio sensor evaluation device is inhibited from making a sensor adequacy determination, or the result of the sensor adequacy determination is made invalid. It is thus possible to prevent a normal air/fuel ratio sensor from being erroneously determined as an "inadequate air/fuel ratio sensor".

A cylinder-to-cylinder air/fuel ratio (A/F) imbalance determination system according to another aspect of the invention is used in the above-described multi-cylinder internal combustion engine, and includes "an air/fuel ratio sensor and a plurality of fuel injection valves" as described above.

Furthermore, the system includes an imbalance determination device that obtains the imbalance determination parameter based on at least the output value of the air/fuel ratio sensor, and makes an imbalance determination as to whether a cylinder-to-cylinder air/fuel ratio imbalance condition occurs, based on the result of comparison between the obtained imbalance determination parameter and a given threshold value for use in imbalance determination.

The imbalance determination device includes the "forced imbalance condition creating device and air/fuel ratio sensor evaluation parameter obtaining device" as described above, and also includes a correction amount calculating device that calculates a correction amount for making the obtained evaluation parameter close to a predetermined reference parameter, based on "the obtained evaluation parameter and the reference parameter", and an imbalance determination parameter obtaining device that corrects at least one of "the output value of the air/fuel ratio sensor, original data obtained based on the output value of the air/fuel ratio sensor for determining the imbalance determination parameter, and the imbalance determination parameter", using the calculated correction amount, and obtains the imbalance determination parameter based on the corrected data.

With the above arrangement, the correction amount for making the evaluation parameter obtained in the forced imbalance condition close to the reference parameter is calculated, and "the output value of the air/fuel ratio sensor or a processed value of the output value (original data)" for determining "the imbalance determination parameter to be compared with an imbalance determination threshold value when making an A/F imbalance determination" or the imbalance determination parameter itself is corrected with the correction amount. As a result, the obtained imbalance determination parameter is close to a value that would be obtained when the air/fuel ratio sensor is the reference air/fuel ratio sensor. Accordingly, an A/F imbalance determination can be made with further improved accuracy.

In this case, the correction amount calculating device is preferably configured to calculate a value (Y/X or X/Y, for example) corresponding to the ratio (=Y/X) of the reference parameter (Y) to the evaluation parameter (X), as the correction amount.

With the above arrangement, the correction amount can be obtained by simple calculation, and original data, for example, can be corrected by simple calculation (such as multiplying the original data by the correction amount).

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein:

FIG. 17A and FIG. 17B are views showing changes in the detected air/fuel ratio, wherein FIG. 17A shows the detected air/fuel ratio when no imbalance condition occurs, and FIG. 17B shows the detected air/fuel ratio when an imbalance condition occurs;

DETAILED DESCRIPTION OF EMBODIMENTS

Figure 1:
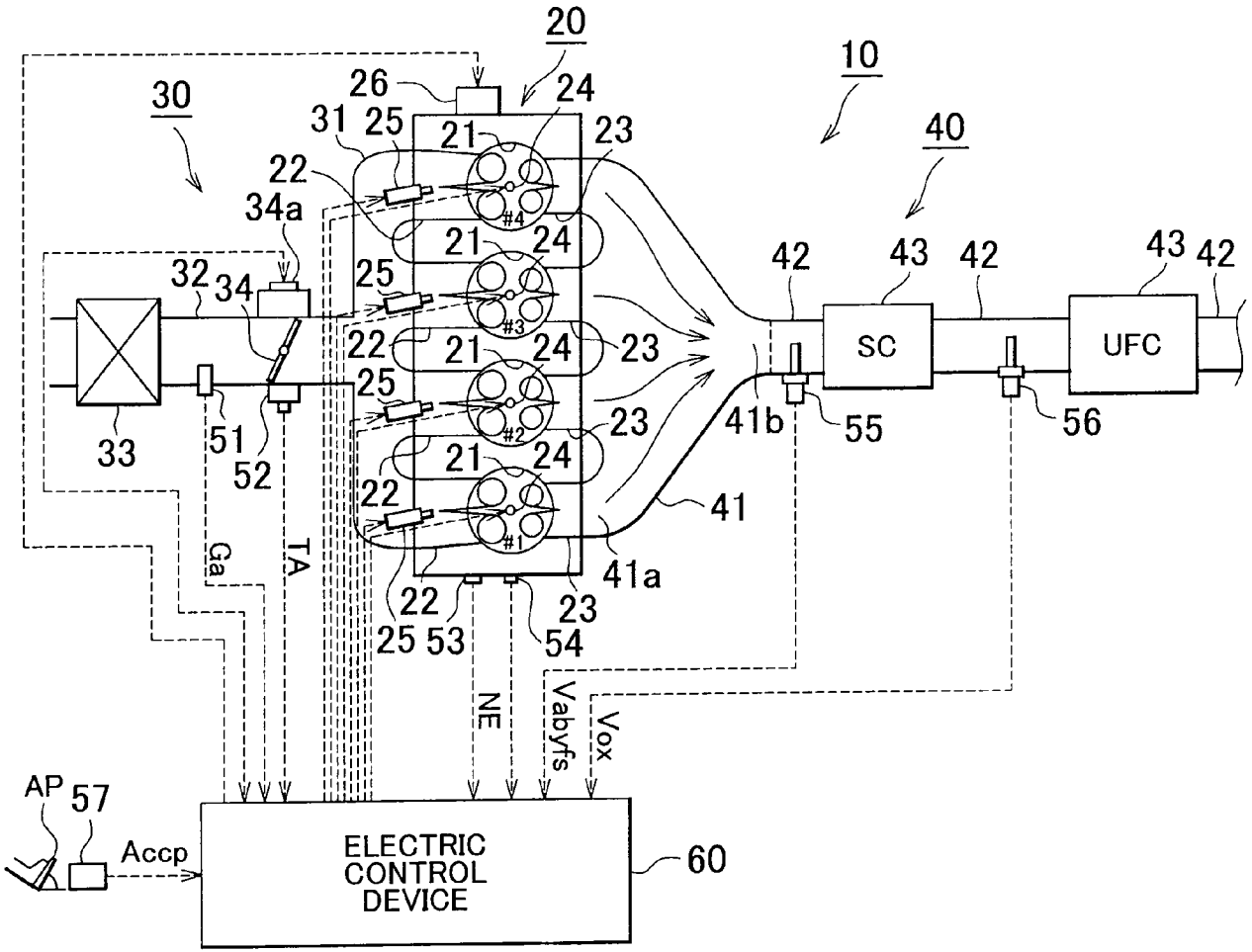
FIG. 1 is a view schematically showing the construction of an internal combustion engine in which a cylinder-to-cylinder air/fuel ratio imbalance determination system (first determination system) according to a first embodiment of the invention is used.

In the following, a cylinder-to-cylinder air/fuel ratio (A/F) imbalance determination system of an internal combustion engine according to each embodiment of the invention will be described with reference to the drawings. The system of each embodiment obtains a value (a command amount of air/fuel ratio change rate) corresponding to a time differential value (or rate of change) of the air/fuel ratio (detected air/fuel ratio) represented by the output value of an air/fuel ratio sensor, as an imbalance determination parameter, and makes a cylinder-to-cylinder air/fuel ratio (A/F) imbalance determination, using the imbalance determination parameter.

Furthermore, the system of each embodiment determines whether the air/fuel ratio sensor has output characteristics adequate for making a cylinder-to-cylinder air/fuel ratio (A/F) imbalance determination, based on a parameter for use in evaluation of the air/fuel ratio sensor (evaluation parameter). The system of each embodiment forcedly creates an A/F imbalance condition among cylinders, and obtains a value corresponding to the detected air/fuel ratio change rate in this condition, as "the evaluation parameter".

It is to be understood that the imbalance determination parameter may be any parameter provided that it increases as a degree of imbalance among the air/fuel ratios of air-fuel mixtures respectively supplied to at least three cylinders from which exhaust gases reach the air/fuel ratio sensor increases, and is not limited to the value corresponding to the detected air/fuel ratio change rate. More specifically, the imbalance determination parameter may be a trace length of the output value (or a detected air/fuel ratio into which the output value of the air/fuel ratio sensor is converted) of the air/fuel ratio sensor, or a value (a second-order differential value of the output value of an upstream air/fuel ratio sensor with respect to time, or a second-order differential value of the air/fuel ratio represented by the output value of the upstream air/fuel ratio sensor with respect to time) corresponding to the rate of change of the change rate of the output value of the air/fuel ratio sensor or the detected air/fuel ratio. Also, the imbalance determination parameter may be a parameter that decreases as a degree of imbalance among the air/fuel ratios of air-fuel mixtures respectively supplied to at least three cylinders from which exhaust gases reach the air/fuel ratio sensor.

Furthermore, the parameter for use in evaluation of the air/fuel ratio sensor may be any parameter that represents an output characteristic of the air/fuel ratio sensor, and is not limited to a value corresponding to the detected air/fuel ratio change rate. It is desirable that the air/fuel ratio sensor evaluation parameter is the same as or of the same type as the imbalance determination parameter.

A cylinder-to-cylinder air/fuel ratio (A/F) imbalance determination system (which will be simply called "first determination system") according to a first embodiment of the invention is a part of an air/fuel ratio control system that controls the air/fuel ratio of the internal combustion engine, and is also a part of a fuel injection amount control system that controls the fuel injection amount.

FIG. 1 schematically shows the construction of the internal combustion engine 10 to which the first determination system is applied. The engine 10 is a four-cycle, spark ignition type, multi-cylinder (four-cylinder in this embodiment) gasoline engine. The engine 10 includes a main body 20, an intake system 30 and an exhaust system 40.

The main body 20 includes a cylinder block portion and a cylinder head portion. The main body 20 includes a plurality of (four) combustion chambers (a first cylinder #1 through a fourth cylinder #4) formed or defined by top faces of corresponding pistons, cylinder walls and a lower face of the cylinder head portion.

The cylinder head portion is formed with intake ports 22 through which "an air-fuel mixture composed of air and fuel" is supplied to the respective combustion chambers (respective cylinders) 21, and exhaust ports 23 through which exhaust gases (burned gases) are discharged from the respective combustion chambers 21. The intake ports 22 are arranged to be opened and closed by corresponding intake vales (not shown), and the exhaust ports 23 are arranged be opened and closed by corresponding exhaust vales (not shown).

A plurality of ignition plugs (four ignition plugs in this embodiment) are fixed to the cylinder head portion. Each of the ignition plugs 24 is positioned such that its spark generating portion is exposed to a central portion of a corresponding one of the combustion chambers 21 in the vicinity of the lower face of the cylinder head portion. Each of the ignition plugs 24 is operable to generate a spark for ignition from the spark generating portion, in response to an ignition signal.

Furthermore, a plurality of fuel injection valves (injectors) (four fuel injection valves in this embodiment) 25 are fixed to the cylinder head portion. Each of the fuel injection valves 25 is provided in a corresponding one of the intake ports 22. When the fuel injection valve 25 receives an injection command signal, which is normal, the valve 25 injects "an amount of fuel instructed by the injection command signal" into the corresponding intake port 22. Thus, the fuel injection valve 25 provided in each of the cylinders 21 is operable to supply fuel to the cylinder 21 independently of the other cylinders.

Furthermore, an intake valve control device 26 is provided in the cylinder head portion. The intake valve control device 26 has a known arrangement for hydraulically adjusting/controlling the relative rotational angles (phase angles) between an intake camshaft (not shown) and intake cams (not shown). The intake valve control device 26 operates according to a command signal (drive signal) so as to change the valve-opening timing of the intake valves.

The intake system 30 includes an intake manifold 31, an intake pipe 32, an air filter 33, a throttle valve 34 and a throttle valve actuator 34*a*.

The intake manifold 31 includes a plurality of branch portions connected to the respective intake ports 22, and a surge tank into which the branch portions join. The intake pipe 32 is connected to the surge tank. The intake manifold 31, intake pipe 32 and the intake ports 22 constitute "intake passages". The air filter 33 is provided at an end portion of the intake pipe 32. The throttle valve 34 is pivotably mounted to the intake pipe 32 at a position between the air filter 33 and the intake manifold 31. The throttle valve 34 is arranged to pivot so as to change the cross-sectional area of the intake passage formed by the intake pipe 32. The throttle valve actuator 34*a* consists of a DC motor, and is operable to rotate the throttle valve 34 in response to a command signal (drive signal).

The exhaust system 40 includes an exhaust manifold 41, an exhaust pipe 42, an upstream catalyst 43 and a downstream catalyst 44.

The exhaust manifold 41 consists of a plurality of branch portions 41*a* connected to the respective exhaust ports 23, and a collecting portion (exhaust collecting portion) 41*b* into which the branch portions 41*a* join. The exhaust pipe 42 is connected to the collecting portion 41*b* of the exhaust manifold 41. The exhaust manifold 41, exhaust pipe 42 and the exhaust ports 23 constitute "exhaust passages" through which exhaust gases pass. In this specification, the collecting portion 41*b* of the exhaust manifold 41 and the exhaust pipe 42 are also called "exhaust passage" for the sake of convenience.

The upstream catalyst 43 is a three-way catalyst that includes a ceramic support, and "a noble metal serving as a catalyst" and "ceria ($CeO_2$)" supported on the ceramic support, and has the function of storing and releasing oxygen (oxygen storage function). The upstream catalyst 43 is disposed in the exhaust pipe 42. The upstream catalyst 43, when it reaches a certain activation temperature, exhibits "the catalytic function of removing unburned substances (e.g., HC, CO and $H_2$) and nitrogen oxides (NOx) at the same time" and "the oxygen storage function".

The downstream catalyst 44 is a three-way catalyst similar to the upstream catalyst 43. The downstream catalyst 44 is disposed in a portion of the exhaust pipe 42 downstream of the upstream catalyst 43. The upstream catalyst 43 and downstream catalyst 44 may be catalysts of types other than the three-way catalyst.

The first determination system includes a hot-wire airflow meter 51, a throttle position sensor 52, a crank angle sensor 53, an intake cam position sensor 54, an upstream air/fuel ratio sensor 55, a downstream air/fuel ratio sensor 56 and an accelerator pedal position sensor 57.

The hot-wire airflow meter 51 detects the mass flow (airflow) of intake air flowing in the intake pipe 43, and outputs a signal indicative of the mass airflow (the amount of intake air of the engine 10 per unit time) Ga. The airflow or flow rate of intake air Ga is substantially equal to the flow rate of exhaust gas, and is also substantially proportional to the velocity of flow of exhaust gas.

The throttle position sensor 52 detects the opening of the throttle valve 34, and outputs a signal indicative of the throttle opening TA.

The crank angle sensor (crank position sensor) 53 outputs a signal having narrow pulses generated each time the crankshaft of the engine 10 rotates 10° and wide pulses generated each time the crankshaft rotates 360°. The signal is transmitted to an electric control device 60 (which will be described later) where the signal is converter into the engine speed NE.

The intake cam position sensor 54 generates one pulse each time the intake camshaft rotates 90 degrees from a certain angle, then 90 degrees, and then 180 degrees. The electric control device 60 obtains an absolute crank angle CA relative to the compression top dead center of a reference cylinder (e.g., the first cylinder #1), based on the signals from the crank angle sensor 53 and intake cam position sensor 54. The absolute crank angle CA is set to "0° crank angle" when the reference cylinder is at the compression top dead center, and increases up to 720° crank angle in accordance with the angle of rotation of the crankshaft. Then, the absolute crank angle CA is set again or reset to 0° crank angle at the time when it reaches 720° crank angle.

The upstream air/fuel ratio sensor 55 (air/fuel ratio sensor of this invention) is disposed in either of the exhaust manifold 41 and the exhaust pipe 42 (namely, in the exhaust passage) at a position between the collecting portion 41*b* of the exhaust manifold 41 and the upstream catalyst 43. Namely, the air/fuel ratio sensor 55 is disposed in the exhaust passage of the engine 10, more specifically, "in the exhaust collecting portion into which exhaust gases emitted from the combustion chambers 21 of at least three cylinders, out of the plurality of cylinders, are collected" or "in a portion of the exhaust passage downstream of the exhaust gas collecting portion". The air/fuel ratio sensor 55 is, for example, "a limiting current type wide range air/fuel ratio sensor having a diffusion resistance layer" disclosed in, for example, Japanese Patent Application Publication No. 11-72473 (JP-A-11-72473), Japanese Patent Application Publication No. 2000-65782 (JP-A-2000-65782), and Japanese Patent Application Publication No. 2004-69547 (JP-A-2004-69547).

Figure 2:
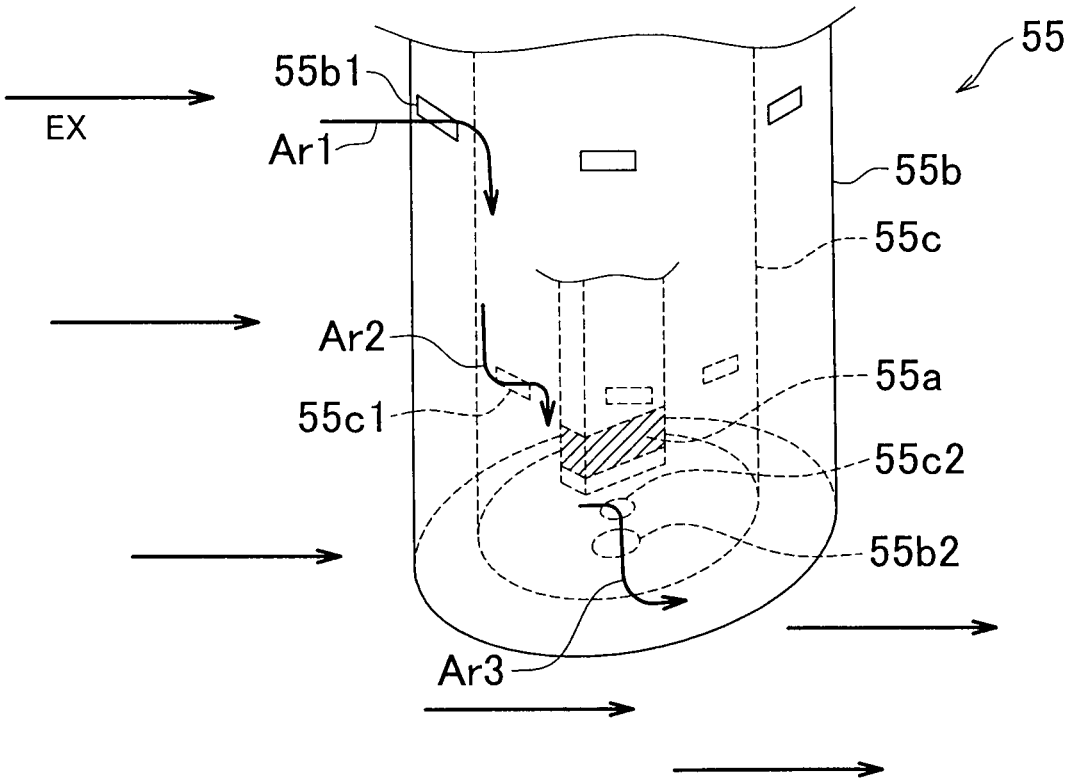
FIG. 2 is a schematic perspective view of a part of an air/fuel ratio sensor (upstream air/fuel ratio sensor) shown in FIG. 1.
Figure 3:
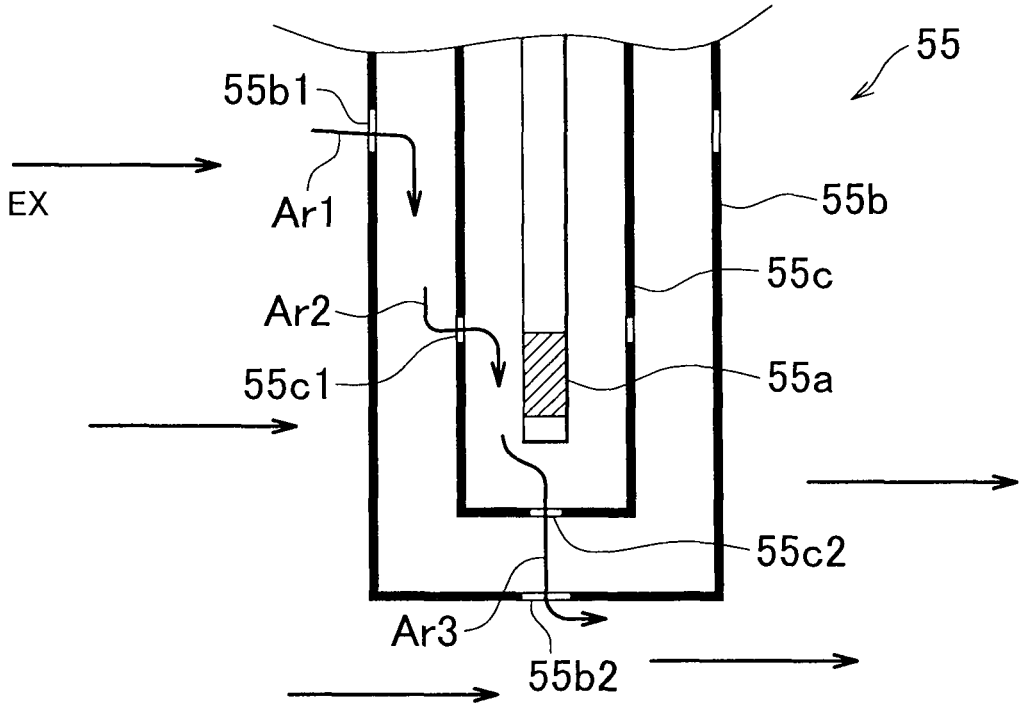
FIG. 3 is a cross-sectional view of a part of the air/fuel ratio sensor (upstream air/fuel ratio sensor) shown in FIG. 1.

As shown in FIG. 2 and FIG. 3, the upstream air/fuel ratio sensor 55 has an air/fuel ratio sensing element 55*a*, an outer protective cover 55*b*, and an inner protective cover 55*c*.

The outer protective cover 55*b* is a hollow cylindrical body made of metal. The inner protective cover 55*c* is housed in the outer protective cover 55*b* such that the outer protective cover 55*b* surrounds the inner protective cover 55*c*. A plurality of inlet holes 55*b*1 are formed in a side wall of the outer protective cover 55*b*. The inlet holes 55*b*1 are through-holes through which exhaust gas EX flowing in the exhaust passage (exhaust gas present outside the outer protective cover 55*b*) flows into the outer protective cover 55*b*. Further, the outer protective cover 55*b* has an outlet hole 55*b*2 formed in a bottom wall thereof such that the exhaust gas within the outer protective cover 55*b* flows to the outside (the exhaust passage) through the outlet hole 55*b*2.

The inner protective cover 55*c* is a hollow cylindrical body made of metal and having a diameter smaller than that of the outer protective cover 55*b*. The air/fuel ratio sensing element 55*a* is housed in the inner protective cover 55*c* such that the inner protective cover 55*c* surrounds the air/fuel ratio sensing element 55*a*. The inner protective cover 55*c* has a plurality of inlet holes 55*c*1 formed in a side wall thereof. The inlet holes 55*c*1 are through-holes through which the exhaust gas introduced into "the space between the outer protective cover 55*b* and the inner protective cover 55*c*" through the inlet holes 55*b*1 of the outer protective cover 55*b* flows into the inner protective cover 55*c*. Further, the inner protective cover 55*c* has an outlet hole 55*c*2 formed in a bottom wall thereof such that the exhaust gas within the inner protective cover 55*c* flows to the outside through the outlet hole 55*c*2.

Figure 4A:
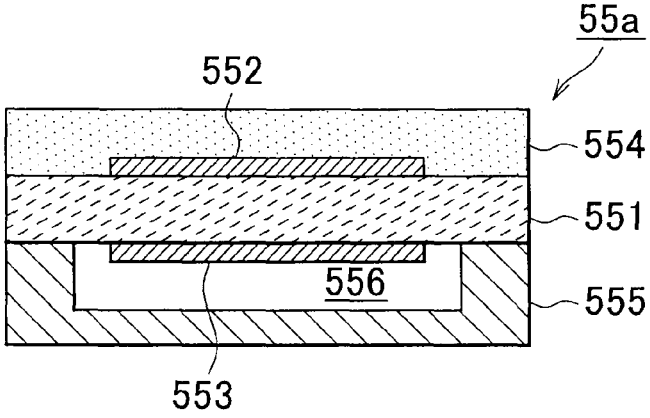
FIG. 4A-FIG. 4C are schematic cross-sectional views each showing an air/fuel ratio sensing element included in the air/fuel ratio sensor (upstream air/fuel ratio sensor) shown in FIG. 1.
Figure 4B:
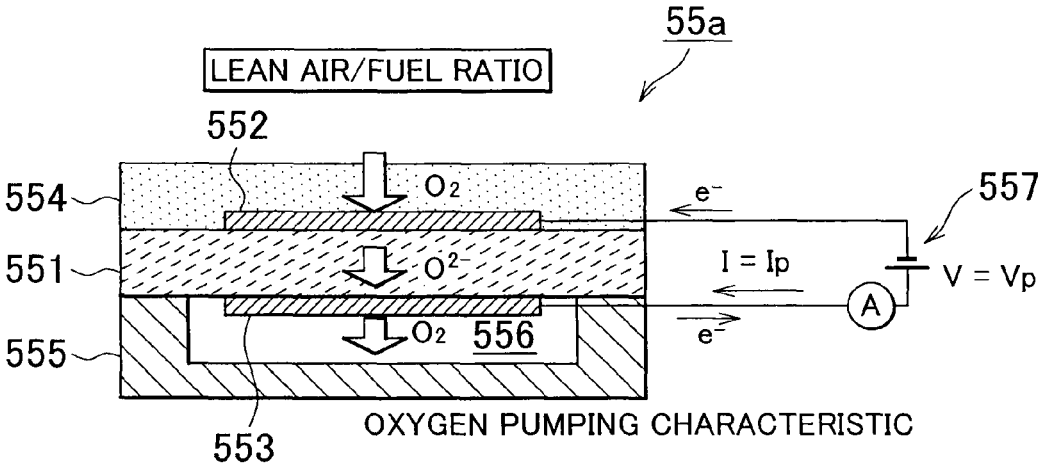
Figure 4C:
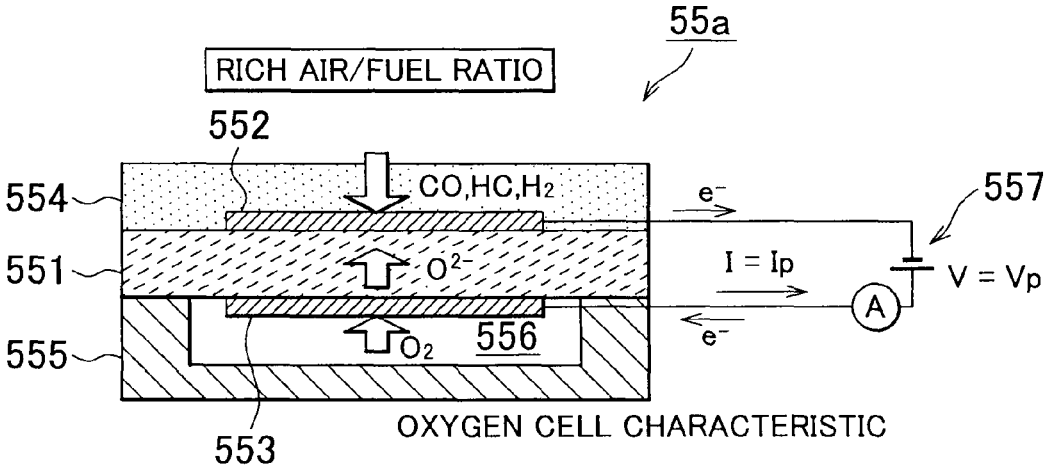

As shown in FIG. 4A-FIG. 4C, the air/fuel ratio sensing element 55*a* includes a solid electrolyte layer 551, an exhaust-side electrode layer 552, an atmosphere-side electrode layer 553, a diffusion resistance layer 554, and a partition wall 555.

The solid electrolyte layer 551 is a sintered body of an oxygen ion conductive oxide. In this embodiment, the solid electrolyte layer 551 is a "stabilized zirconia element" formed by dissolving CaO as a stabilizer in $ZrO_2$ (zirconia). The solid electrolyte layer 551 exhibits its known oxygen cell characteristic" and "oxygen pumping characteristic" when its temperature is equal to or higher than the activation temperature.

The exhaust-side electrode layer 552 is formed of a noble metal, such as platinum (Pt), having a high catalytic activity. The exhaust-side electrode layer 552 is formed on one major surface of the solid electrolyte layer 551. The exhaust-side electrode layer 552 is formed by, for example, chemical plating, so as to provide a sufficient permeability (namely, to provide a porous structure).

The atmosphere-side electrode layer 553 is formed of a noble metal, such as platinum (Pt), having a high catalytic activity. The atmosphere-side electrode layer 553 is formed on the other major surface of the solid electrolyte layer 551, such that the atmosphere-side electrode layer 553 is opposed to the exhaust-side electrode layer 552 with the solid electrolyte layer 551 interposed therebetween. The atmosphere-side electrode layer 553 is formed by, for example, chemical plating, so as to provide a sufficient permeability (namely, to provide a porous structure).

The diffusion resistance layer (diffusion control layer) 554 is formed of a porous ceramic material (heat-resisting inorganic substance). The diffusion resistance layer 554 is formed by, for example, plasma spraying, so as to cover the outer surface of the exhaust-side electrode layer 552.

The partition wall 555 is formed of alumina (ceramic) that is dense and does not permit gas to permeate therethrough. The partition wall 555 is arranged to form "an atmosphere chamber 556" as a space in which the atmosphere-side electrode layer 553 is placed. The atmosphere is introduced into the atmosphere chamber 556.

A power supply 557 is connected to the upstream air/fuel ratio sensor 55. The power supply 557 applies voltage V to the air/fuel ratio sensor 55 so that the atmosphere-side electrode layer 553 is at a high potential, and the exhaust-side electrode layer 552 is at a low potential.

Figure 5:
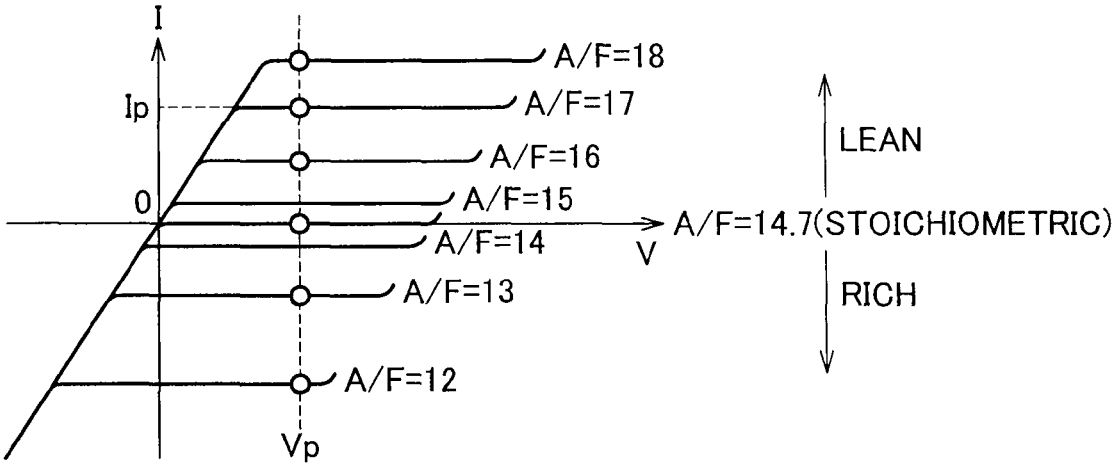
FIG. 5 is a graph showing the relationship between the air/fuel ratio of exhaust gas and the limiting current of the air/fuel ratio sensor.

When the air/fuel ratio of exhaust gas is leaner (i.e., larger) than the stoichiometric air/fuel ratio, the upstream air/fuel sensor 55 constructed as described above ionizes oxygen that reached the exhaust-side electrode layer 552 through the diffusion resistance layer 554, and passes the oxygen ions toward the atmosphere-side electrode layer 553, as shown in FIG. 4B. As a result, current I flows from the positive electrode to the negative electrode of the power supply 557. If the voltage V is set to a given value Vp or higher, the magnitude of the current I becomes a constant value that is proportional to the concentration of oxygen that reached the exhaust-side electrode layer 552 (i.e., the oxygen partial pressure, or the air/fuel ratio of the exhaust gas), as shown in FIG. 5. The upstream air/fuel sensor 55 outputs a voltage level into which the current (i.e., limiting current Ip) is converted, as an output value Vabyfs.

When the air/fuel ratio of the exhaust gas is richer (i.e., smaller) than the stoichiometric air/fuel ratio, on the other hand, the upstream air/fuel ratio sensor 55 ionizes oxygen present in the atmosphere chamber 556, and guides the oxygen ions toward the exhaust-side electrode layer 552, so as to oxidize unburned substances (such as HC, CO and $H_2$) that reaches the exhaust-side electrode layer 552 through the diffusion resistance layer 554. As a result, current I flows from the negative electrode to the positive electrode of the power supply 557. If the voltage V is set to a given value Vp or higher, the magnitude of the current I becomes a constant value that is proportional to the concentration of the unburned substances that reached the exhaust-side electrode layer 552 (i.e., the air/fuel ratio of the exhaust gas), as shown in FIG. 5. The upstream air/fuel ratio sensor 55 outputs a voltage level into which the current (i.e., limiting current Ip) is converted, as an output value Vabyfs.

Figure 6:
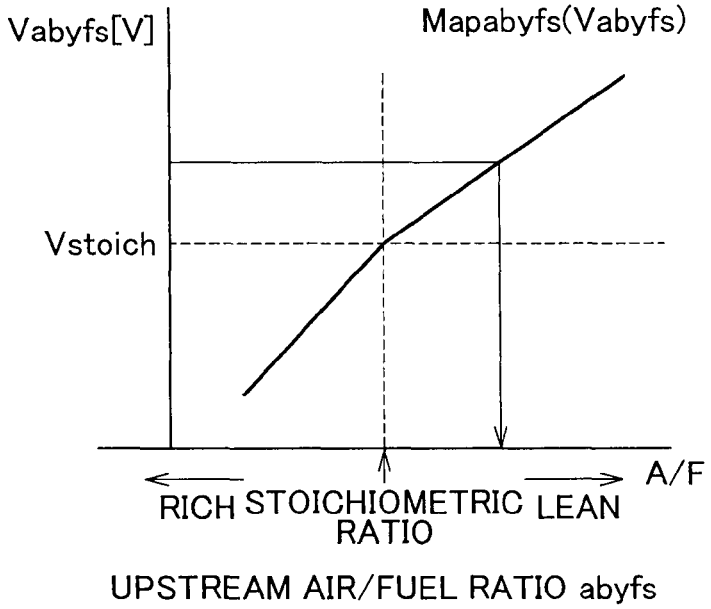
FIG. 6 is a graph showing the relationship between the air/fuel ratio of exhaust gas and the output value of the air/fuel ratio sensor.

Namely, as shown in FIG. 6, the air/fuel ratio sensing element 55*a* generates an output Vabyfs commensurate with the air/fuel ratio (upstream air/fuel ratio abyfs, detected air/ fuel ratio abyfs) of gas that flows down to a position where the upstream air/fuel ratio sensor 55 is mounted, passes through the inlet holes 55*b*1 of the outer protective cover 55*b* and the inlet holes 55*c*1 of the inner protective cover 55*c* and reaches the air/fuel ratio sensing element 55*a*, as "air/fuel ratio sensor output (output value of the air/fuel ratio sensor) Vabyfs". The air/fuel ratio sensor output Vabyfs increases as the air/fuel ratio of the gas that reaches the air/fuel ratio sensing element 55*a* becomes larger (i.e., leaner). Thus, the air/fuel ratio sensor output Vabyfs is substantially proportional to the air/fuel ratio of the exhaust gas that reaches the air/fuel ratio sensing element 55*a*.

The electric control device 60 which will be described later stores an air/fuel ratio conversion table (map) Mapabyfs as shown in FIG. 6, and obtains the actual air/fuel ratio abyfs (detects the upstream air/fuel ratio abyfs) by converting the output value Vabyfs of the air/fuel ratio sensor into the air/fuel ratio with reference to the air/fuel ratio conversion table Mapabyfs. Thus, the detected air/fuel ratio abyfs is a value representing the air/fuel ratio into which the output value Vabyfs of the air/fuel ratio sensor 55 is converted with reference to the air/fuel ratio conversion table Mapabyfs: therefore, the detected air/fuel ratio abyfs may also be expressed as the air/fuel ratio represented by the output value Vabyfs of the air/fuel ratio sensor 55. As will be described later, the air-fuel ratio sensor 55 undergoes changes in its output characteristics. The air/fuel ratio conversion table Mapabyfs is a table that is empirically obtained in advance based on output values Vabyfs of a standard air/fuel sensor 55 (i.e., reference air/fuel ratio sensor) whose output characteristics have not changed.

Referring again to FIG. 1, the downstream air/fuel ratio sensor 56 is disposed in the exhaust pipe 42 (i.e., exhaust passage) at a position between the upstream catalyst 43 and the downstream catalyst 44. The downstream air/fuel ratio sensor 56 is a known concentration cell type oxygen concentration sensor ($O_2$ sensor). The downstream air/fuel ratio sensor 56 generates an output value Voxs commensurate with the air/fuel ratio (downstream air/fuel ratio afdown) of exhaust gas that flows down to a portion of the exhaust passage where the downstream air/fuel ratio sensor 56 is mounted.

Figure 7:
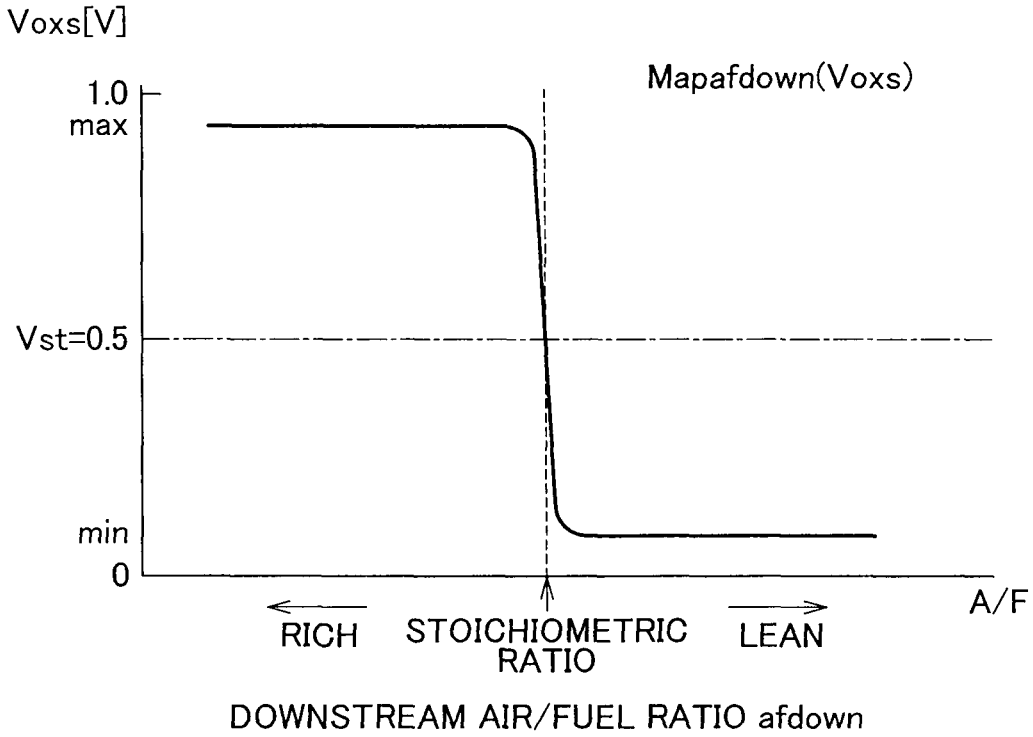
FIG. 7 is a graph showing the relationship between the air/fuel ratio of exhaust gas and the output of a downstream air/fuel ratio sensor.

As shown in FIG. 7, the output Voxs of the downstream air/fuel ratio sensor 56 is equal to the maximum output value max (e.g., about 0.9 V) when the air/fuel ratio of gas to be sensed is richer than the stoichiometric air/fuel ratio, and is equal to the minimum output value min (e.g., about 0.1 V) when the air/fuel ratio of gas to be sensed is leaner than the stoichiometric air/fuel ratio. When the air/fuel ratio of gas to be sensed is equal to the stoichiometric air/fuel ratio, the output Voxs is equal to a voltage Vst (intermediate voltage Vst, for example, about 0.5 V) approximately intermediate between the maximum output value max and the minimum output value min. Also, the output value Voxs rapidly changes from the maximum output value max to the minimum output value min when the air/fuel ratio of gas to be sensed changes from a rich air/fuel ratio to a lean air/fuel ratio relative to the stoichiometric air/fuel ratio, and rapidly changes from the minimum output value min to the maximum output value max when the air/fuel ratio of gas to be sensed changes from a lean air/fuel ratio to a rich air/fuel ratio relative to the stoichiometric air/fuel ratio.

The accelerator pedal position sensor 57 as shown in FIG. 1 detects the amount of operation of the accelerator pedal AP operated by the driver, and outputs a signal indicative of the amount of operation Accp of the accelerator pedal AP.

The electric control device 60 is a known microcomputer comprised of "CPU, ROM, RAM, backup RAM (or a non-volatile memory, such as EEPROM), and an interface including AD converters", for example.

The backup RAM is arranged to be supplied with electric power from a battery installed on the vehicle, without regard to the position (the OFF position, START position or the ON position, for example) of the ignition key switch (not shown) of the vehicle on which the engine 10 is installed. The backup RAM, when supplied with electric power from the battery, stores data (data is written into the backup RAM) according to a command of the CPU, and holds the data such that the data can be read from the backup RAM as needed.

The interface of the electric control device 60 is connected to the sensors 51-57, and supplies signals from the sensors 51-57 to the CPU. Also, the interface sends command signals (drive signals) to the ignition plug 24 of each cylinder, fuel injection valve 25 of each cylinder, intake valve control device 26, throttle valve actuator 34*a*, and so forth, according to commands of the CPU. The electric control device 60 is configured to send a command signal to the throttle valve actuator 34*a* so that the throttle opening TA increases as the acquired amount of operation Accp of the accelerator pedal increases.

Next, the principle of "cylinder-to-cylinder air/fuel ratio (A/F) imbalance determination", which is adopted by the first determination system (and other determination systems which will be described later), will be explained.

The "amount of change per unit time" of "the air/fuel ratio represented by the output value Vabyfs of the air/fuel ratio sensor 55 (i.e., detected air/fuel ratio abyfs)" increases as a deviation of "the air/fuel ratio of an air-fuel mixture supplied to a certain cylinder" from "the air/fuel ratio of air-fuel mixtures supplied to the remaining cylinders" increases, as will be described later with reference to FIGS. 8A-8C. In the following description, the cylinder to which the air-fuel mixture having the air/fuel ratio that deviates from the air/fuel ratio of the air-fuel mixtures supplied to the remaining cylinders is supplied will also be called "imbalance cylinder", and the air/fuel ratio of the air-fuel mixture supplied to the imbalance cylinder will also be called "the air/fuel ratio of the imbalance cylinder". Also, the remaining cylinders (i.e., cylinders other than the imbalance cylinder) will also be called "non-imbalance cylinders" or "normal cylinders", and the air/fuel ratio of the air-fuel mixtures supplied to the non-imbalance cylinders will also be called "the air/fuel ratio of the non-imbalance cylinders or the air/fuel ratio of the normal cylinders".

The "amount of change of the detected air/fuel ratio abyfs per unit time" may be said to be a time differential value of the detected air/fuel ratio abyfs when the unit time is an extremely short time, for example, about 4 msec.; therefore, it will also be called "the rate of change ΔAF of the detected air/fuel ratio". Thus, the absolute value of the rate of change ΔAF of the detected air/fuel ratio increases as a deviation of the air/fuel ratio of the imbalance cylinder from that of the normal cylinders increases.

In addition, the air/fuel ratio sensor 55 includes protective covers (the outer protective cover 55*b* and the inner protective cover 55*c*). Therefore, the rate of change ΔAF of the detected air/fuel ratio is less likely or unlikely to be influenced by the engine speed NE.

Accordingly, on the basis of "a command amount of air/fuel ratio change rate which varies in accordance with the rate of change ΔAF of the detected air/fuel ratio (e.g., the average value of the absolute values of a plurality of detected air/fuel ratio change rates ΔAF, or the maximum value among the absolute values of a plurality of detected air/fuel ratio change rates ΔAF)", a cylinder-to-cylinder A/F imbalance determination can be made with high accuracy, without being strongly influenced by the engine speed NE, for the reason as will be described in detail below.

Exhaust gases from the respective cylinders reach the air/fuel ratio sensor 55 in the order of ignition. Where no cylinder-to-cylinder A/F imbalance condition occurs, exhaust gases that are emitted from the respective cylinders and reach the air/fuel ratio sensor 55 have substantially the same air/fuel ratio. Accordingly, the detected air/fuel ratio abyfs represented by the output value Vabyfs of the air/fuel ratio sensor 55 when no cylinder-to-cylinder A/F imbalance condition occurs varies as shown in FIG. 8A by way of example. Namely, when no cylinder-to-cylinder A/F imbalance condition occurs, the waveform of the output value Vabyfs of the air/fuel ratio sensor 55 is generally flat. Therefore, the absolute value of the rate of change ΔAF of the detected air/fuel ratio is small.

When "a cylinder-to-cylinder A/F imbalance condition (shift-to-rich imbalance condition) in which only the air/fuel ratio of a particular cylinder (e.g., the first cylinder) shifts to the rich side relative to the stoichiometric air/fuel ratio" occurs, a large difference arises between the air/fuel ratio of the exhaust gas of the particular cylinder (the air/fuel ratio of the imbalance cylinder) and the air/fuel ratio of exhaust gas of the cylinders other than the particular cylinder (the air/fuel ratio of the normal cylinders, the air/fuel ratio of the non-imbalance cylinders).

Figure 8A:
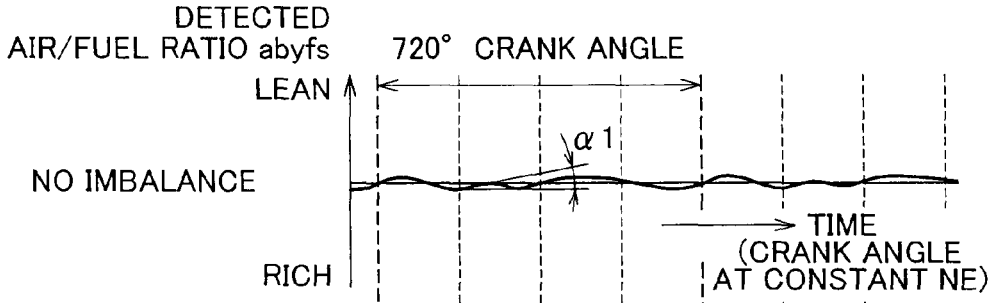
FIG. 8A-FIG. 8C are views each showing changes in the detected air/fuel ratio obtained based on the output value of the air/fuel ratio sensor.
Figure 8B:
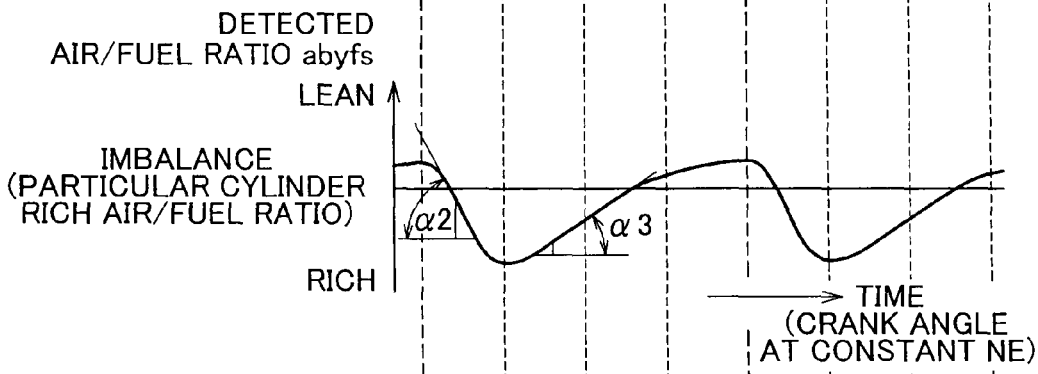

Accordingly, in the case of the four-cylinder, four-cycle engine, the detected air/fuel ratio abyfs represented by the output value Vabyfs of the air/fuel ratio sensor 55 when the shift-to-rich A/F imbalance condition occurs varies largely every 720° crank angle (which is a crank angle required to complete single combustion cycles in all of the cylinders from which exhaust gases that will reach the air/fuel ratio sensor 55 are discharged), as shown in FIG. 8B by way of example. In this specification, "a period of time corresponding to the crank angle required to complete single combustion cycles in all of the cylinders from which exhaust gases that will reach the air/fuel ratio sensor 55 are discharged" will also be called "unit combustion cycle period".

More specifically, in the example as shown in FIG. 8B where the first cylinder is the imbalance cylinder, the detected air/fuel ratio abyfs becomes equal to a value richer than the stoichiometric air/fuel ratio when the exhaust gas from the first cylinder reaches the air/fuel ratio sensing element 55*a* of the air/fuel ratio sensor 55, and the detected air/fuel ratio abyfs continuously varies so as to be closer to and equal to the stoichiometric ratio or a value slightly leaner than the stoichiometric ratio when exhaust gases from the remaining cylinders reach the air/fuel ratio sensing element 55*a*. The detected air/fuel ratio abyfs becomes closer to and eventually equal to a value slightly leaner than the stoichiometric ratio when the exhaust gases from the remaining cylinders reach the air/fuel ratio sensing element 55*a*, owing to the conventional air/fuel ratio feedback control as described above.

Figure 8C:
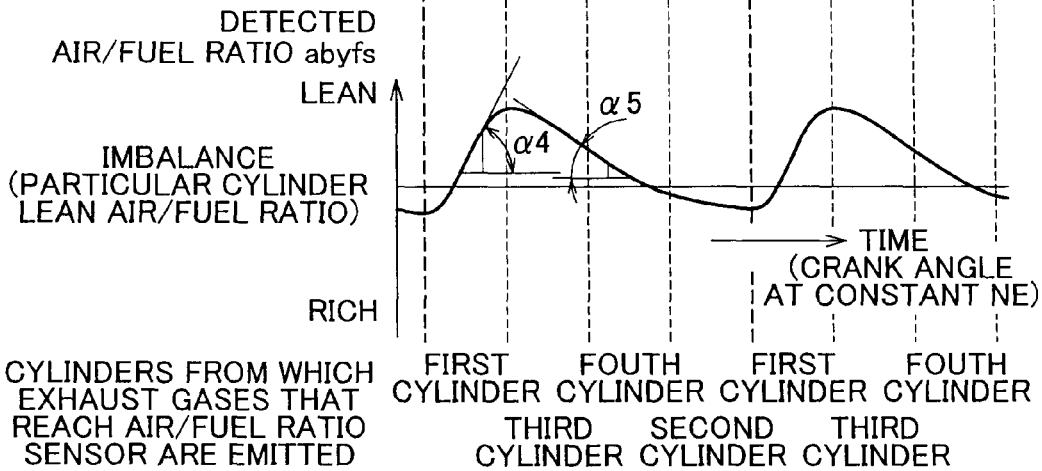

On the other hand, when "a cylinder-to-cylinder A/F imbalance condition (shift-to-lean imbalance condition) in which only the air/fuel ratio of a particular cylinder (e.g., the first cylinder) shifts to the lean side relative to the stoichiometric air/fuel ratio" occurs, the detected air/fuel ratio abyfs represented by the output value Vabyfs of the air/fuel ratio sensor 55 varies largely every 720° crank angle, as shown in FIG. 8C by way of example.

More specifically, in the example as shown in FIG. 8C, the detected air/fuel ratio abyfs becomes equal to a value leaner than the stoichiometric air/fuel ratio when the exhaust gas from the first cylinder reaches the air/fuel ratio sensing element 55*a*, and the detected air/fuel ratio abyfs continuously varies so as to be closer to and eventually equal to the stoichiometric ratio or a value slightly richer than the stoichiometric ratio when exhaust gases from the remaining cylinders reach the air/fuel ratio sensing element 55*a*. The detected air/fuel ratio abyfs becomes closer to and eventually equal to a value slightly richer than the stoichiometric ratio when the exhaust gases from the remaining cylinders reach the air/fuel ratio sensing element 55*a*, owing to the conventional air/fuel ratio feedback control as described above.

As is apparent from FIG. 8A-FIG. 8C, the absolute value (the magnitude of each angle α2-α5) of the rate of change ΔAF of the detected air/fuel ratio" as a time differential value of the detected air/fuel ratio abyfs when a cylinder-to-cylinder A/F imbalance condition occurs is noticeably larger than the absolute value (the magnitude of angle α1) of the rate of change ΔAF of the detected air/fuel ratio when no cylinder-to-cylinder A/F imbalance condition occurs.

Accordingly, a cylinder-to-cylinder A/F imbalance determination can be made by acquiring a command amount of the air/fuel ratio change rate which varies in accordance with the rate of change ΔAF of the detected air/fuel ratio (for example, the detected air/fuel ratio change rate ΔAF obtained at given infinitesimal time intervals, the average value of the absolute values of a plurality of detected air/fuel ratio changes rates ΔAF obtained over a certain period, or the maximum value among the absolute values of a plurality of detected air/fuel ratio change rates ΔAF obtained over a certain period) "as a parameter for use in imbalance determination", based on the output value Vabyfs of the air/fuel ratio sensor 55, and comparing the command amount of the air-fuel ratio change rate with a given threshold value for use in imbalance determination, for example. It is found by experiment that, when a shift-to-rich imbalance condition occurs, the detected air/fuel ratio abyfs decreases relatively rapidly, and then increases relatively gently or slowly, as shown in FIG. 8B. It is also found that, when a shift-to-lean imbalance condition occurs, the detected air/fuel ratio abyfs increases relatively rapidly, and then decreases relatively gently or slowly, as shown in FIG. 8C. Accordingly, the magnitude of α2 is larger than the magnitude of α5, and the magnitude of α4 is larger than the magnitude of α3.

Next, the reasons why the detected air/fuel ratio change rate ΔAF is hardly influenced by the engine speed will be explained. As described above, the air/fuel ratio sensor 55 has the air/fuel ratio sensing element 55*a*, and the protective covers (55*b*, 55*c*) for the air/fuel ratio sensing element 55*a*. The air/fuel ratio sensing element 55*a* is housed in the protective covers (55*b*, 55*c*) such that the protective covers surround the air/fuel ratio sensing element 55*a*. Furthermore, the protective covers (55*b*, 55*c*) have the inlet holes (55*b*1, 55*c*1) through which exhaust gas EX flowing in the exhaust passage flows into the protective covers (55*b*, 55*c*) and reaches the air/fuel ratio sensing element 55*a*, and the outlet holes (55*b*2, 55*c*2) through which the exhaust gas introduced into the protective covers flows out into the exhaust passage.

The air/fuel ratio sensor 55 is positioned such that the protective covers (55*b*, 55*c*) are exposed to the exhaust collecting portion 41*b* or a portion of the exhaust passage downstream of the exhaust collecting portion 41*b* (and upstream of the upstream catalyst 43). More specifically, the air/fuel ratio sensor 55 is placed in the exhaust passage such that the bottom walls of the protective covers (55*b*, 55*c*) extend in parallel with the flow of the exhaust gas EX, and the center axis of the protective covers (55*b*, 55*c*) is orthogonal to the flow of the exhaust gas EX. Accordingly, the exhaust gas EX flowing in the exhaust passage flows into a space between the outer protective cover 55*b* and the inner protective cover 55*c*, through the inlet holes 55*b*1 of the outer protective cover 55*b*, as indicated by arrow Ar1 in FIG. 2 and FIG. 3, and flows into the inner protective cover 55*c* through the inlet holes 55*c*1 of the inner protective cover 55*c*, as indicated by arrow Art. Thereafter, the exhaust gas EX reaches the air/fuel ratio sensing element 55*a*. Then, the exhaust gas flows out into the exhaust passage, through the outlet holes 55*c*2 of the inner protective cover 55*c* and the outlet holes 55*b*2 of the outer protective cover 55*b*, as indicated by arrow Ar3.

Namely, the exhaust gas in the exhaust passage, when reaching the inlet holes 55*b*1 of the outer protective cover 55*b*, is drawn into the protective covers (55*b*, 55*c*), due to the flow of the exhaust gas EX in the exhaust passage in the vicinity of the outlet holes 55*b* of the outer protective cover 55*b*.

Therefore, the flow rate of the exhaust gas in the protective covers (55*b*, 55*c*) varies in accordance with the flow rate of the exhaust gas EX in the exhaust passage, which flows in the vicinity of the outlet holes 55*b*2 of the outer protective cover 55*b* (namely, in accordance with the intake air flow rate Ga as the amount of intake air per unit time). In other words, the length of time from "a point in time at which exhaust gas (first exhaust gas) having a certain air/fuel ratio reaches the inlet holes 55*b*1" to "a point in time at which the first exhaust gas reaches the air/fuel ratio sensing element 55*a*" depends on the intake air flow rate Ga, but does not depend on the engine speed NE. This also applies to an air/fuel ratio sensor having only the inner protective cover.

Figure 9:
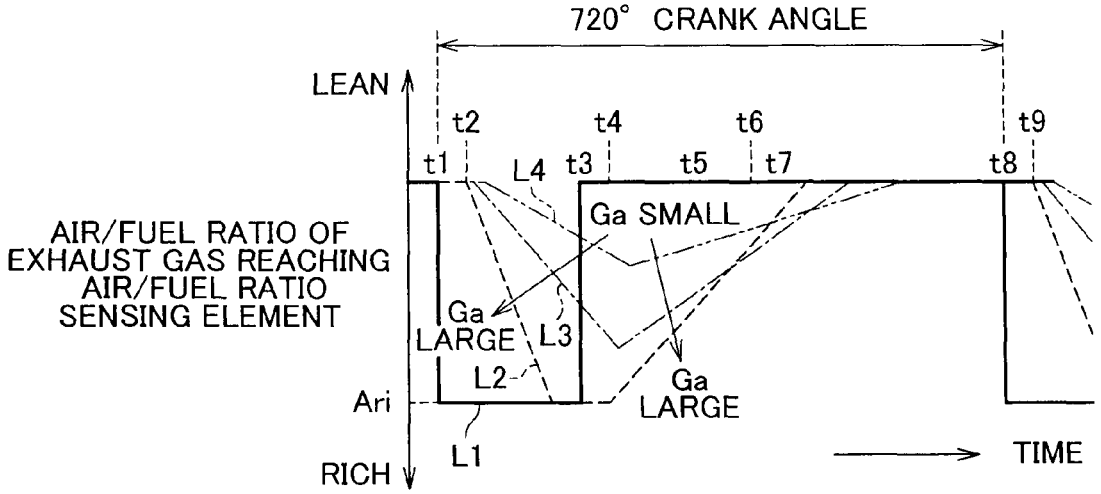
FIG. 9 is a view showing changes in the air/fuel ratio of exhaust gas that reaches inlet holes of an outer protective cover of the air/fuel ratio sensor, and the air/fuel ratio of gas that reaches the air/fuel ratio sensing element.

FIG. 9 schematically shows changes in the air/fuel ratio of exhaust gas with time when a shift-to-rich A/F imbalance condition in which the air/fuel ratio of exhaust gas from a particular cylinder shifts to the rich side occurs. In FIG. 9, line L1 indicates the air/fuel ratio of exhaust gas that reaches the inlet holes 55*b*1 of the outer protective cover 55*b*, and line L2, line L3 and line 4 indicate the air/fuel ratio of exhaust gas that reaches the air/fuel ratio sensing element 55*a*. More specifically, line 2 corresponds to the case where the intake air flow rate Ga is relatively large, and line 3 corresponds to the case where the intake air flow rate Ga is within a middle range, while line 4 corresponds to the case where the intake air flow rate Ga is relatively small.

When the exhaust gas of a particular cylinder in which the air/fuel ratio shifts to the rich side reaches the inlet holes 55*b*1 at time t1, as indicated by line L1, the gas passes through the inlet holes (55*b*1, 55*c*1), and starts reaching the air/fuel ratio sensing element 55*a* at a time point (time t2) slightly later than time t1. At this time, the flow rate of the exhaust gas flowing within the protective covers 55*b*, 55*c* is determined by the flow rate of the exhaust gas flowing in the exhaust passage, as described above.

Accordingly, the air/fuel ratio of gas that contacts the air/fuel ratio sensing element 55*a* starts changing from a point in time that is closer to time t1 as the intake air flow rate Ga is larger. It is also to be noted that the air/fuel ratio of exhaust gas that contacts the air/fuel ratio sensing element 55*a* is the air/fuel ratio of exhaust gas as a mixture of "exhaust gas that newly reaches the air/fuel ratio sensing element 55*a*" and "exhaust gas that is already present in the vicinity of the air/fuel ratio sensing element 55*a*". Accordingly, the rate of change of the air/fuel ratio of exhaust gas that contacts (reaches) the air-fuel rate sensing element 55*a* (the rate of change as a time differential value of the air/fuel ratio, namely, the gradients of lines L2-L4 in FIG. 9) increases as the intake air flow rate Ga increases.

Then, exhaust gas of a normal cylinder in which no shift to rich occurs reaches the inlet holes 55*b*1 at time t3, and the gas starts reaching the air/fuel ratio sensing element 55*a* at a point in time (around time t4) slightly later than time t3. The "flow rate of the exhaust gas from the normal cylinder in which no shift to rich occurs, in the protective covers (55*b*, 55*c*)" is also determined by the flow rate of the exhaust gas EX flowing in the exhaust passage (and therefore determined by the intake air flow rate Ga). Accordingly, the air/fuel ratio of exhaust gas that contacts (reaches) the air/fuel ratio sensing element 55*a* increases more rapidly as the intake air flow rate Ga increases.

When the intake air flow rate Ga is relatively small, exhaust gas of "the cylinder of which the exhaust stroke comes next to that of the particular cylinder and in which no shift to rich occurs" reaches the air/fuel ratio sensing element 55*a*, at a point in time prior to a point in time at which the air/fuel ratio of exhaust gas that contacts the air/fuel ratio sensing element 55*a* becomes equal to "the air/fuel ratio Ari of exhaust gas of the particular cylinder in which a shift to rich occurs", as indicated by line L3 and line L4. Accordingly, the air/fuel ratio of exhaust gas that contacts the air/fuel ratio sensing element 55*a* starts changing (increasing) toward the lean side before it becomes equal to the air/fuel ratio Ari of exhaust gas of the particular cylinder.

Figure 10:
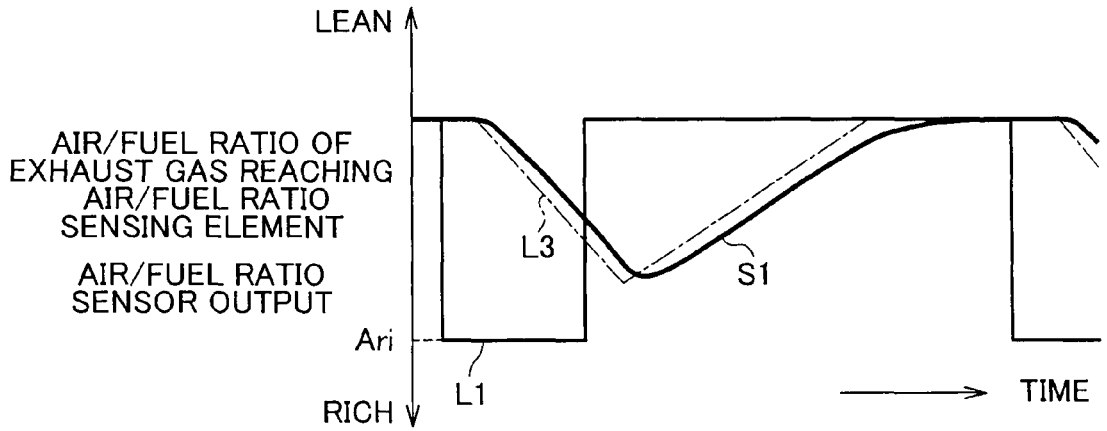
FIG. 10 is a view showing changes in the air/fuel ratio of exhaust gas that reaches the inlet holes of the outer protective cover of the air/fuel ratio sensor, the air/fuel ratio of gas that reaches the air/fuel ratio sensing element, and the output value of the air/fuel ratio sensor.

In the meantime, the output value Vabyfs of the air/fuel ratio sensor 55 (in fact, the output value Vabyfs of the air/fuel ratio sensing element 55*a*) changes with a slight delay in accordance with changes in the air/fuel ratio of gas that reaches the air/fuel ratio sensing element 55*a*. Accordingly, as shown in FIG. 10, the output value Vabyfs of the air/fuel ratio sensor 55 changes as indicated by solid line S1 as the air/fuel ratio of exhaust gas that reaches the air/fuel ratio sensing element 55*a* changes as indicated by one-dot chain line L3.

Figure 11A:
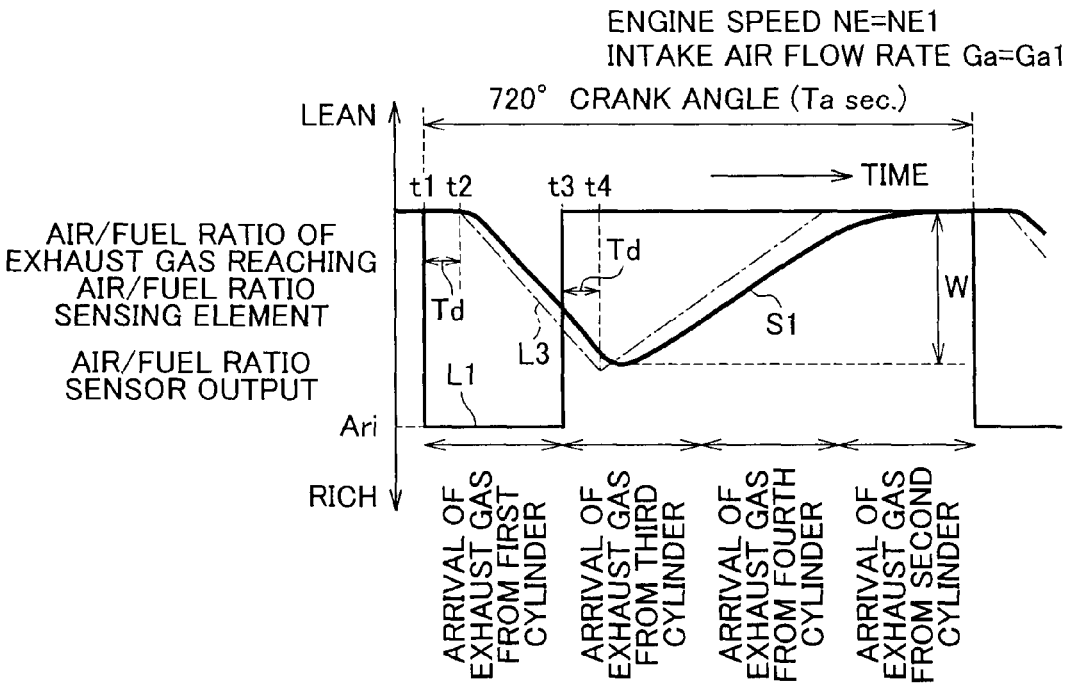
FIG. 11A and FIG. 11B are views useful for explaining that the rate of change of the detected air/fuel ratio is not influenced by the engine speed, each of which views shows changes in the air/fuel ratio of exhaust gas that reaches the inlet holes of the outer protective cover of the air/fuel ratio sensor, the air/fuel ratio of gas that reaches the air/fuel ratio sensing element, and the output value of the air/fuel ratio sensor.
Figure 11B:
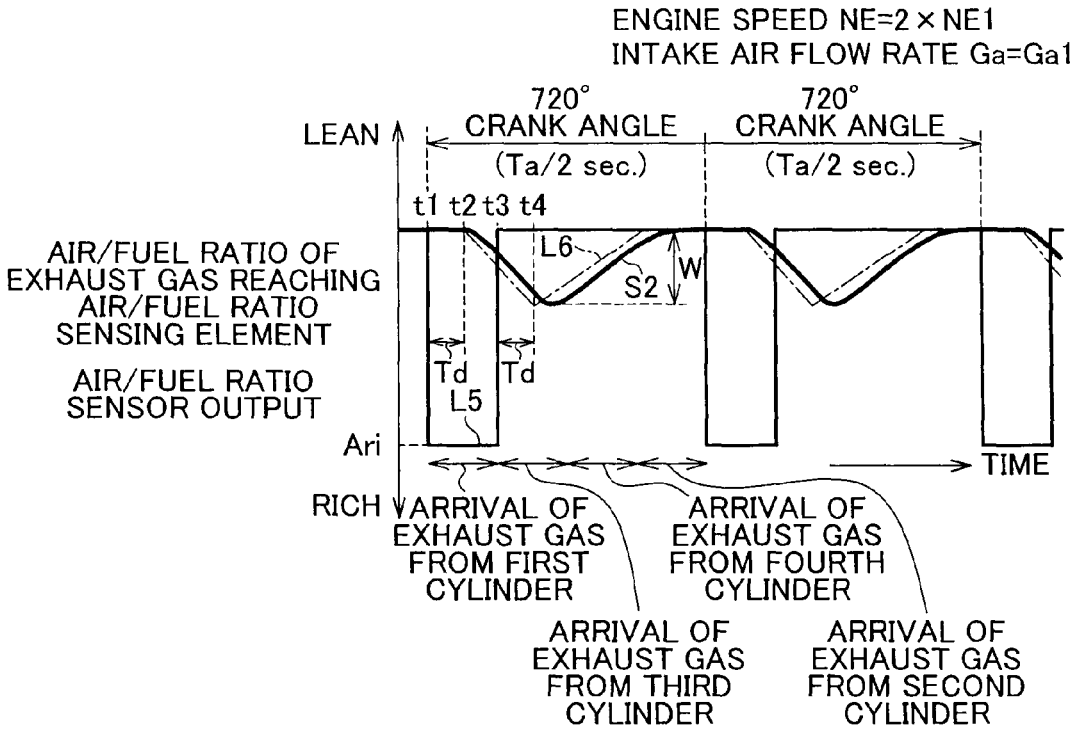

FIG. 11A and FIG. 11B are views useful for explaining about the output value Vabyfs of the air/fuel ratio sensor 55 when an A/F imbalance condition occurs in which the air/fuel ratio of a particular cylinder shifts to the rich side, and the intake air flow rate Ga is constant while the engine speed NE is varied.

FIG. 11A shows "the air/fuel ratio (line L1) of exhaust gas that reaches the inlet holes 55*b* of the outer protective cover", "the air/fuel ratio (line L3) of gas that reaches the air/fuel ratio sensing element 55*a*", and "the output value Vabyfs (line S1) of the air/fuel ratio sensor 55" in the case where the engine speed NE is equal to a given value NE1, and the intake air flow rate Ga is equal to a given value Ga1.

FIG. 11B shows "the air/fuel ratio (line L5) of exhaust gas that reaches the inlet holes 55*b* of the outer protective cover", "the air/fuel ratio (line L6) of gas that reaches the air/fuel ratio sensing element 55*a*", and "the output value Vabyfs (line S2) of the air/fuel ratio sensor 55" in the case where the engine speed NE is twice as high as the given value NE1 (2×NE1), and the intake air flow rate Ga is equal to the given value Ga1.

As described above, the flow rate of exhaust gas that flows in the protective covers (55*b*, 55*c*) is determined by the intake air flow rate Ga. Accordingly, if the intake air flow rate Ga does not change but is constant, the rate of change of the output value Vabyfs of the air/fuel ratio sensor 55 does not change, and therefore the rate of change (or gradient) ΔAF of the detected air/fuel ratio does not change, even if the engine speed NE changes. Furthermore, if the intake air flow rate Ga does not change, "a period of time from a point in time (time t1) at which the exhaust gas of the particular cylinder in which a shift to rich occurs reaches the inlet holes 55*b*1 to a point in time (time t2) at which the gas starts reaching the air/fuel ratio sensing element 55*a*" is a fixed or constant period of time Td even if the engine speed NE changes. In addition, if the intake air flow rate Ga dos not change, "a period of time from a point in time (time t3) at which the exhaust gas of the cylinder in which no shift to rich occurs reaches the inlet holes 55*b*1 to a point in time (time t4) at which the gas starts reaching the air/fuel ratio sensing element 55*a*" is similarly a fixed or constant period of time Td. As a result, the output value Vabyfs of the air/fuel ratio sensor 55 varies as indicated in FIG. 11A and FIG. 11B.

As is understood from FIG. 11A and FIG. 11B, the width (W) or extent of variation in the output value Vabyfs of the air/fuel ratio sensor 55 is reduced as the engine speed NE increases. Namely, the length of a trace of the output value Vabyfs of the air/fuel ratio sensor 55 varies largely depending on the engine speed NE. Accordingly, when a cylinder-to-cylinder A/F imbalance determination is made based on the trace length of the output value Vabyfs of the air/fuel ratio sensor 55, a reference value to be compared with the trace length must be determined with high accuracy in accordance with the engine speed NE.

On the other hand, the detected air/fuel ratio change rate ΔAF is hardly influenced by the engine speed NE; therefore, a value (air/fuel ratio change rate command amount) that varies with the detected air/fuel ratio change rate ΔAF is also hardly influenced by the engine speed NE. Accordingly, if an imbalance determination is made using the air/fuel ratio change rate command value (for example, if an imbalance determination is made by making a comparison in magnitude between the absolute value of the air/fuel ratio change rate command amount and a given threshold value for use in imbalance determination), a cylinder-to-cylinder A/F imbalance determination can be made with high accuracy, irrespective of the engine speed NE.

Figure 12A:
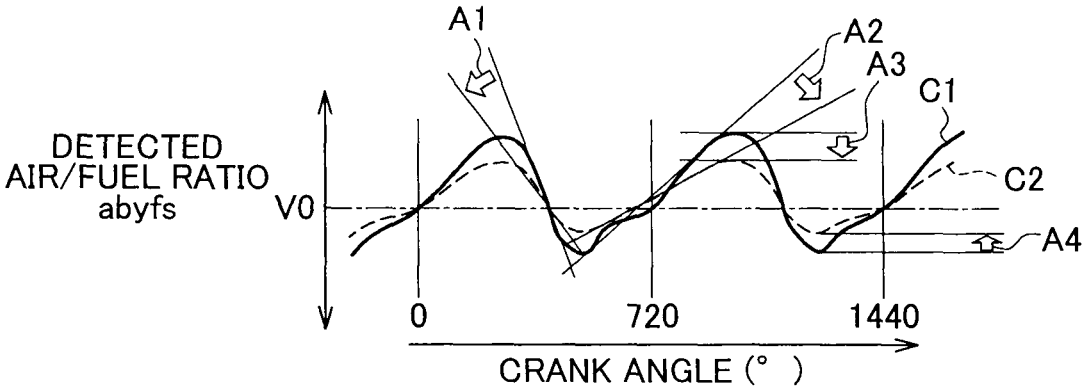
FIG. 12A and FIG. 12B are views each showing changes in the output value (solid line) of a reference air/fuel ratio sensor and the output value (broken line) of an air/fuel ratio sensor whose output characteristic deviates from that of the reference air/fuel ratio sensor.
Figure 12B:
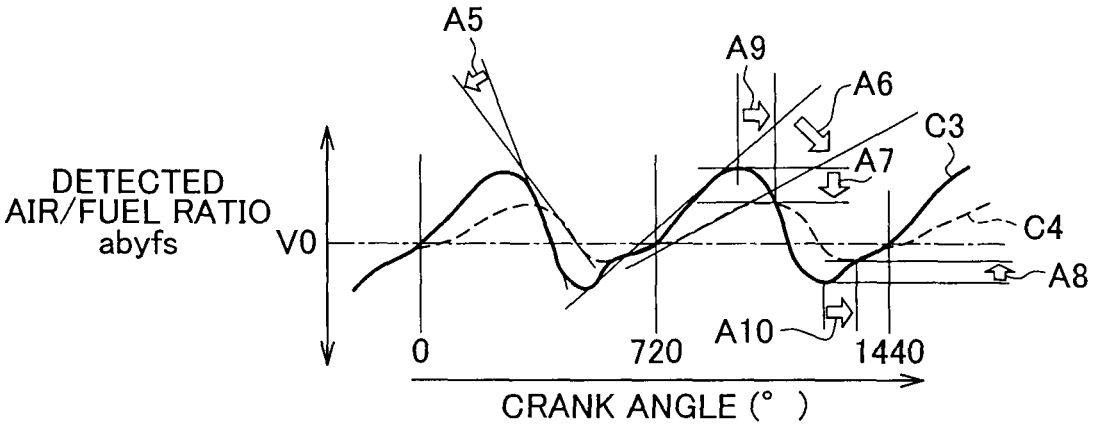

The first determination system (and other determination systems which will be described later) evaluates the output characteristics of the air/fuel ratio sensor 55. In the following, the output characteristics of the air/fuel ratio sensor 55 will be explained with reference to FIG. 12A and FIG. 12B. FIG. 12A and FIG. 12B both show "changes or variations in the detected air/fuel ratio abyfs obtained based on the output value Vabyfs of the air/fuel ratio sensor 55, with respect to the crank angle" in "the case where a cylinder-to-cylinder A/F imbalance condition occurs (where the air/fuel ratio of an imbalance cylinder deviates by some degree from the air/fuel ratio of normal cylinders)".

(1) First, change of an output characteristic in the form of reduction of the output gain (output value Vabyfs) of the air/fuel ratio sensor 55 will be explained. In FIG. 12A, solid line C1 indicates the detected air/fuel ratio abyfs represented by the output value Vabyfs of a "reference air/fuel ratio sensor". In FIG. 12A, broken line C2 indicates the detected air/fuel ratio abyfs represented by the output value Vabyfs of "the air/fuel ratio sensor 55 of which the output value Vabyfs is reduced (or the gain is reduced)".

As shown in FIG. 12A, if the gain of the output value Vabyfs of the air/fuel ratio sensor 55 is reduced, the output value Vabyfs changes such that "a difference between the output value Vabyfs and value V0 (Vstoich) corresponding to the stoichiometric air/fuel ratio is reduced".

As a result, if the gain of the output value Vabyfs of the air/fuel ratio sensor 55 is reduced, the absolute value of the rate of change ΔAF of the detected air/fuel ratio obtained when the detected air/fuel ratio change rate ΔAF becomes negative (the gradient of the detected air/fuel ratio abyfs) is reduced as indicated by arrow A1 in FIG. 12A. Similarly, if the gain of the output value Vabyfs of the air/fuel ratio sensor 55 is reduced, the absolute value of the detected air/fuel ratio change rate ΔAF obtained when the change rate ΔAF becomes positive (the gradient of the detected air/fuel ratio abyfs) is reduced as indicated by arrow A2 in FIG. 12A. Furthermore, the maximum value of the detected air/fuel ratio abyfs is reduced as indicated by arrow A3 in FIG. 12A, and the minimum value of the detected air/fuel ratio abyfs is increased as indicated by arrow A4 in FIG. 12A.

Accordingly, if the output characteristic of the air/fuel ratio sensor 55 changes, more specifically, if "the output gain is reduced", the determination system may not be able to accurately make an A/F imbalance determination as to whether a cylinder-to-cylinder A/F imbalance condition occurs, by making a comparison between a value (one type of parameter for use in imbalance determination) corresponding to the absolute value of the detected air/fuel ratio change rate ΔAF and a given threshold value for use in imbalance determination, or making a comparison between a value (one type of parameter for use in imbalance determination) corresponding to the absolute value of a second-order differential value of the detected air/fuel ratio abyfs and a given threshold value for use in imbalance determination, or by making a comparison between the maximum value or minimum value (one type of parameter for use in imbalance determination) of the detected air/fuel ratios abyfs and a given threshold value for use in imbalance determination, or making a comparison between the trance length (one type of parameter for use in imbalance determination) of the detected air/fuel ratio abyfs and a given threshold value for use in imbalance determination.

(2) Next, change of an output characteristic in the form of reduction of the response of the air/fuel ratio sensor 55 will be explained. In FIG. 12B, solid line C3 indicates the detected air/fuel ratio abyfs represented by the output value Vabyfs of the "reference air/fuel ratio sensor", and broken line C4 indicates the detected air/fuel ratio abyfs represented by the output value Vabyfs of the air/fuel ratio sensor 55 whose output response is reduced".

If the response of the air/fuel ratio sensor 55 is reduced, the absolute value (the gradient of the detected air/fuel ratio abyfs) of the rate of change ΔAF of the detected air/fuel ratio obtained when the detected air/fuel ratio change rate ΔAF becomes negative is reduced as indicated by arrow A5 in FIG. 12B. Similarly, the absolute value (the gradient of the detected air/fuel ratio abyfs) of the detected air/fuel ratio change rate ΔAF obtained when the change rate ΔAF becomes positive is reduced as indicated by arrow A6 in FIG. 12B. Furthermore, the maximum value of the detected air/fuel ratio abyfs is reduced as indicated by arrow A7 in FIG. 12B, and the minimum value of the detected air/fuel ratio abyfs is increased as indicated by arrow A8 in FIG. 12B.

Accordingly, if the output characteristic of the air/fuel ratio sensor 55 changes, more specifically, if "the response is reduced", the determination system may not be able to accurately make an A/F imbalance determination as to whether a cylinder-to-cylinder A/F imbalance condition occurs, by making a comparison in magnitude between any of the above-described parameters for use in imbalance determination, and a given threshold value for use in imbalance determination.

Furthermore, if the response of the air/fuel ratio sensor 55 is reduced, the crank angle at which the maximum value of the detected air/fuel ratio abyfs appears is delayed as indicated by arrow A9 in FIG. 12B. Similarly, if the response of the air/fuel ratio sensor 55 is reduced, the crank angle at which the minimum value of the detected air/fuel ratio abyfs appears is delayed as indicated by arrow A10 in FIG. 12B. Accordingly, when the determination system is configured to specify an imbalance cylinder based on the crank angle(s) (or time) at which the maximum value and/or minimum value of the detected air/fuel ratio abyfs appear, the system may not be able to specify the imbalance cylinder with high accuracy.

Therefore, the first determination system is adapted to carry out a process of making a determination (air/fuel ratio sensor adequacy determination, sensor adequacy determination) as to whether the output characteristics of the air/fuel ratio sensor 55 are adequate or suitable for making an A/F imbalance determination, by a method as described below.

Figure 13A:
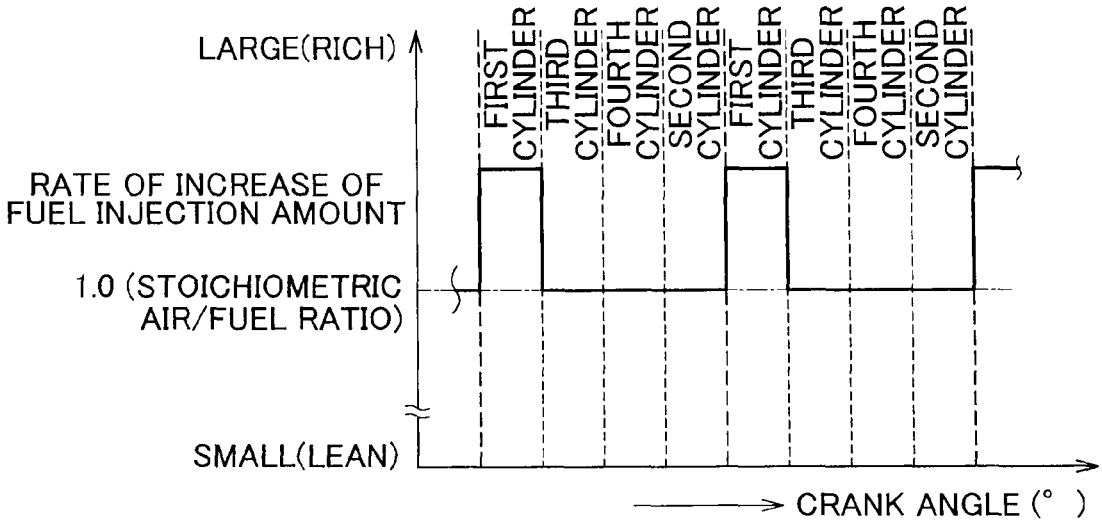
FIG. 13A and FIG. 13B are views each showing the rate of increase of the fuel injection amount with respect to each cylinder in a forced imbalance condition (forced rich imbalance condition)

More specifically described, the first determination system initially creates a cylinder-to-cylinder A/F imbalance condition, namely, forcedly causes a cylinder-to-cylinder A/F imbalance condition to occur in the engine. Namely, the first determination system increases the amount of fuel injected into a particular cylinder (e.g., the first cylinder), as indicated in FIG. 13A, so as to forcedly set "the air/fuel ratio of an air-fuel mixture supplied to the particular cylinder (the air/fuel ratio of the particular cylinder, the air/fuel ratio of the forced imbalance cylinder)" to an air/fuel ratio richer or smaller than "the air/fuel ratio of air-fuel mixtures supplied to the other cylinders (the second through fourth cylinders) (the air/fuel ratio of the non-forced-imbalance cylinders)". The air/fuel ratio of the other cylinders is set to the stoichiometric air-fuel ratio. The condition established in this manner will be called "forced imbalance condition".

Figure 13B:
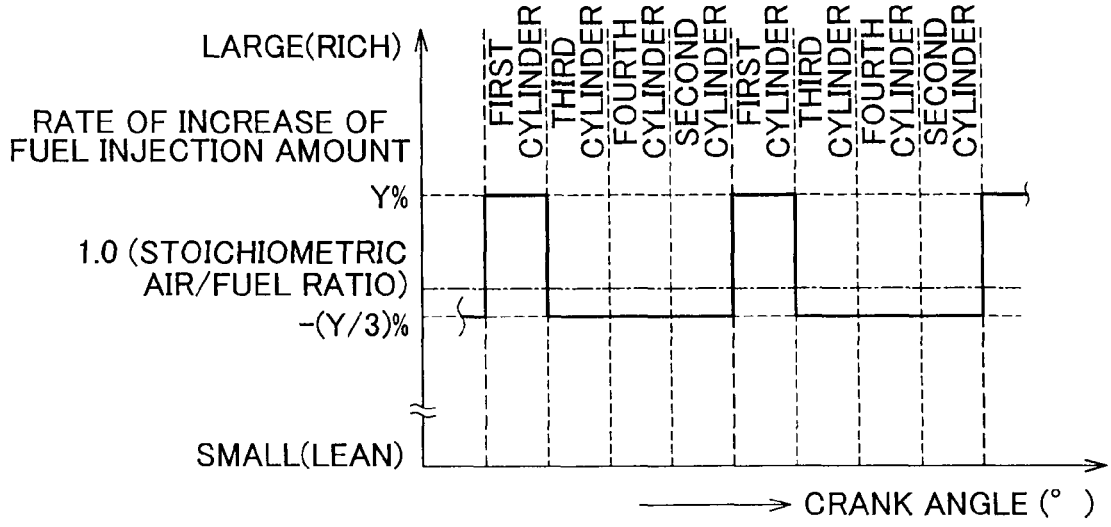

In an alternative method, as shown in FIG. 13B, the first determination system may increase the amount of fuel injected into the forced imbalance cylinder by Y % (e.g., 45%), so that the air/fuel ratio of the forced imbalance cylinder is shifted to be richer by a certain value than the stoichiometric air-fuel ratio, and reduce the amount of fuel injected into each of the non-forced-imbalance cylinders by (Y/3) %, so that the air/fuel ratio of the non-forced-imbalance cylinders is set to a value that is leaner than the stoichiometric air-fuel ratio. In this manner, the average air/fuel ratio of air-fuel mixtures supplied to the engine as a whole can be kept at the stoichiometric air/fuel ratio, and therefore, deterioration of emissions can be avoided.

After creating the cylinder-to-cylinder A/F imbalance condition, the first determination system obtains the rate of change ΔAF of the detected air/fuel ratio in the forced A/F imbalance condition. More specifically, the first determination system obtains an output value Vabyfs of the air/fuel ratio sensor each time a given sampling time ts elapses (i.e., at intervals of a given sampling time ts), and obtains a detected air/fuel ratio abyfs based on the output value Vabyfs with reference to the air/fuel ratio conversion table Mapabyfs. Then, the first determination system obtains "a rate of change ΔAF of the detected air/fuel ratio at the present time (the detected air/fuel ratio change rate ΔAF(n) of this cycle)" by subtracting "the detected air/fuel ratio abyfs obtained at a point in time preceding the present time by the given sampling time ts (the detected air/fuel ratio abyfs(n−1) of the last cycle" from "the detected air/fuel ratio abyfs obtained at the present time (detected air/fuel ratio abyfs(n) of this cycle)".

Then, the first determination system obtains "a parameter for use in evaluation of the air/fuel ratio sensor (evaluation parameter)" representing the output characteristics of the air/fuel ratio sensor 55. More specifically, the first determination system calculates "the average value of the absolute values |ΔAF| of a plurality of detected air/fuel ratio change rates ΔAF obtained over an evaluation data collection period that is longer than the given sampling time ts", as the evaluation parameter. The evaluation data collection period is desirably determined by multiplying the unit combustion cycle period by a factor of a natural number.

Subsequently, the first determination system reads a reference parameter stored in advance in the ROM, from the ROM. The reference parameter corresponds to the evaluation parameter obtained based on the output value Vabyfs of the reference air/fuel ratio sensor when the reference air/fuel ratio sensor is mounted in the engine in place of the air/fuel ratio sensor 55 and the forced imbalance condition is created in the engine. Namely, the reference parameter is "the average value of the absolute values |ΔAF| of a plurality of detected air/fuel ratio change rates ΔAF obtained over the evaluation data collection period longer than the given sampling time ts" in the forced imbalance condition when the output characteristics of the air/fuel ratio sensor 55 coincide with the output characteristics of the reference air/fuel ratio sensor.

Then, the first determination system compares the obtained evaluation parameter with the reference parameter read from the ROM, and determines that the air/fuel ratio sensor 55 is "adequate for making an A/F imbalance determination" if the absolute value of a difference between the parameters is smaller than a given threshold value. If the absolute value of the difference between the parameters is equal to or larger than the given threshold value, the first determination system determines that the air/fuel ratio sensor 55 is "not adequate (inappropriate) for making an A/F imbalance determination".

When the first determination system determines that the air/fuel ratio sensor 55 is "adequate for making an A/F imbalance condition", the system makes a cylinder-to-cylinder A/F imbalance determination, based on the above-described command amount of the air/fuel ratio change rate. If, on the other hand, the first determination system determines that the air/fuel ratio sensor 55 is not adequate for making an A/F imbalance condition", the system inhibits itself from making a cylinder-to-cylinder A/F imbalance determination based on the above-described command amount of the air/fuel ratio change rate. The inhibition against making a cylinder-to-cylinder A/F imbalance determination includes invalidating the result of cylinder-to-cylinder A/F imbalance determination, even if the determination is actually made. The summary of the operation of the first determination system has been heretofore described.

Next, the actual operation of the first determination system will be described. The CPU of the electric control device 60 repeatedly executes "a routine for calculating the fuel injection amount Fi and generating a fuel injection command" as shown in FIG. 14, with respect to a certain cylinder (which will also be called "cylinder into which fuel is to be injected" or "fuel injection cylinder"), each time the crank angle of the cylinder reaches a given crank angle (e.g., BTDC 90° CA) before the intake top dead center.

Figure 14:
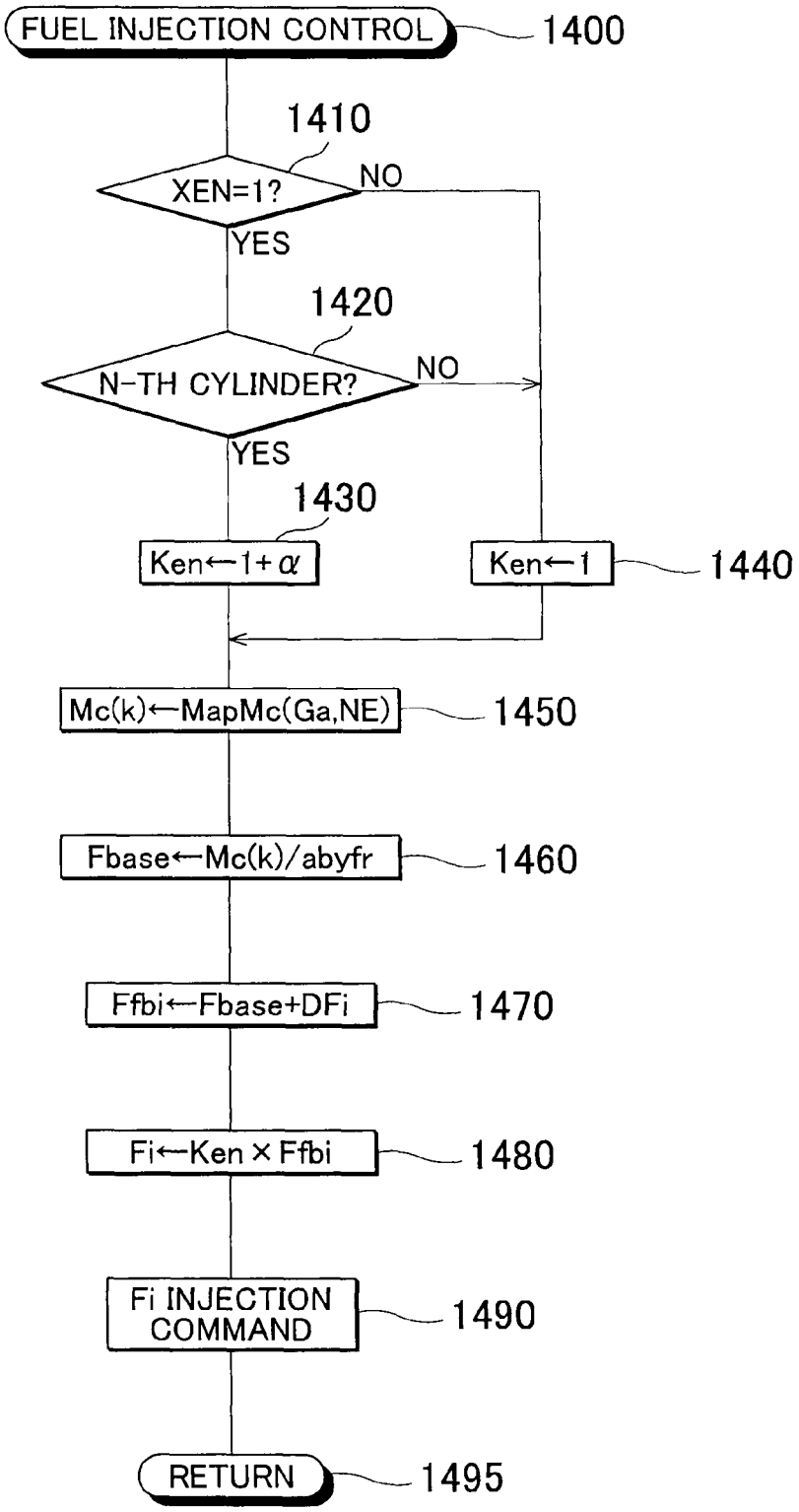
FIG. 14 is a flowchart illustrating a routine executed by CPU of an electric control device shown in FIG. 1.

The CPU starts the process of FIG. 14 from step 1400 when the time for execution of the process is reached, and proceeds to step 1410 to determine whether a value of a forced imbalance condition flag XEN is "1". The forced imbalance condition flag XEN indicates that "the engine is in a forced imbalance condition" when its value is "1", and indicates that the engine is not in a forced imbalance condition" when its value is "0".

The value of the forced imbalance condition flag XEN is set to "0" in an initial routine that is executed when the position of the ignition key switch of the vehicle in which the engine 10 is installed is changed from OFF to ON. Also, the value of the forced imbalance condition flag XEN is set to "1" when a forced imbalance condition is caused to occur through execution of a routine which will be described later, and is set to "0" when the forced imbalance condition is terminated.

Suppose the current value of the force imbalance condition flag XEN is "1". In this case, the CPU makes an affirmative decision (YES) in step 1410, and proceeds to step 1420 to determine whether the fuel injection cylinder at this point in time is the Nth cylinder. The value "N" is a natural number selected from 1 to 4. In the first determination system, the value "N" is set to "1" in a routine which will be described later. Accordingly, the CPU determines in step 1420 whether the fuel injection cylinder is the first cylinder.

If the fuel injection cylinder is the Nth cylinder (the first cylinder), the CPU makes an affirmative decision (YES) in step 1420, and proceeds to step 1430 to set a value of a fuel correction coefficient Ken to "1+α". The fuel correction coefficient Ken is a coefficient (the amount of correction of the fuel injection amount) used for creating a forced imbalance condition. In the first determination system, value "α" is set to a predetermined positive value (e.g., 0.45) in a routine which will be described later. Thereafter, the CPU sequentially executes step 1450 through step 1490 as described below, and proceeds to step 1495 to complete the current cycle of the routine of FIG. 14.

If the fuel injection cylinder is not the Nth cylinder (the first cylinder) at the time when the CPU executes step 1420, the CPU makes a negative decision (NO) in step 1420, and proceeds to step 1440 to set the value of the fuel correction coefficient Ken to "1". Thereafter, the CPU sequentially executes step 1450 through step 1490 as described below, and proceeds to step 1495 to complete the current cycle of the routine.

On the other hand, if the value of the forced imbalance condition flag XEN is not "1" at the time when the CPU executes step 1410, the CPU makes a negative decision (NO) in step 1410, and proceeds to step 1440 to set the value of the fuel correction coefficient Ken to "1". Thereafter, the CPU sequentially executes step 1450 through step 1490 as described below, and proceeds to step 1495 to complete the current cycle of the routine.

Step 1450: The CPU obtains "the in-cylinder intake air amount Mc(k)" as "the amount of air drawn into the fuel injection cylinder", based on "the intake air flow rate Ga measured by the air flow meter 51, engine speed NE and a lookup table MapMc". The in-cylinder intake air amount Mc(k) associated with each intake stroke is stored in the RAM. The in-cylinder intake air amount Mc(k) may be calculated using a known air model ("model constructed according to physical rules" which simulates the behavior of air in the intake passage).

Step 1460: The CPU obtains a basic fuel injection amount Fbase by dividing the in-cylinder intake air amount Mc(k) by an upstream target air/fuel ratio abyfr. In this embodiment, the upstream target air/fuel ratio abyfr is set to the stoichiometric air/fuel ratio stoich.

Step 1470: The CPU calculates the FB corrected injection amount (the fuel injection amount after feedback correction) Ftbi by correcting the basic fuel injection amount Fbase using an air/fuel ratio feedback amount DFi. The air/fuel ratio feedback amount DFi is set to "0" when the value of the forced imbalance condition flag XEN is "1". However, the air/fuel ratio feedback amount DFi may be calculated in the manner as described below, irrespective of whether the value of the forced imbalance condition flag XEN is "1".

The method of calculating the air/fuel ratio feedback amount DFi is known in the art. The air/fuel ratio feedback amount DFi is a correction amount for making the air/fuel ratio of the air-fuel mixture supplied to the engine equal to the stoichiometric air-fuel ratio, and may be determined in the manner as described below when a certain air/fuel ratio feedback condition or conditions are satisfied. The air/fuel ratio feedback amount DFi is set to "0" when the air/fuel ratio feedback condition or conditions are not satisfied.

The CPU obtains an output value Vabyfc for use in feedback control, according to the following expression (1).

$$Vabyfc=Vabyfs+Vafsfb \quad (1)$$

where Vabyfs is the output of the upstream air/fuel ratio sensor 55, and Vafsfb is a sub-feedback amount calculated based on the output Voxs of the downstream air/fuel ratio sensor 56. A method of calculating the sub-feedback amount Vafsfb will be described later.

The CPU obtains an air/fuel ratio abyfsc for use in feedback control, based on the above-indicated output value Vabyfc for use in feedback control, with reference to the air/fuel ratio conversion table Mapabyfs as shown in FIG. 7, as indicated in the following expression (2).

$$abyfsc=Mapabyfs(Vabyfc) \quad (2)$$

The CPU calculates "a deviation DFc of the in-cylinder fuel supply amount" representing an excess or shortage of the fuel supplied into the cylinder at a point in time that is N strokes ahead of the current time, according to the following expressions (3) through (5).

$$Fc(k-N)=Mc(k-N)/abyfsc \quad (3)$$

$$Fcr=Mc(k-N)/abyfr \quad (4)$$

$$DFc=Fcr(k-N)-Fc(k-N) \quad (5)$$

where the in-cylinder intake air amount Mc(k−N) is "the in-cylinder intake air amount at a point in time that is N cycles ahead of the current time", and the in-cylinder fuel supply amount Fc(k−N) is "the amount of fuel actually supplied to the combustion chamber 21 at the time point that is N cycles ahead of the current time", while a target in-cylinder fuel supply amount Fcr(k−N) is "the amount of fuel that should have been supplied to the combustion chamber 21 at the time point that is N cycles ahead of the current time".

The CPU calculates the air/fuel ratio feedback amount DFi according to the following expression (6).

$$DFi=Gp\times DFc+Gi\times SDFc \quad (6)$$

where Gp is a predetermined proportional gain, and Gi is a predetermined integral gain, while SDFc is "an integral value of the deviation DFc of the in-cylinder fuel supply amount".

For example, the CPU calculates the sub-feedback amount Vafsfb in the manner as described below. The CPU obtains "an output deviation DVoxs" as a difference between "the downstream target value Voxsref corresponding to the stoichiometric air/fuel ratio" and "the output Voxs of the downstream air/fuel ratio sensor 56", according to the following expression (7).

$$DVoxs=Voxsref-Voxs \quad (7)$$

The CPU obtains the sub-feedback amount Vafsfb, according to the following equation (8).

$$Vafsfb=Kp\times DVoxs+Ki\times SDVoxs+Kd\times DDVoxs \quad (8)$$

where Kp is a predetermined proportional gain (proportionality constant), and Ki is a predetermined integral gain (integral constant), while Kd is a predetermined differential gain (differential constant). SDVoxs is a time integral value of the output deviation DVoxs, and DDVoxs is a time differential value of the output deviation DVox.

Namely, the CPU calculates "the sub-feedback amount Vafsfb" according to proportional, integral and differential (PID) control, so that the output Voxs of the downstream air/fuel ratio sensor 56 becomes equal to the downstream target value Voxref. The sub-feedback amount Vafsfb is used for calculating the output value Vabyfc for use in feedback control, as indicated in the above-described expression (1).

Step 1480: The CPU calculates a final fuel injection amount Fi by multiplying the FB corrected injection amount Ffbi by the fuel correction coefficient Ken.

Step 1490: The CPU sends a command signal to the fuel injection valve 25, so that the fuel of the final fuel injection amount (specified injection amount) Fi is injected from "the fuel injection valve 25 corresponding to the fuel injection cylinder".

Accordingly, if the value of the forced imbalance condition flag XEN is "1" at the present time, and the fuel injection cylinder is the Nth cylinder (=the first cylinder), the fuel injection amount is increased by an amount corresponding to α. As a result, the Nth cylinder becomes a forced imbalance cylinder.

If, on the other hand, the cylinder into which the fuel is to be injected is one of the cylinders (the second to fourth cylinders) other than the Nth cylinder, the fuel injection amount is not increased nor reduced even if the value of the forced imbalance condition flag XEN is "1", but is set to a fuel injection amount required to achieve the stoichiometric air/fuel ratio. Thus, the cylinders other than the Nth cylinder become non-forced-imbalance cylinders.

If the value of the forced imbalance condition flag XEN is not "1", the fuel injection amount of each of all cylinders is not increased nor reduced, but is set to a fuel injection amount required to achieve the stoichiometric air/fuel ratio.

Figure 15:
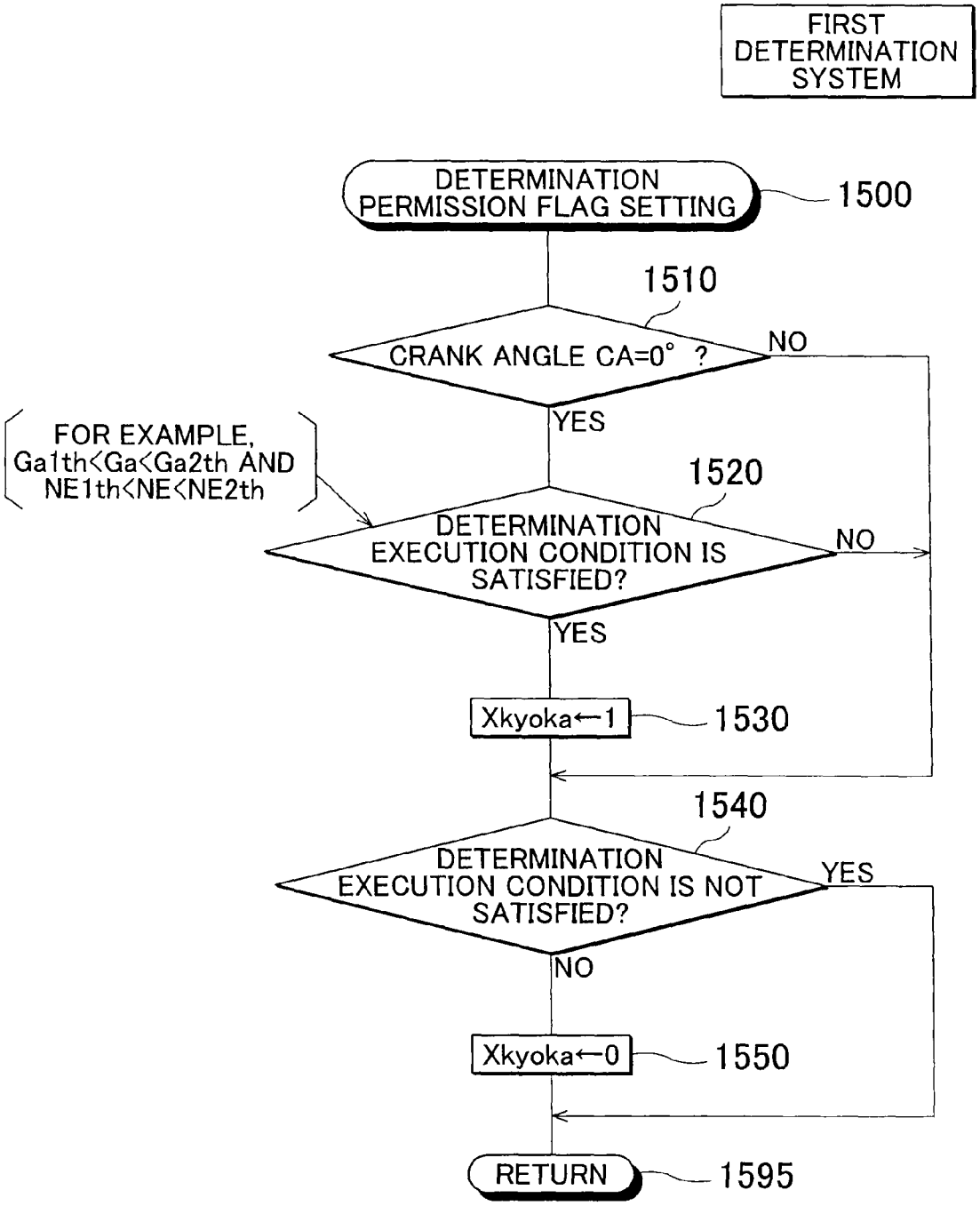
FIG. 15 is a flowchart illustrating a routine executed by CPU of the electric control device shown in FIG. 1.

The CPU is adapted to determine whether a process of making an air/fuel ratio sensor adequacy determination and a process of making an A/F imbalance determination (which will be described later) are executed, based on a value of a determination permission flag Xkyoka. To set the determination permission flag Xkyoka, the CPU executes "a determination permission flag setting routine" as illustrated in the flowchart of FIG. 15 each time a set time (4 ms) elapses (i.e., at intervals of a set time (4 ms)). In the initial routine as described above, the value of the determination permission flag Xkyoka is set to "0".

The CPU starts the process of FIG. 15 from step 1500 when the time for execution is reached, and proceeds to step 1510 to determine whether the absolute crank angle CA is 0° crank angle (=720° crank angle).

If the absolute crank angle CA is not equal to 0° crank angle at the time when the CPU executes step 1510, the CPU makes a negative decision (NO) in step 1510, and directly proceeds to step 1540.

If, on the other hand, the absolute crank angle CA is equal to 0° crank angle at the time when the CPU executes step 1510, the CPU makes an affirmative decision (YES) in step 1510, and proceeds to step 1520 to determine whether a determination execution condition is satisfied.

The determination execution condition is satisfied when all of the following conditions (condition C1 through condition C5) are satisfied. The determination execution condition may be satisfied when both of the condition C1 and the condition C3 are satisfied. Also, the determination execution condition may be satisfied when the condition C3 is satisfied, or may be satisfied when the condition C3 and "at least one of the conditions other than the condition C3" are satisfied. Needless to say, the determination execution condition may be satisfied when another condition or conditions are further satisfied.

Condition C1: The intake air flow rate Ga is larger than a lower threshold value of the intake air flow rate (a first threshold value of the intake air flow rate) Ga1*th*, and is smaller than a higher threshold value of the intake air flow rate (a second threshold value of the intake air flow rate) Ga2*th*. The higher threshold value of the intake air flow rate Ga2*th* is greater than the lower threshold value of the intake air flow rate Ga1*th*.

Condition C2: The engine speed NE is higher than a lower engine-speed threshold value NE1*th*, and is lower than a higher engine-speed threshold value NE2*th*. The higher engine-speed threshold value NE2*th* is greater than the lower engine-speed threshold value NE1*th*.

Condition C3: The engine is not operating under fuel cut control

Condition C4: A main feedback control condition is satisfied, and the engine is operating under main feedback control.

Condition C5: A sub-feedback control condition is satisfied, and the engine is operating under sub-feedback control.

If the determination execution condition is not satisfied at the time when the CPU executes step 1520, the CPU makes a negative decision (NO) in step 1520, and directly proceeds to step 1540.

If, on the other hand, the determination execution condition is satisfied at the time when the CPU executes step 1520, the CPU makes an affirmative decision (YES) in step 1520, and proceeds to step 1530 to set the value of the determination permission flag Xkyoka to "1". Then, the CPU proceeds to step 1540.

In step 1540, the CPU determines whether the determination execution condition is not satisfied. If the determination execution condition is not satisfied, the CPU proceeds from step 1540 to step 1550 to set the value of the determination permission flag Xkyoka to "0", and proceeds to step 1595 to complete the current cycle of the routine. If, on the other hand, the determination execution condition is satisfied at the time when the CPU executes step 1540, the CPU proceeds from step 1540 directly to step 1595 to complete the current cycle of the routine.

Thus, the determination permission flag Xkyoka is set to "1" when the determination execution condition is satisfied at the time when the absolute crank angle is equal to 0° crank angle, and is set to "0" at the time when the determination execution condition is not satisfied.

Figure 16:
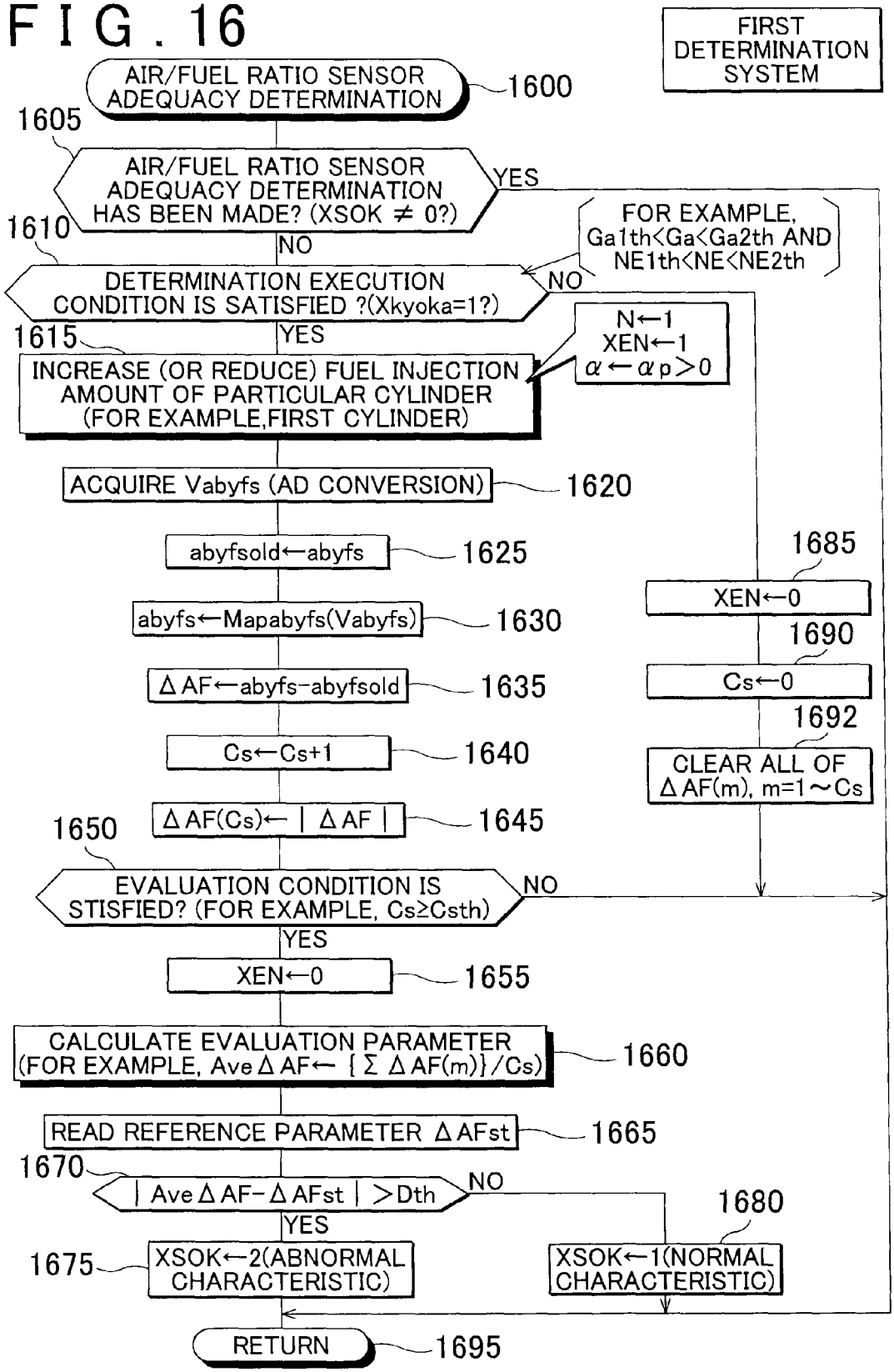
FIG. 16 is a flowchart illustrating a routine executed by CPU of the electric control device shown in FIG. 1.

Next a process for making "an air/fuel ratio sensor adequacy determination" will be explained. The CPU executes "an air/fuel ratio sensor adequacy determining routine" as illustrated in the flowchart of FIG. 16, each time a given time (4 ms=4 milliseconds=fixed sampling time ts) elapses.

When the time for execution of the routine is reached, the CPU starts the process from step 1600, and proceeds to step 1605 to determine "whether a determination on the adequacy of the air/fuel ratio sensor 55 (air/fuel ratio sensor adequacy determination, air/fuel ratio sensor characteristic evaluation) has been made". More specifically, the CPU determines whether a value of a sensor adequacy determination termination flag XSOK is unequal to "0". The value of the sensor adequacy determination termination flag XSOK is set to "0" in the above-described initial routine, and is set to "1" or "2" when the adequacy of the air/fuel ratio sensor 55 is determined in step 1670 through step 1680 as will be described later.

If a determination on the adequacy of the air/fuel ratio sensor 55 has been made at the time when the CPU executes step 1605 (namely, if the sensor adequacy determination termination flag XSOK has a value other than "0"), the CPU makes an affirmative decision (YES) in step 1605, and directly proceeds to step 1695 to complete the current cycle of the routine.

If, on the other hand, a determination on the adequacy of the air/fuel ratio sensor 55 has not been made at the time when the CPU executes step 1605 (namely, if the value of the sensor adequacy determination termination flag XSOK is "0"), the CPU makes a negative decision (NO) in step 1605, and proceeds to step 1610 to determine whether the determination execution condition is satisfied. More specifically, the CPU determines in step 1610 whether the value of the determination permission flag Xkyoka is "1".

If the value of the determination permission flag Xkyoka is "1" at this time, the CPU sequentially executes step 1615 through step 1645 as described below, and proceeds to step 1650.

Step 1615: The CPU performs "an operation to increase the fuel injection amount of a particular cylinder (the first cylinder in this embodiment) to be larger than that of the other cylinders" so as to create a forced imbalance condition (in this case, a forced rich imbalance condition). More specifically described, the CPU sets value "N" to "1", sets a value of a forced imbalance condition flag XEN to "1", and sets value "α" to a certain positive value αp (e.g., 0.45). As a result, the fuel injection amount of the Nth cylinder is increased by an amount corresponding to value α, as compared with the fuel injection amount of the other cylinders (see step 1410 through step 1440 and step 1480 of FIG. 14).

Step 1620: The CPU acquires the output value Vabyfs of the air/fuel ratio sensor 55 at this point in time, through AD conversion. Step 1625: The CPU causes the detected air/fuel ratio abyfs stored in the RAM at this point in time to be stored into the RAM as the detected air/fuel ratio abyfsold of the last cycle (detected air/fuel ratio abyfs(n−1) of the last cycle). Namely, the detected air/fuel ratio abyfsold of the last cycle is the detected air/fuel ratio abyfs detected at a point in time 4 ms (sampling time ts) ahead of the current time.

Step 1630: The CPU obtains the detected air/fuel ratio abyfs (abyfs(n)) of this cycle based on the air/fuel ratio sensor output Vabyfs acquired in step 1620, with reference to the air/fuel ratio conversion table Mapabyfs. Step 1635: The CPU obtains the rate of change ΔAF of the detected air/fuel ratio by subtracting "the detected air/fuel ratio abyfsold of the last cycle stored in step 1625" from "the detected air/fuel ratio abyfs of this cycle obtained in step 1630" (the detected air/fuel ratio change rate of this cycle ΔAF(n)=abyfs(n)−abyfs(n−1)).

Figure 17A:
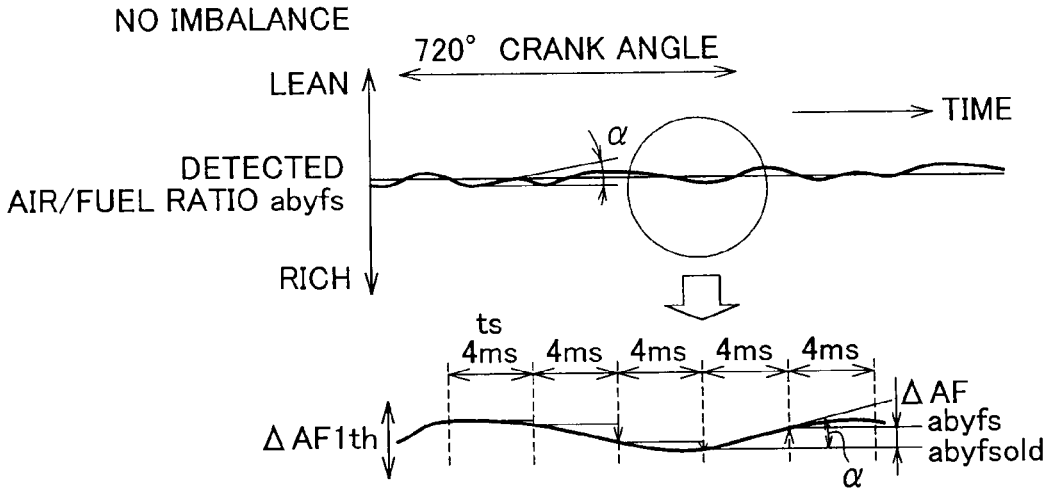
Figure 17B:
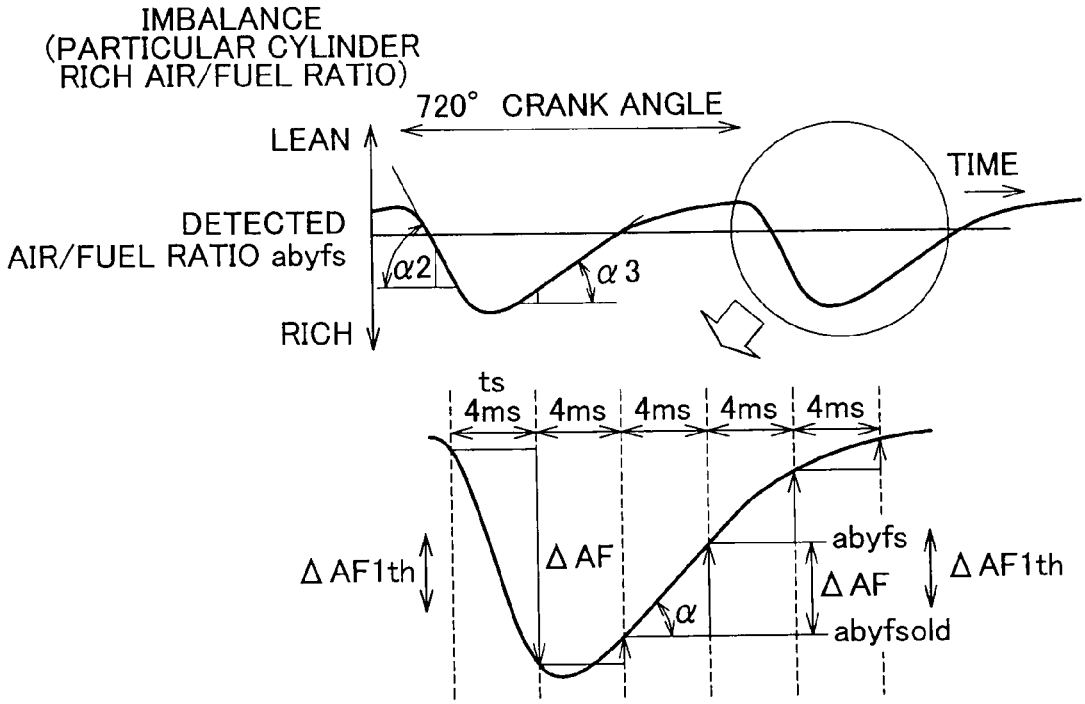

As shown in FIG. 17A and FIG. 17B, the detected air/fuel ratio change rate ΔAF is the amount of change ΔAF of the detected air/fuel ratio abyfs over the sampling time or period ts (=4 ms). Since the sampling time ts (=4 ms) is such a short time as 4 ms, the detected air/fuel ratio change rate ΔAF is substantially proportional to a time differential value d(abyfs)/dt of the detected air/fuel ratio abyfs, and therefore represents the gradient or inclination α of a corresponding section of the waveform formed by the detected air/fuel ratio abyfs.

Step 1640: The CPU increases the value of a counter Cs by "1". The counter Cs is set to "0" in the above-described initial routine, and is set to "0" when the determination execution condition is not satisfied (see step 1690 of FIG. 16).

Step 1645: The CPU stores the absolute value (|ΔAF|) of the detected air/fuel ratio change rate ΔAF obtained in step 1645 as Cs-th data ΔAF(Cs). For example, if the current time is "a point in time immediately after the value of the determination permission flag Xkyaka changes from "0" to "1"", the value of the counter Cs is "1" (see step 1690 and step 1640). Accordingly, the absolute value (|ΔAF|) of the detected air/fuel ratio change rate ΔAF obtained in step 1635 is stored as data ΔAF(1).

Then, the CPU determines in step 1650 whether a condition for evaluation of the air/fuel ratio sensor 55 is satisfied. More specifically described, the CPU determines in step 1650 whether the value of the counter Cs is equal to or larger than a threshold value Csth. The threshold value Csth is determined so that the number of data pieces of the detected air/fuel ratio change rate ΔAF is large enough to determine the output characteristics of the air/fuel ratio sensor 55 when the value of the counter Cs is equal to or larger than the threshold value Csth. It is desirable that the threshold value Csth is determined to be equal to or larger than the number of data pieces of the detected air/fuel ratio change rate ΔAF obtained over an estimated one unit combustion cycle period.

If the condition for evaluation of the air/fuel ratio sensor 55 is not satisfied at this time (namely, if the value of the counter Cs is smaller than the threshold value Csth), the CPU makes a negative decision (NO) in step 1650, and directly proceeds to step 1695 to complete the current cycle of the routine.

The process as described above is repeatedly executed as long as the value of the sensor adequacy determination termination flag XSOK is "0", and the value of the determination permission flag Xkyoka is "1". In this manner, the value of the counter Cs is incremented in step 1640, and the absolute value (|ΔAF|) of the detected air/fuel ratio change rate ΔAF is stored as data ΔAF(Cs) in step 1645.

After a lapse of a certain period of time, the value of the counter Cs reaches the threshold value Csth. If the CPU executes step 1650 at this time, the CPU makes an affirmative decision (YES) in step 1650, executes step 1655 and step 1660 as described below, and then proceeds to step S1665.

Step 1655: The CPU sets the value of the forced imbalance condition flag XEN to "0". As a result, the forced imbalance condition is terminated (see step 1410 and step 1440 of FIG. 14). At this time, the CPU may set value α to "0".

Step 1660: The CPU calculates "an air/fuel ratio sensor evaluation parameter (data)" used for determining whether the output characteristics of the air/fuel ratio sensor 55 are adequate "for making a cylinder-to-cylinder A/F imbalance determination", based on data ΔAF(m) (m is a natural number from 1 to Csth).

More specifically described, the CPU calculates the average value AveΔAF of the absolute values of the detected air/fuel ratio change rates ΔAF, as the evaluation parameter, by dividing the sum of a plurality of pieces of data ΔAF(m) by the value of the counter Cs (which is equal to the threshold value Csth at the present time).

Step 1665: The CPU reads the above-mentioned reference parameter ΔAFst (reference value) from the ROM. The CPU may read the reference parameter ΔAFst in the following manner: the CPU obtains the average value(s) of "the engine speed NE and/or the intake air flow rate Ga" over a period in which the detected air/fuel ratio change rates ΔAF as a basis for the evaluation parameter AveΔAF are acquired, as an engine condition parameter(s) during evaluation data acquisition. In the meantime, reference parameters ΔAFst are determined in advance with respect to the respective engine condition parameters during evaluation data acquisition, and are stored in the ROM in the form of a table. The CPU reads a reference parameter ΔAFst corresponding to the actual engine condition parameter(s) during evaluation data acquisition, from the above-mentioned table.

Then, the CPU proceeds to step 1670 to determine whether "an absolute value D of a difference between the evaluation parameter AveΔAF and the reference parameter ΔAFst" is larger than "a given threshold value Dth for evaluation". Namely, the CPU makes a comparison between the evaluation parameter AveΔAF and the reference parameter ΔAFst.

If the absolute value D is larger than the threshold value Dth, the CPU determines that the output characteristics of the air/fuel ratio sensor 55 largely deviate from the output characteristics of the reference air/fuel ratio sensor, and the air/fuel ratio sensor 55 (the output characteristics of the air/fuel ratio sensor 55) is "not adequate for making a cylinder-to-cylinder A/F imbalance determination".

In this case, the CPU makes an affirmative decision (YES) in step 1670, and proceeds to step 1675 to set the value of the sensor adequacy determination termination flag XSOK to "2". In other words, the value "2" of the sensor adequacy determination termination flag XSOK indicates that the air/fuel ratio sensor 55 is not adequate or suitable for making an A/F imbalance determination. Thereafter, the CPU proceeds to step 1695 to complete the current cycle of the routine.

If, on the other hand, the absolute value D is equal to or smaller than the threshold value Dth at the time when the CPU executes step 1670, the CPU determines that the output characteristics of the air/fuel ratio sensor 55 are substantially the same as the output characteristics of the reference air/fuel ratio sensor, and "the air/fuel ratio sensor 55 is adequate for making a cylinder-to-cylinder A/F imbalance determination". In this case, the CPU makes a negative decision (NO) in step 1670, and proceeds to step 1680 to set the value of the sensor adequacy determination termination flag XSOK to "1". In other words, the value "1" of the sensor adequacy determination termination flag XSOK indicates that "the air/fuel ratio sensor 55 is adequate for making a cylinder-to-cylinder A/F imbalance determination". Then, the CPU proceeds to step 1695 to complete the current cycle of the routine.

In the meantime, if the value of the determination permission flag Xkyoka is "0" at the time when the CPU executes 1610, the CPU makes a negative decision (NO) in step 1610, and sequentially executes step 1685, step 1690 and step 1692 as described below, and directly proceeds to step 1695 to complete the current cycle of the routine.

Step 1685: The CPU sets the value of the forced imbalance condition flag XEN to "0". At this time, the CPU may set value a to "0". Step 1690: The CPU sets the value of the counter Cs to "0" (clear or reset the counter Cs). Step 1692: The CPU sets all of the data ΔAF(m) (m is a natural number from 1 to Cs) which has been obtained, to "0" (clear the data ΔAF(m)).

Figure 18:
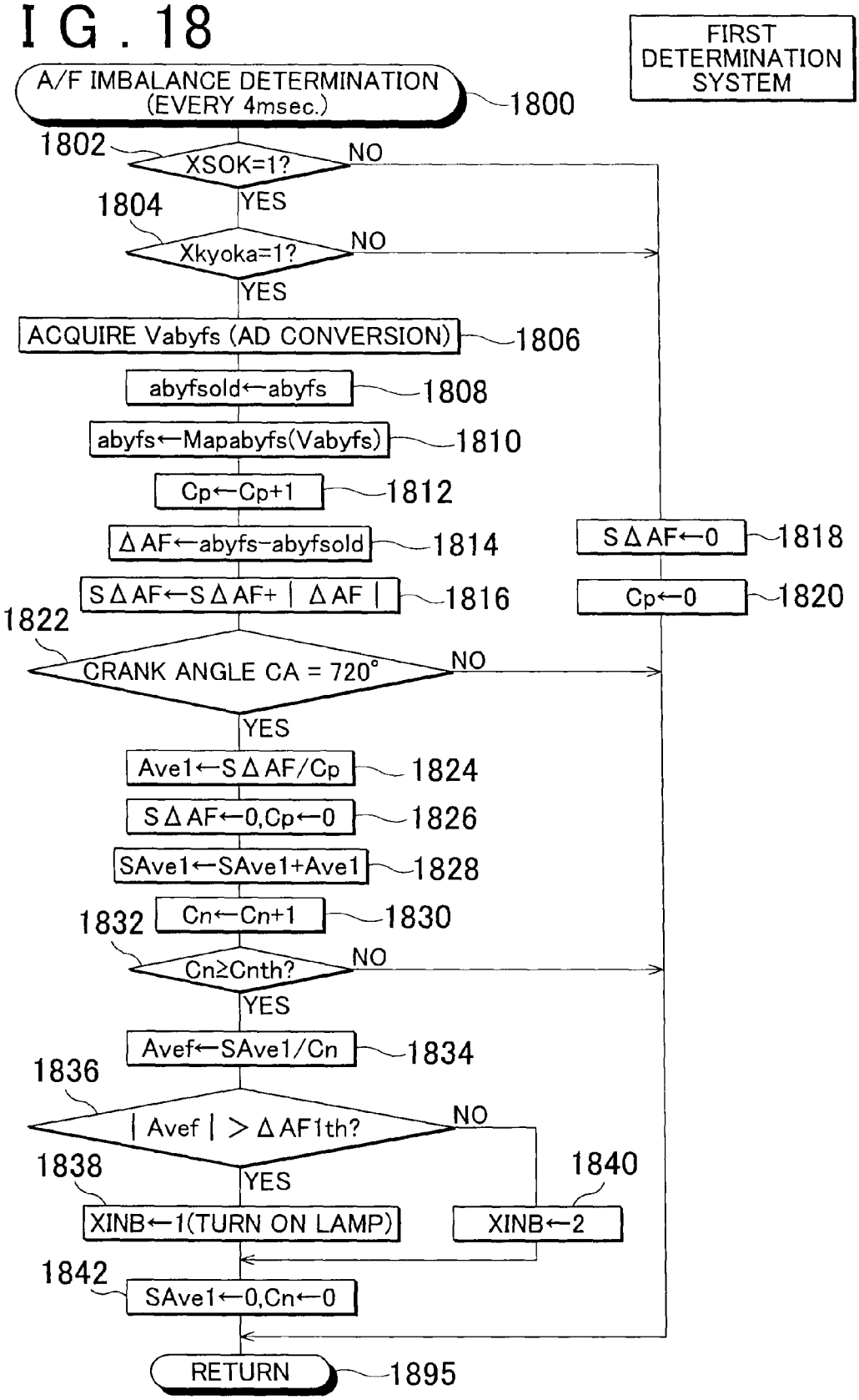
FIG. 18 is a flowchart illustrating a routine executed by CPU of the electric control device shown in FIG. 1.

Next, a process for making "a cylinder-to-cylinder air/fuel ratio (A/F) imbalance determination" will be described. The CPU executes "a routine for making a cylinder-to-cylinder A/F imbalance determination" as illustrated in the flowchart of FIG. 18, each time 4 ms (4 milliseconds=a fixed sampling time ts) elapses.

Initially, the case where the sensor adequacy determination termination flag XSOK and the determination permission flag Xkyoka are both "1" will be explained. When the time for execution of the routine is reached, the CPU starts the process from step 1800, and proceeds to step 1802 to determine whether the value of the sensor adequacy determination termination flag XSOK is "1". In the case as described above, the CPU makes an affirmative decision (YES) in step 1802, and proceeds to step 1804 to determine whether the value of the determination permission flag Xkyoka is "1". In the case as described above, the CPU makes an affirmative decision (YES) in step 1804, sequentially executes step 1806 through step 1816 as described below, and proceeds to step 1822.

Step 1806: The CPU acquires the output value Vabyfs of the air/fuel ratio sensor at this point in time, through AD conversion. Step 1808: The CPU stores the detected air/fuel ratio abyfs (upstream air/fuel ratio abyfs) stored at this time as the detected air/fuel ratio abyfsold of the last cycle. Namely, the detected air/fuel ratio abyfsold of the last cycle is the detected air/fuel ratio abyfs acquired at a point in time 4 ms (sampling time ts) ahead of this point in time. Step 1810: The CPU obtains the detected air/fuel ratio abyfs of this cycle, based on the output value Vabyfs of the air/fuel ratio sensor 55, with reference to the air/fuel ratio conversion table Mapabyfs.

Step 1812: The CPU increases the value of a counter Cp by "1". The value of the counter Cp represents the number of data pieces of "the absolute values |ΔAF| of the detected air/fuel ratio change rates ΔAF added to a total value SΔAF" in step 1816 which will be described later. The counter Cp is set to "0" in the above-described initial routine.

Step 1814: The CPU calculates the detected air/fuel ratio change rate ΔAF by subtracting the detected air/fuel ratio abyfsold of the last cycle from the detected air/fuel ratio abyfs of this cycle.

Step 1816: The CPU updates the total value SΔAF by adding the absolute value (|ΔAF|) of the detected air/fuel ratio change rate ΔAF obtained in step 1814, to the total value SΔAF of the detected air/fuel ratio change rate ΔAF stored at this time. The reason why the "absolute value |ΔAF| of the detected air/fuel ratio change rate ΔAF" is added to the total value SΔAF is that the detected air/fuel ratio change rate ΔAF may be a positive value or a negative value when a cylinder-to-cylinder A/F imbalance condition occurs, as is understood from FIG. 8B and FIG. 8C. The total value SΔAF is also set to "0" in the above-described initial routine.

Then, the CPU proceeds to step 1822 to determine whether the crank angle CA (absolute crank angle CA) of the reference cylinder (the first cylinder in this embodiment) relative to the compression top dead center is equal to 720° crank angle. If the absolute crank angle CA is less than 720° crank angle at this time, the CPU makes a negative decision (NO) in step 1822, and directly proceeds to step 1895 to complete the current cycle of the routine.

Step 1822 is provided for determining the minimum period (unit combustion cycle period) over which the absolute values ΔAF of the detected air/fuel ratio change rates ΔAF are acquired so as to obtain the average value thereof. In this embodiment, 720° crank angle corresponds to the minimum period. The 720° crank angle is required for all of the cylinders (the first through fourth cylinders in this embodiment) from which exhaust gases that reach one air/fuel ratio sensor 55 are emitted to complete a single combustion cycle for each cylinder. While the minimum period may be shorter than 720° crank angle, it is desirable that the minimum period is equal to or longer than the length of a plurality of times of the sampling time ts. Namely, it is desirable that the minimum period or unit period is determined so that a plurality of detected air/fuel ratio change rates ΔAF can be acquired within the minimum period.

If, on the other hand, the absolute crank angle CA is equal to 720° crank angle at the time when the CPU executes step 1822, the CPU makes an affirmative decision (YES) in step 1822, sequentially executes step 1824 through step 1830 as described below, and then proceeds to step 1832.

Step 1824: The CPU calculates the average value (first average value) Ave1 of the absolute values |ΔAF| of the detected air/fuel ratio change rates ΔAF, by dividing the total value SΔAF by the value of the counter Cp.

Step 1826: The CPU sets (clears) the total value SΔAF to "0", and sets (clears) the value of the counter CP to "0".

Step 1828: The CPU updates the total value SAve1 of the first average values Ave1. More specifically, the CPU adds the first average value Ave1 of this cycle, which is newly obtained in step 1824, to "the total value SAve1 of the first average values Ave1" stored at this time, so as to calculate "the total value SAve1 of the first average values Ave1" of this cycle.

Step 1830: The CPU increases the value of a counter Cn by "1". The value of the counter Cn represents the number of data pieces of the first average values Ave1 added to "the total value SAve1 of the first average values Ave1". The counter Cn is set to "0" in the above-described initial routine.

Then, the CPU proceeds to step 1832 to determine whether the value of the counter Cn is equal to or larger than a threshold value Cnth. If the value of the counter Cn is smaller than the threshold value Cnth at this time, the CPU makes a negative decision (NO) in step 1832, and directly proceeds to step 1895 to complete the current cycle of the routine. In this connection, it is desirable that the threshold value Cnth is a natural number, and is equal to or larger than 2.

If, on the other hand, the value of the counter Cn is equal to or larger than the threshold value Cnth at the time when the CPU executes step 1832, the CPU makes an affirmative decision (YES) in step 1832, and proceeds to step 1834 to calculate the average value (final average value) Avef of the first average values Ave1, by dividing "the total value SAve1 of the first average values Ave1" by the value (=Cnth) of the counter Cn. The final average value Avef is a value commensurate with the detected air/fuel ratio change rate ΔAF (i.e., a value that varies according to ΔAF, or a value that increases as the magnitude of ΔAF increases), and is an air/fuel ratio change rate command amount as "a parameter for use in A/F imbalance determination".

Then, the CPU proceeds to step 1836 to determine whether the absolute value |Avef| of the final average value Avef (the air/fuel ratio change rate command amount) is larger than a threshold value ΔAF1*th* for use in imbalance determination. It is desirable to set the threshold value ΔAF1*th* for imbalance determination so that the threshold value ΔAF1*th* increases as the intake air flow rate Fa increases. Since the final average value Avef is a positive value, the CPU may be configured to determine in step 1836 whether the final average value Avef is larger than the threshold value ΔAF1*th* for imbalance determination.

If the absolute value of the final average value Avef is larger than the imbalance determination threshold value ΔAF1*th* at this time, the CPU makes an affirmative decision (YES) in step 1836, and proceeds to step 1838 to set a value of an imbalance occurrence flag XINB to "1". Namely, the CPU determines that a cylinder-to-cylinder A/F imbalance condition occurs in the engine. At this time, the CPU may turn on an alarm lamp (not shown). The value of the imbalance occurrence flag XINB is stored in the backup RAM. Then, the CPU proceeds to step 1842.

On the other hand, if the absolute value of the final average value Avef is equal to or smaller than the imbalance determination threshold value ΔAF1*th* at the time when the CPU executes step 1836, the CPU makes a negative decision (NO) in step 1836, and proceeds to step 1840 to set the value of the imbalance occurrence flag XINB to "2". Namely, the CPU determines that no cylinder-to-cylinder A/F imbalance condition occurs in the engine, and stores this determination. Then, the CPU proceeds to step 1842. Step 1840 may be omitted.

In step 1842, the CPU sets (clears) "the total value SAve1 of the first average values Ave1" to "0", and sets (clears) the value of the counter Cn to "0". Thereafter, the CPU proceeds to step 1895 to complete the current cycle of the routine. In the manner as described above, a cylinder-to-cylinder A/F imbalance determination is made only when the value of the sensor adequacy determination termination flag XSOK is "1".

Next, the case where at least one of the sensor adequacy determination termination flag XSOK and the determination permission flag Xkyoka has a value other than "1" will be explained. In this case, the CPU makes a negative decision in step 1802 or step 1804, and proceeds to step 1818 to set (clear) the total value SΔAF of the detected air/fuel ratio change rates ΔAF to "0". Then, the CPU proceeds to step 1820 to set the value of the counter Cp to "0". Thereafter, the CPU directly proceeds to step 1895 to complete the current cycle of the routine. Namely, a cylinder-to-cylinder A/F imbalance determination is not made (or is inhibited from being made) when the value of the sensor adequacy determination termination flag XSOK is "0", which indicates that an air/fuel ratio sensor adequacy determination has not been made, and when the value of the sensor adequacy determination termination flag XSOK is "2", namely, it is determined, as a result of the air/fuel ratio sensor adequacy evaluation, that "the air/fuel ratio sensor is "not adequate for making an A/F imbalance determination".

As explained above, the first determination system is applied to the multi-cylinder internal combustion engine 10 having three or more cylinders. The first determination system obtains a parameter for use in A/F imbalance determination (the final average value Avef) which increases as a difference between the air/fuel ratio of an air-fuel mixture supplied to one of the three or more cylinders and the air/fuel ratio of air-fuel mixtures supplied to the other or remaining cylinders of the three or more cylinders increases, based on at least the output value Vabyfs of the air/fuel ratio sensor 55 (see steps 1802-1834 of FIG. 18).

Furthermore, the first determination system includes an imbalance determination device that makes "an A/F imbalance determination as to whether a cylinder-to-cylinder A/F imbalance condition occurs", based on the result of comparison as to whether the obtained parameter for use in imbalance determination (the final average value Avef) is equal to or larger than the given threshold value (ΔAF1*th*) for use in imbalance determination (see steps 1836-1840 of FIG. 18).

In addition, the first determination system includes a forced imbalance condition creating device (see step 1615 of FIG. 16, steps 1410-1440 of FIG. 14 and step 1480 of FIG. 14) that changes the amount(s) of fuel injected from one or more fuel injection valves 25, so as to create "a forced imbalance condition (a forced rich imbalance condition in this embodiment)" in which "the air/fuel ratio of an air-fuel mixture supplied to one cylinder of the three or more cylinders" deviates from "the air/fuel ratio of air-fuel mixtures supplied to the other plural cylinders of the three or more cylinders". The first determination system also includes an evaluation parameter obtaining device (see steps 1620-1660 of FIG. 16) that obtains "the air-fuel ratio sensor evaluation parameter (AveΔAF) representing the output characteristics of the air/fuel ratio sensor", based on the output value of the air/fuel ratio sensor 55 in a condition where the forced imbalance condition is established. The first determination system further includes an air/fuel ratio sensor evaluation device (see steps 1665-1680 of FIG. 16) that makes a determination (a sensor adequacy determination) as to "whether the output characteristics of the air/fuel ratio sensor are adequate for making an A/F imbalance determination", by comparing the obtained air/fuel ratio sensor evaluation parameter (AveΔAF) with a predetermined reference parameter (ΔAFst). The first determination system further includes an imbalance determination executing/inhibiting device (note that a negative decision (NO) is obtained in step 1802 of FIG. 18 when the value of the sensor adequacy determination termination flag XSOK is set to "2" in step 1675 of FIG. 16) which inhibits an A/F imbalance determination from being made when the above-indicated air/fuel ratio sensor evaluation device determines that the output characteristics of the air/fuel ratio sensor are not adequate for making an A/F imbalance determination (i.e., when an affirmative decision (YES) is obtained in step 1670 of FIG. 16).

When the value of the sensor adequacy determination termination flag XSOK is set to "2" in step 1675 of FIG. 16, the first determination system may execute step 1806 through step 1816 and step 1822 through step 1836 of FIG. 18, but may be configured to make the result of imbalance determination invalid by keeping the value of the imbalance occurrence flag XINB at "0" irrespective of the result of determination in step 1836.

With the above arrangement, a forced imbalance condition similar to a condition where an inherent cylinder-to-cylinder A/F imbalance occurs is forced to occur, and the air-fuel ratio sensor evaluation parameter (AveΔAF) representing the output characteristics of the air/fuel ratio sensor 55 in the forced imbalance condition is obtained. Then, a determination on the adequacy of the air/fuel ratio sensor is made depending on whether the air/fuel ratio sensor evaluation parameter (AveΔAF) and the reference parameter (ΔAFst) are close to each other.

Accordingly, it is determined with high accuracy whether the output characteristics of the air/fuel ratio sensor 55 are not adequate for "making a cylinder-to-cylinder A/F imbalance determination". Furthermore, when it is determined that the output characteristics of the air/fuel ratio sensor 55 are not adequate for making a cylinder-to-cylinder A/F imbalance determination, the process of making a cylinder-to-cylinder A/F imbalance determination is in fact not carried out. Consequently, the possibility of errors in the cylinder-to-cylinder A/F imbalance determination due to, for example, changes in the output characteristics of the air/fuel ratio sensor 55 can be reduced.

In the first determination system, the value of α set in step 1615 of FIG. 16 may be a negative value αm. In this case, a forced lean imbalance condition is created.

Next, a cylinder-to-cylinder air/fuel ratio (A/F) imbalance determination system (hereinafter simply called "second determination system") according to a second embodiment of the invention will be described. When the second determination system obtains a parameter for evaluation of the air/fuel ratio sensor 55, the system causes two cylinder-to-cylinder A/F imbalance conditions, i.e., "a forced rich imbalance condition and a forced lean imbalance condition", to occur in non-overlapping periods. The forced rich imbalance condition is a condition in which the air/fuel ratio of the forced imbalance cylinder is richer than the stoichiometric air/fuel ratio. The forced lean imbalance condition is a condition in which the air/fuel ratio of the forced imbalance cylinder is leaner than the stoichiometric air/fuel ratio.

Furthermore, the second determination system obtains the average value of the absolute values of a plurality of detected air/fuel ratio change rates ΔAF obtained in the forced rich imbalance condition, as a rich-side evaluation parameter. Similarly, the second determination system obtains the average value of the absolute values of a plurality of detected air/fuel ratio change rates ΔAF obtained in the forced lean imbalance condition, as a lean-side evaluation parameter.

Then, the second determination system determines that the air/fuel ratio sensor 55 (the output characteristics of the air/fuel ratio sensor 55) is not adequate for making an A/F imbalance condition when the absolute value of a difference between the rich-side evaluation parameter and a rich-side reference parameter is larger than a rich-side threshold value DRth, AND the absolute value of a difference between the lean-side evaluation parameter and a lean-side reference parameter is larger than a lean-side threshold value DLth.

The second determination system may be configured to determine that the air/fuel ratio sensor 55 (the output characteristics of the air/fuel ratio sensor 55) is not adequate for making an A/F imbalance determination when the absolute value of a difference between the rich-side evaluation parameter and the rich-side reference parameter is larger than the rich-side threshold value DRth, OR the absolute value of a difference between the lean-side evaluation parameter and the lean-side reference parameter is larger than the lean-side threshold value DLth. The second determination system is identical with the first determination system in other aspects. Accordingly, the above differences between the first and second determination systems will be mainly explained. In the following description, the same reference numerals as those assigned to the above-described steps executed by the first determination system are assigned to some of the steps in which the same operations as those of the above-described steps are performed, and detailed description of these steps will be omitted as appropriate.

Figure 19:
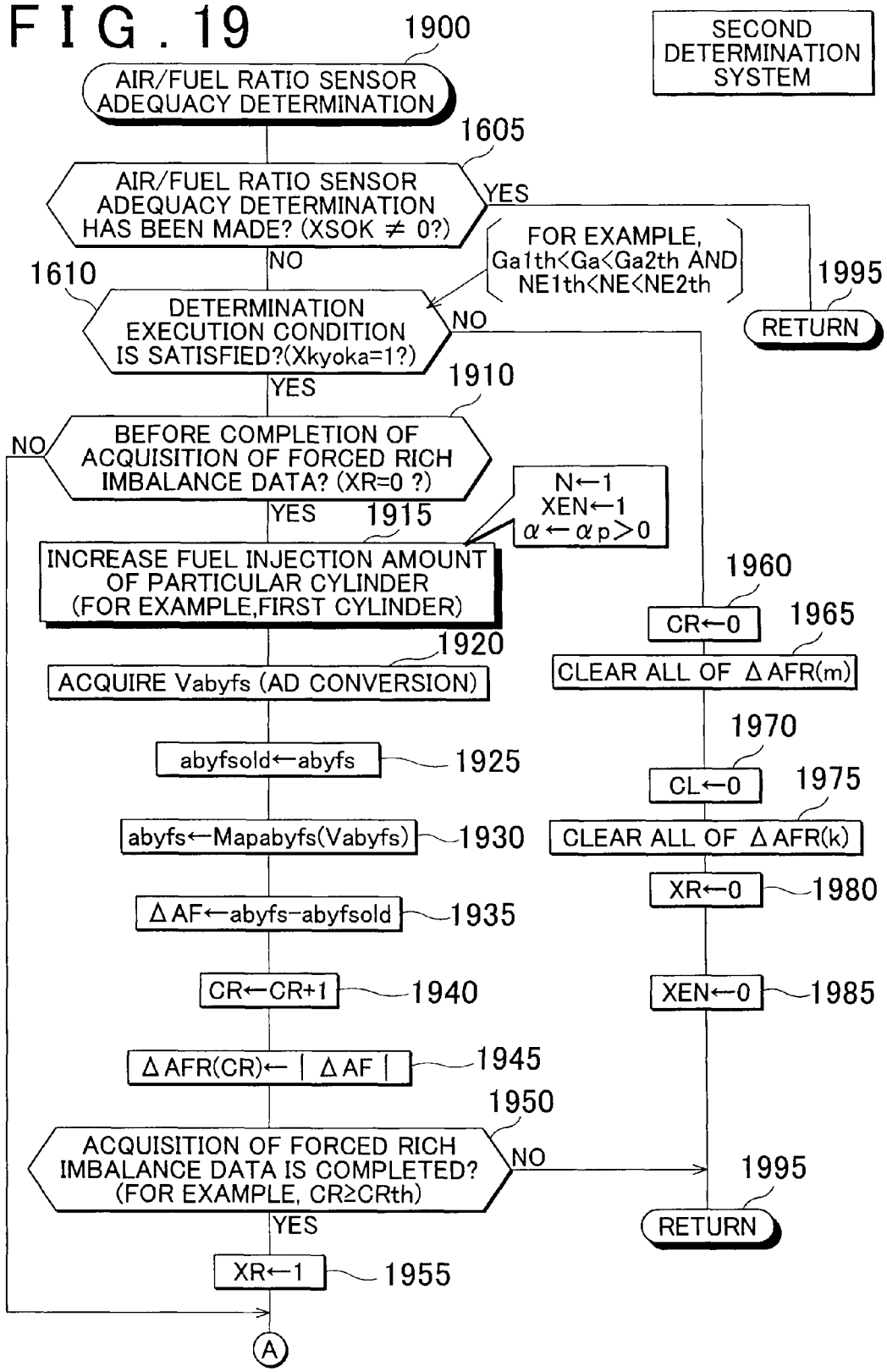
FIG. 19 is a flowchart illustrating a routine executed by CPU of a cylinder-to-cylinder air/fuel ratio imbalance determination system (second determination system) according to a second embodiment of the invention.
Figure 20:
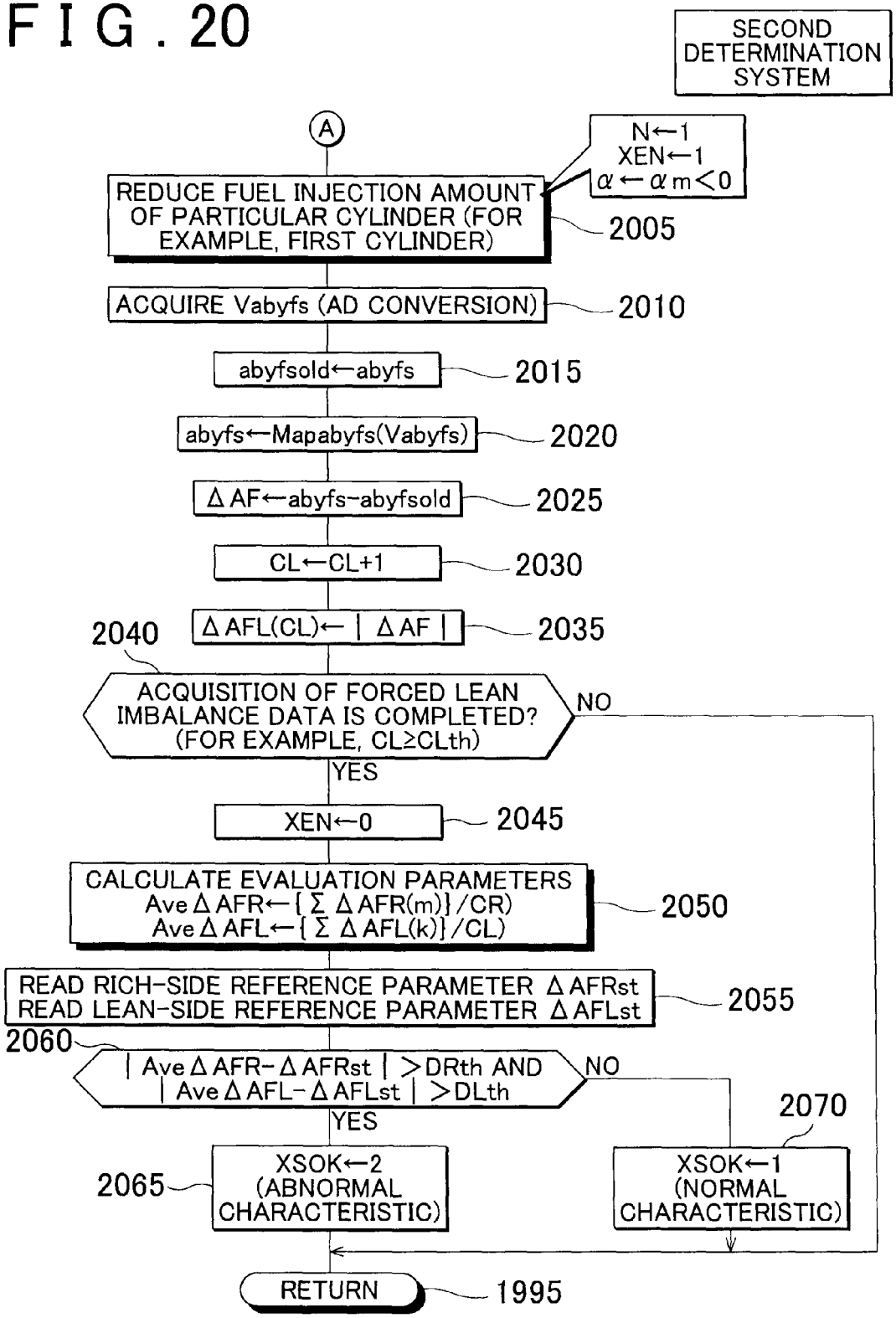
FIG. 20 is a flowchart illustrating a routine executed by CPU of the second determination system.

The CPU of the second determination system executes the routines executed by the CPU of the first determination system except for the routine of FIG. 16, and executes "an air/fuel ratio sensor adequacy determination routine" as illustrated in FIG. 19 and FIG. 20 that replace FIG. 16, each time a given time (4 ms) elapses.

When the time for execution of the routine of FIG. 19 is reached, the CPU starts the process from 1900, and determines in step 1605 whether the sensor adequacy determination termination flag XSOK is unequal to "0". If the sensor adequacy determination termination flag XSOK has a value other than "0" at this time, the CPU makes an affirmative decision (YES) in step 1605, and directly proceeds to step 1995 to immediately complete the current cycle of the routine.

On the other hand, if the value of the sensor adequacy determination termination flag XSOK is "0" at the time when the CPU executes 1605, the CPU makes a negative decision (NO) in step 1605, and proceeds to step 1610 to determine whether the value of the determination permission flag Xkyoka is "1".

If the value of the determination permission flag Xkyoka is "1", the CPU makes an affirmative decision (YES) in step 1610, and proceeds to step 1910 to determine whether acquisition of forced rich imbalance data has not been completed. More specifically, the CPU determines in step 1910 whether a value of a forced rich imbalance data acquisition completion flag XR (which will also be called "rich data acquisition completion flag XR") is "0". The value of the rich data acquisition completion flag XR is set to "0" in the above-described initial routine.

If the acquisition of forced rich imbalance data has not been completed at this time, and the value of the rich data acquisition completion flag XR is "0" (not "1"), the CPU makes an affirmative decision (YES) in step 1910, and sequentially executes step 1915 through step 1935.

In step 1915-step 1935, the same operations as those of step 1615-step 1635 of FIG. 16 are performed. Accordingly, value "N" is set to "1", and the value of the forced imbalance condition flag XEN is set to "1", while value "α" is set to a positive value "αp". Then, the rate of change ΔAF of the detected air/fuel ratio is obtained. In this connection, value "N" may be set to any of "2-4".

Then, the CPU proceeds to step 1940 to increase a value of a counter CR by "1". The counter CR is set to "0" in the above-described initial routine.

Then, the CPU proceeds to step 1945 to store the absolute value (|ΔAF|) of the detected air/fuel ratio change rate ΔAF obtained in step 1935, as the CR-th piece of forced rich imbalance data ΔAFR(CR). For example, if the current time is "a point in time immediately after the value of the determination permission flag Xkyoka changes from "0" to "1"", the value of the counter CR is "1" (see step 1960 and step 1940 which will be described later). Accordingly, the absolute value (|ΔAF|) of the detected air/fuel ratio change rate ΔAF obtained in step 1935 is stored as data ΔAFR(1).

Then, the CPU proceeds to step 1950 to determine whether the acquisition of the forced rich imbalance data is completed. More specifically, the CPU determines whether the value of the counter CR is equal to or larger than a given threshold value CRth. The threshold value CRth is determined so that the number of data pieces of the detected air/fuel ratio change rate ΔAF obtained in the forced rich imbalance condition is large enough to determine the output characteristics of the air/fuel ratio sensor 55 when the value of the counter CR reaches the threshold value CRth.

If the value of the counter CR is smaller than the given threshold value CRth at this time, the CPU makes a negative decision (NO) in step 1950, and directly proceeds to step 1995 to complete the current cycle of the routine.

The process as described above is repeatedly executed as long as the value of the sensor adequacy determination termination flag XSOK is "0", and the value of the determination permission flag Xkyoka is "1", while the value of the rich data acquisition completion flag XR is "0". With the above process thus repeatedly executed, the value of the counter CR is increased one by one in step 1940, and the absolute values (|ΔAF|) of the detected air/fuel ratio change rates ΔAF are successively stored as data ΔAFR(CR) in step 1945. The data ΔAFR(CR) is the original data based on which a parameter for evaluation of the air/fuel ratio sensor is obtained.

After a lapse of a certain time in the above-described condition, the value of the counter CR reaches the threshold value CRth. If the CPU executes step 1950 at this time, the CPU makes an affirmative decision (YES) in step 1950, and proceeds to step 1955 to set the value of the rich data acquisition completion flag XR to "1". Then, the CPU proceeds to step 2005 of FIG. 20 (see "A" in FIG. 19 and FIG. 20). Once the rich data acquisition completion flag XR is set to "1", the CPU makes a negative decision (NO) in step 1910 in subsequent cycles, and directly proceeds to step 2005 of FIG. 20.

In step 2005 of FIG. 20, the CPU performs an operation to reduce the fuel injection amount of a particular cylinder (the first cylinder in this embodiment) to be smaller than that of the other cylinders, so as to create a forced lean imbalance condition. More specifically described, the CPU sets value "N" to "1", sets the value of the forced imbalance condition flag XEN to "1", and sets value "α" to a predetermined negative value αm (e.g., −0.3). As a result, the fuel injection amount of the Nth cylinder is reduced by an amount corresponding to value α, as compared with the fuel injection amount of the other cylinders (see step 1410 through step 1440 of FIG. 14). The value "N" may be set to any of "2-4".

Then, the CPU executes step 2010 through step 2025. In step 2010-step 2025, the same operations as those of step 1620-step 1635 of FIG. 16 are performed. Accordingly, the detected air/fuel ratio change rate ΔAF is obtained.

Then, the CPU proceeds to step 2030 to increase the value of the counter CL by "1". In this connection, the counter CL is set to "0" in the above-described initial routine.

Then, the CPU proceeds to step 2035 to store the absolute value (|ΔAF|) of the detected air/fuel ratio change rate ΔAF obtained in step 2025, as the CL-th piece of forced lean imbalance data ΔAFL(CL). For example, if the current time is "a point in time immediately after the value of the rich data acquisition completion flag XR changes from "0" to "1"", the value of the counter CL is "1" (see step 1970 of FIG. 19 and step 2030 of FIG. 20 which will be described later). Accordingly, the absolute value (|ΔAF|) of the detected air/fuel ratio change rate ΔAF obtained in step 2025 is stored as data ΔAFL(1).

Then, the CPU proceeds to step 2040 to determine whether the acquisition of the forced lean imbalance data is completed. More specifically, the CPU determines whether the value of the counter CL is equal to or larger than a given threshold value CLth. The threshold value CLth is determined so that the number of data pieces of the detected air/fuel ratio change rate ΔAF obtained in the forced lean imbalance condition is large enough to determine the output characteristics of the air/fuel ratio sensor 55 when the value of the counter CL reaches the threshold value CLth.

If the value of the counter CL is smaller than the given threshold value CLth at this time, the CPU makes a negative decision (NO) in step 2040, and directly proceeds to step 1995 to complete the current cycle of the routine.

Thus, the process of step 2005 through step 2035 is repeatedly executed as long as the sensor adequacy determination termination flag XSOK is "0", and the value of the determination permission flag Xkyoka is "1", while the value of the rich data acquisition completion flag XR is "1". With the process thus repeatedly executed, the value of the counter CL is increased one by one in step 2030, and the absolute values (|ΔAF| of the detected air/fuel ratio change rates ΔAF are successively stored as data ΔAFL(CL) in step 2035. The data ΔAFL(CL) is the original data based on which the parameter for evaluation of the air/fuel ratio sensor is obtained.

After a lapse of a certain time in above condition, the value of the counter CL reaches the threshold value CLth. If the CPU executes step 2040 at this time, the CPU makes an affirmative decision (YES) in step 2040, and proceeds to step 2045 to set the value of the forced imbalance condition flag XEN to "0". As a result, the forced imbalance condition is terminated (see step 1410 and step 1440 of FIG. 14). At this time, the CPU may set value α to "0".

Then, the CPU proceeds to step 2050 to calculate "an air-fuel ratio sensor evaluation parameter" used for determining whether the output characteristics of the air/fuel ratio sensor 55 are "adequate for making a cylinder-to-cylinder A/F imbalance determination", based on data ΔAFR(m) (m is a natural number from 1 to CRth) and data ΔAFL(k) (k is a natural number from 1 to CLth).

More specifically described, the CPU calculates the average value AveΔAFR of the absolute values of "a plurality of detected air/fuel ratio change rates ΔAF obtained in the forced rich imbalance condition" as a rich-side evaluation parameter, by dividing the sum of a plurality of pieces of data ΔAFR(m) by the value of the counter CR (which is equal to the threshold value CRth at this point in time). Also, the CPU calculates the average value AveΔAFL of the absolute values of "a plurality of detected air/fuel ratio change rates ΔAF obtained in the forced lean imbalance condition" as a lean-side evaluation parameter, by dividing the sum of a plurality of pieces of data ΔAFL(k) by the value of the counter CL (which is equal to the threshold value CLth at this point in time).

Then, the CPU proceeds to step 2055 to read a rich-side reference parameter ΔAFRst and a lean-side reference parameter ΔAFLst from the ROM. The rich-side reference parameter ΔAFRst corresponds to the above-mentioned evaluation parameter AveΔAFR obtained based on the output value Vabyfs of the reference air/fuel ratio sensor when the reference air/fuel ratio sensor is mounted in place of the air/fuel ratio sensor 55 and the forced rich imbalance condition is established (in which α is set to αp and the increased fuel is injected into the first cylinder). The lean-side reference parameter ΔAFLst corresponds to the evaluation parameter AveΔAFL obtained based on the output value Vabyfs of the reference air/fuel ratio sensor when the reference air/fuel ratio sensor is mounted in place of the air/fuel ratio sensor 55 and the forced lean imbalance condition is established (in which α is set to am and the reduced fuel is injected into the first cylinder).

Like the reference parameter ΔAFst used in the first determination system, the rich-side reference parameter ΔAFRst may be set for respective parameters indicative of engine conditions during acquisition of the actual evaluation parameter (in this case, during the duration of the forced rich imbalance condition). Similarly, the lean-side reference parameter ΔAFLst may be set for respective parameters indicative of engine conditions during acquisition of the actual evaluation parameter (in this case, during the duration of the forced lean imbalance condition).

Then, the CPU proceeds to step 2060 to determine whether the absolute value DR of a difference between the rich-side evaluation parameter AveΔAFR and the rich-side reference parameter ΔAFRst is larger than a given rich-side evaluation threshold value DRth, and whether the absolute value DL of a difference between the lean-side evaluation parameter AveΔAFL and the lean-side reference parameter ΔAFLst is larger than a given lean-side evaluation threshold value DLth.

If the absolute value DR is larger than the threshold value DRth, and the absolute value DL is larger than the threshold value DLth, the CPU determines that the output characteristics of the air/fuel ratio sensor 55 deviate largely from the output characteristics of the reference air/fuel ratio sensor, and therefore, the air/fuel ratio sensor 55 "is not adequate for making a cylinder-to-cylinder A/F imbalance determination".

In this case, the CPU makes an affirmative decision (YES) in step 2060, and proceeds to step 2065 to set the value of the sensor adequacy determination termination flag XSOK to "2", which indicates that the air/fuel ratio sensor 55 is not adequate for making an A/F imbalance determination. Thereafter, the CPU proceeds to step 1995 to complete the current cycle of the routine.

On the other hand, if the absolute value DR is equal to or smaller than the threshold value DRth and/or the absolute value DL is equal to or smaller than the threshold value DLth at the time when the CPU executes step 2060, the CPU determines that the output characteristics of the air/fuel ratio sensor are substantially identical with those of the reference air/fuel ratio sensor, and therefore, "the air/fuel ratio sensor 55 is adequate for making a cylinder-to-cylinder A/F imbalance determination". In this case, the CPU makes a negative decision (NO) in step 2060, and proceeds to step 2070 to set the value of the sensor adequacy determination termination flag XSOK to "1", which indicates that the air/fuel ratio sensor 55 is adequate for making an A/F imbalance determination. Thereafter, the CPU proceeds to step 1995 to complete the current cycle of the routine.

As described above, the second determination system includes a forced imbalance condition creating device that creates forced imbalance conditions, like the first determination system. The forced imbalance condition creating device of the second determination system is further configured to change the amount(s) of fuel injected from one or more fuel injection valves 25, so as to create a forced rich imbalance condition and a forced lean imbalance condition as the forced imbalance conditions such that the duration of the forced rich imbalance condition does not overlap the duration of the forced lean imbalance condition. To create the forced rich imbalance condition, the air/fuel ratio of an air-fuel mixture supplied to the above-indicated one cylinder (in this case, the first cylinder) is set to a first air/fuel ratio (obtained by multiplying the fuel injection amount required to provide the stoichiometric air/fuel ratio by a fuel correction coefficient Ken (=1+αp)), which is richer than the air/fuel ratio of air-fuel mixtures supplied to the other plural cylinders (see step 1915 of FIG. 19 and step 1410-step 1440, step 1480 of FIG. 14). To create the forced lean imbalance condition, the air/fuel ratio of an air-fuel mixture supplied to the above-indicated one cylinder (in this case, the first cylinder) is set to a second air/fuel ratio (obtained by multiplying the fuel injection amount required to provide the stoichiometric air/fuel ratio by a fuel correction coefficient Ken (=1+αm)), which is leaner than the air/fuel ratio of air-fuel mixtures supplied to the other plural cylinders (see step 2005 of FIG. 20 and step 1410-step 1440, step 1480 of FIG. 14).

The output characteristics of the air/fuel ratio sensor 55 may differ between the case where the air/fuel ratio to be detected changes from a rich air/fuel ratio to a lean air/fuel ratio, and the case where the air/fuel ratio changes from a lean air/fuel ratio to a rich air/fuel ratio. Accordingly, if "the air/fuel ratio of an air-fuel mixture supplied to one cylinder (the air/fuel ratio of the first cylinder as the forced imbalance cylinder) is set to the first air/fuel ratio and the second air/fuel ratio, variations in the air/fuel ratio of exhaust gas that reaches the air/fuel ratio sensor 55 can be set to various patterns, and therefore, the adequacy of the air/fuel ratio sensor can be determined with high accuracy.

Furthermore, the second determination system obtains an air/fuel ratio sensor evaluation parameter during a period in which the air/fuel ratio of the forced imbalance cylinder is set to the first air/fuel ratio, as a first evaluation parameter (AveΔAFR), and obtains an air/fuel ratio sensor evaluation parameter during a period in which the air/fuel ratio of the forced imbalance cylinder is set to the second air/fuel ratio, as a second evaluation parameter (AveΔAFL) that is to be distinguished from the first evaluation parameter (AveΔAFR). Then, the second determination compares the first evaluation parameter (AveΔAFR) and the second evaluation parameter (AveΔAFL) with "a first reference parameter ΔAFRst and a second reference parameter ΔAFLst", respectively, as the reference parameters, and makes a determination on the adequacy of the air/fuel ratio sensor, based on the results of comparison (see step 2050-step 2070, etc. of FIG. 20). Accordingly, the adequacy of the air/fuel ratio sensor can be determined with high accuracy.

In addition, the output characteristics of the air/fuel ratio sensor 55 may differ between the case where the air/fuel ratio to be detected is richer (or smaller) than the stoichiometric air/fuel ratio, and the case where the air/fuel ratio is leaner (or larger) than the stoichiometric air/fuel ratio. Accordingly, the second determination system sets the first air/fuel ratio to an air/fuel ratio that is richer than the stoichiometric ratio, and sets the second air/fuel ratio to an air/fuel ratio that is leaner than the stoichiometric ratio. As a result, the adequacy of the air/fuel ratio sensor 55 can be determined with further improved accuracy.

Next, a cylinder-to-cylinder air/fuel ratio (A/F) imbalance determination system (hereinafter simply called "third determination system") according to a third embodiment of the invention will be described. When the third determination system obtains parameters for use in evaluation of the air/fuel ratio sensor 55, the system creates "a forced rich imbalance condition and a forced lean imbalance condition" as forced imbalance conditions, and obtains the average values of the absolute values of a plurality of detected air/fuel ratio change rates ΔAF acquired in the respective conditions, as "a rich-side evaluation parameter and a lean-side evaluation parameter", as in the second determination system. Then, the third determination system determines that the air/fuel ratio sensor 55 (the output characteristics of the air/fuel ratio sensor 55) is not adequate for making an A/F imbalance determination, when the absolute value of a difference between the rich-side evaluation parameter and a rich-side reference parameter is larger than a rich-side threshold value DRth, AND the absolute value of a difference between the lean-side evaluation parameter and a lean-side reference parameter is larger than a lean-side threshold value DLth.

Figure 21:
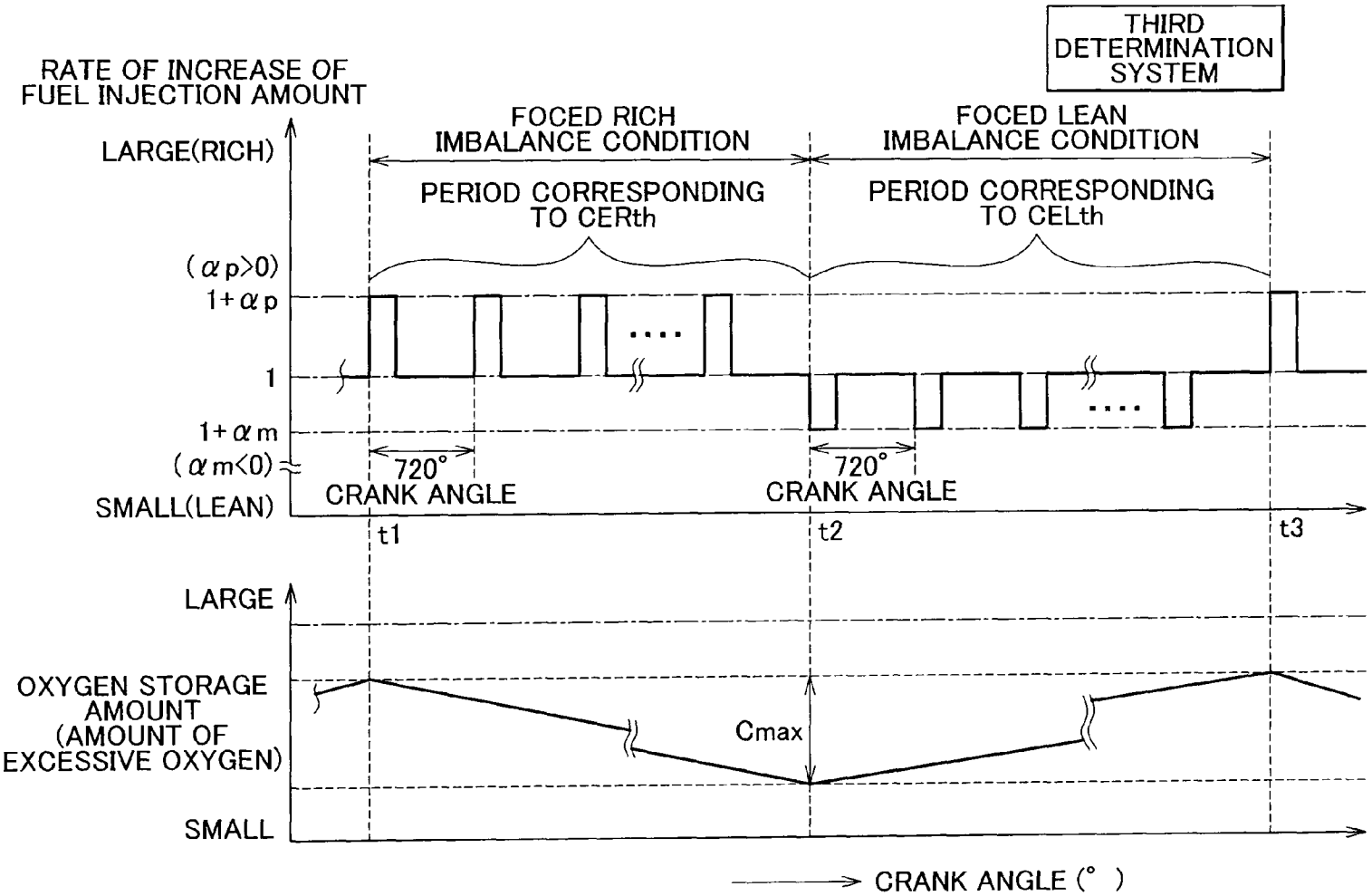
FIG. 21 is a time chart useful for explaining the operation of a cylinder-to-cylinder air/fuel ratio imbalance determination system (third determination system) according to a third embodiment of the invention.

Furthermore, the third determination system causes "the forced rich imbalance condition and the forced lean imbalance condition" to occur alternately in time, as shown in FIG. 21, and limits the respective durations (e.g., the number of fuel injections into the forced imbalance cylinder) of the forced rich imbalance condition and the forced lean imbalance condition, to those in which "the oxygen storage amount OSA of the upstream catalyst 43 does not reach "0", and does not reach the maximum oxygen storage amount Cmax".

In other words, during a first duration (the duration of the forced rich imbalance condition in which the average of the air/fuel ratios of air-fuel mixtures supplied to the engine 10 as a whole is richer than the stoichiometric air/fuel ratio), the third determination system sets the air/fuel ratio (which will also be called "intermediate air/fuel ratio") of the non-forced-imbalance cylinders to "the stoichiometric air/fuel ratio or an air/fuel ratio leaner than the stoichiometric ratio", and sets the air/fuel ratio of the forced imbalance cylinder to "an air/fuel ratio richer than the stoichiometric air/fuel ratio". The third determination system limits the first duration so that "excessive unburned substances in the exhaust gas emitted from the combustion chamber 21 of the forced imbalance cylinder" does not exceed "a first amount that can be oxidized by an amount of oxygen which is smaller than the maximum oxygen storage amount Cmax of the upstream catalyst 43". Also, during a second duration (the duration of the forced lean imbalance condition in which the average of the air/fuel ratios of air-fuel mixtures supplied to the engine 10 as a whole is leaner than the stoichiometric air/fuel ratio), the third determination system sets the air/fuel ratio (intermediate air/fuel ratio) of the non-forced-imbalance cylinders to "the stoichiometric air/fuel ratio or an air/fuel ratio richer than the stoichiometric ratio", and sets the air/fuel ratio of the forced imbalance cylinder to "an air/fuel ratio leaner than the stoichiometric air/fuel ratio". The third determination system limits the second duration so that "excessive oxygen in the exhaust gas emitted from the combustion chamber 21 of the forced imbalance cylinder" dos not exceed "a second amount that is smaller than the maximum oxygen storage amount Cmax of the upstream catalyst 43". Then, the third determination system alternately sets the first duration and the second duration, namely, alternately establishes the forced rich imbalance condition and the forced lean imbalance condition.

The third determination system may be configured to determine that the air/fuel ratio sensor 55 (the output characteristics of the air/fuel ratio sensor 55) is not adequate for making an A/F imbalance determination, when the absolute value of a difference between the rich-side evaluation parameter and the rich-side reference parameter is larger than the rich-side threshold value DRth, OR the absolute value of a difference between the lean-side evaluation parameter and the lean-side reference parameter is larger than the lean-side threshold value DLth. In the other aspects, the third determination system is identical with the first determination system and the second determination system. Accordingly, only the difference as described above will be mainly explained below.

Figure 22:
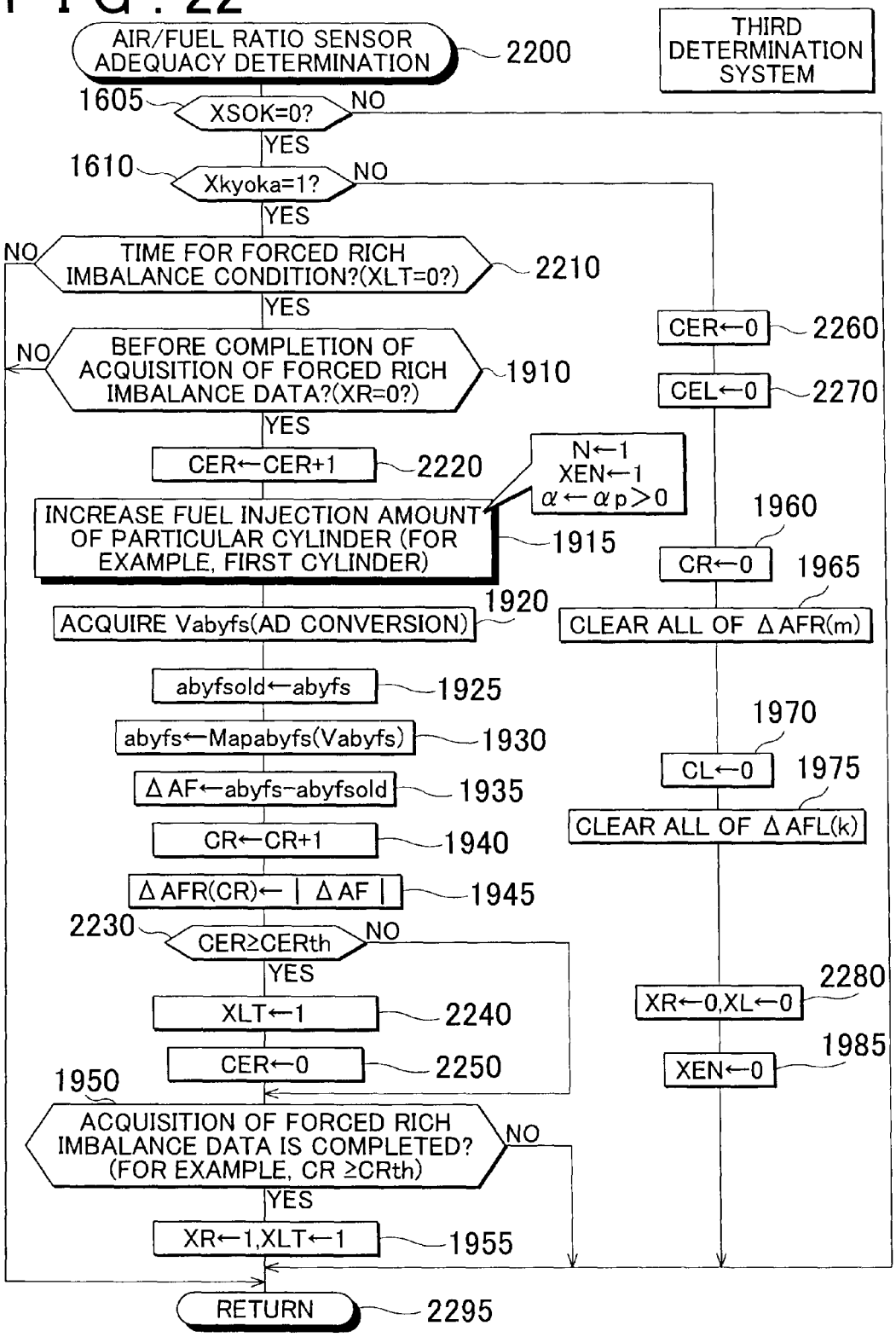
FIG. 22 is a flowchart illustrating a routine executed by CPU of the third determination system.
Figure 23:
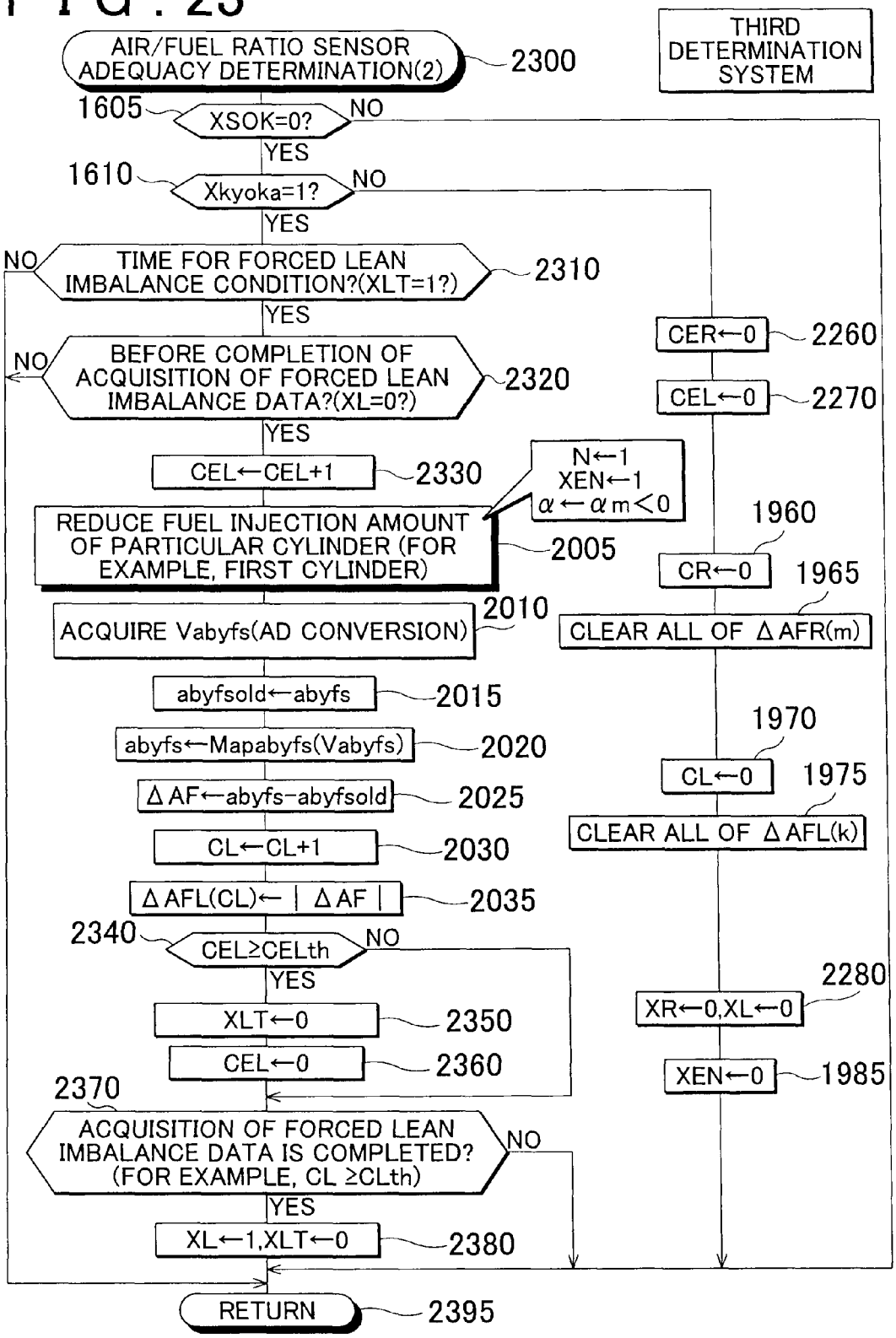
FIG. 23 is a flowchart illustrating a routine executed by CPU of the third determination system.
Figure 24:
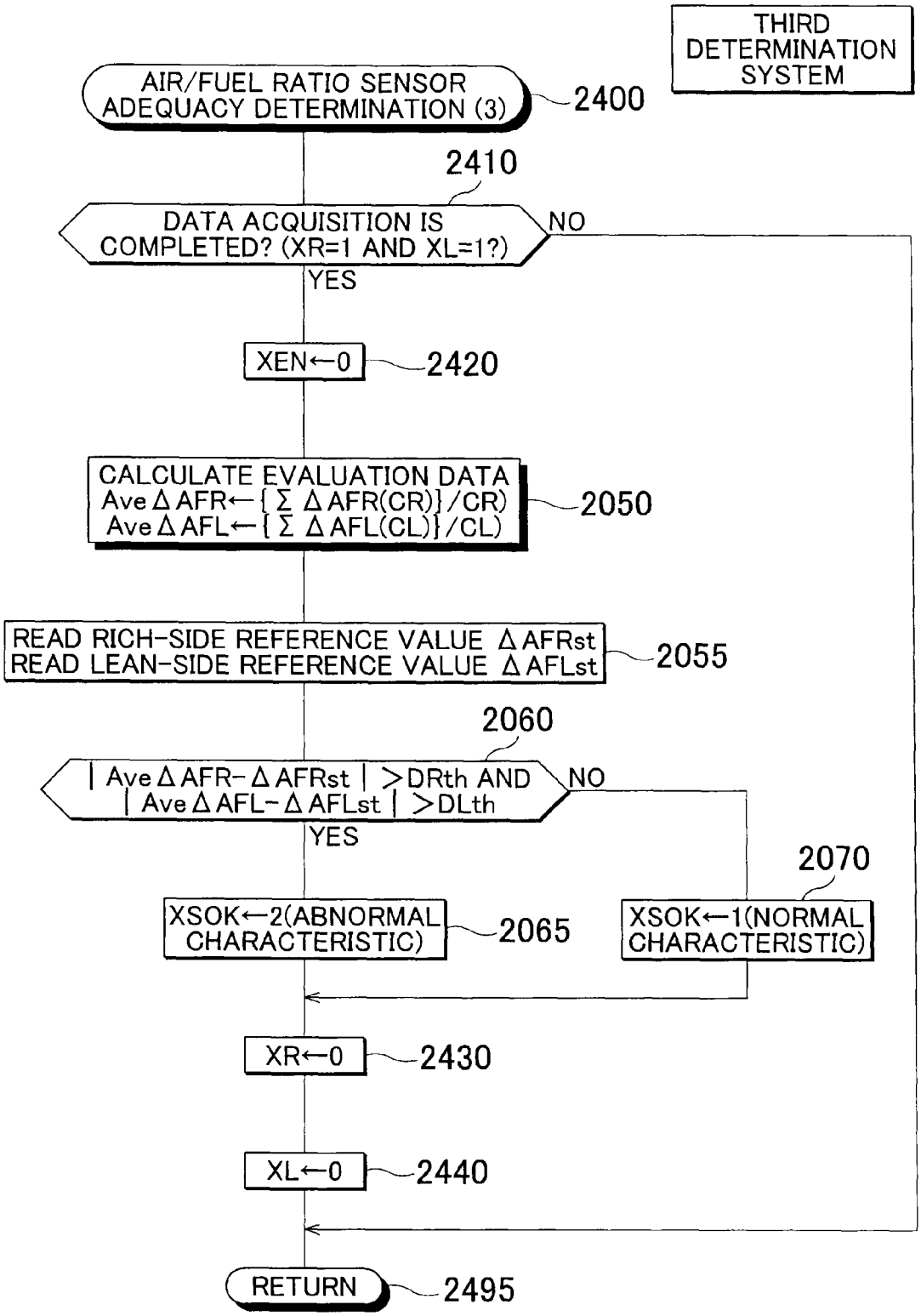
FIG. 24 is a flowchart illustrating a routine executed by CPU of the third determination system.

The CPU of the third determination system executes the routines executed by the CPU of the first determination system, except for the routine of FIG. 16, and executes each of the routines as shown in FIG. 22-FIG. 24, which replace the routine of FIG. 16, each time a given time (4 ms) elapses.

The following explanation will be provided on the assumptions that the value of the sensor adequacy determination termination flag XSOK is "0", which indicates that a determination on the adequacy of the air/fuel ratio sensor 55 has not been made, and that the value of the determination permission flag Xkyoka is "1", which indicates that the determination execution condition is satisfied.

When the time for execution of the routine of FIG. 22 is reached, the CPU starts the process from step 2200, and determines in step 1605 whether the value of the sensor adequacy determination termination flag XSOK is "0". If the sensor adequacy determination termination flag XSOK has a value other than "0" at this time, the CPU makes a negative decision (NO) in step 1605, and directly proceeds to step 2295 to complete the current cycle of the routine.

According to the assumption as described above, the value of the sensor adequacy determination termination flag XSOK is "0". Therefore, the CPU makes an affirmative decision (YES) in step 1605, and proceeds to step 1610 to determine whether the value of the determination permission flag is "1".

According to the assumption as described above, the value of the determination permission flag Xkyoka is "1". Therefore, the CPU makes an affirmative decision (YES) in step 1610, and proceeds to step 2210 to determine whether the current time is "a point in time at which a forced rich imbalance condition should be created (the time for the forced rich imbalance condition)". More specifically, the CPU determines whether a forced lean imbalance condition occurrence flag XLT is "0". In this connection, the value of the forced lean imbalance condition occurrence flag XLT is set to "0" in the above-described initial routine.

Assuming that the CPU currently proceeds to step 2210 for the first time after start of the engine 10, the CPU makes an affirmative decision (YES) in step 2210, and proceeds to step 1910 to determine whether the acquisition of forced rich imbalance data has not been completed (namely, whether the value of the rich data acquisition completion flag XR is "0"). In this case, the value of the rich data acquisition completion flag XR is "0". Therefore, the CPU makes an affirmative decision (YES) in step 1910, and proceeds to step 2220 to increase the value of a counter CER for counting the number of frequencies of occurrence of the forced rich imbalance condition by "1". The value of the counter CER is set to "0" in the above-described initial routine.

Then, the CPU sequentially executes step 1915-step 1945. As a result, value "N" is set to "1", and the value of the forced imbalance condition flag XEN is set to "1", while value "α" is set to a positive value "αp". Furthermore, the detected air/fuel ratio change rate ΔAF is obtained, and the value of the counter CR is increased by "1". Then, the absolute value (|ΔAF|) of the detected air/fuel ratio change rate ΔAF obtained in step 1935 is stored in step 1945 as "the CR-th piece of forced rich imbalance data ΔAFR(CR)".

Then, the CPU proceeds to step 2230 to determine whether the value of the forced rich imbalance condition frequency counter CER is equal to or larger than a given threshold value CERth. The threshold value CERth is determined in advance so that the entire or total amount of excessive unburned substances that flow into the upstream catalyst 43 in the engine that is kept being in the forced rich imbalance condition until the counter CER reaches the threshold value CERth can be entirely oxidized by an amount of oxygen which is smaller than the maximum oxygen storage amount Cmax of the upstream catalyst 43. The threshold value CERth is a natural number including "1".

If the value of the forced rich imbalance condition frequency counter CER is smaller than the threshold value CERth at this time, the CPU makes a negative decision (NO) in step 2230, and directly proceeds to step 1950 to determine whether the acquisition of the forced rich imbalance data is completed (i.e., whether the value of the counter CR is equal to or larger than a given threshold value CRth). The threshold value CRth is set to a value that is equal to or larger than the threshold value CERth.

Accordingly, the value of the counter CR at this time is smaller than the threshold value CRth except for the case where the threshold value CRth and the threshold value CERth are set to the same value. Therefore, the CPU makes a negative decision (NO) in step 1950, and directly proceeds to step 2295 to complete the current cycle of the routine. As a result, the value of the forced lean imbalance condition occurrence flag XLT is kept at "0". Furthermore, "the value of the rich data acquisition completion flag XR" and "a value of a lean data acquisition completion flag XL that is set to "0" in the above-described initial routine" are both kept at "0".

In the meantime, when the time for execution of the routine of FIG. 23 is reached, the CPU starts the process from step 2300, and determines in step 1605 whether the value of the sensor adequacy determination termination flag XSOK is "0". According to the assumption as described above, the sensor adequacy determination termination flag XSOK is "0". Therefore, the CPU makes an affirmative decision (YES) in step 1605, and proceeds to step 1610 to determine whether the value of the determination permission flag Xkyoka is equal to "1".

According to the assumption as described above, the value of the determination permission flag Xkyoka is "1". Therefore, the CPU makes an affirmative decision (YES) in step 1610, and proceeds to step 2310 to determine whether the current time is "a point in time at which a forced lean imbalance condition should be created (the time for the forced lean imbalance condition)". More specifically, the CPU determines whether the forced lean imbalance condition occurrence flag XLT is "1".

As described above, the value of the forced lean imbalance condition occurrence flag XLT is kept at "0" at this time. Accordingly, the CPU makes a negative decision (NO) in step 2310, and directly proceeds to step 2395 to complete the current cycle of the routine.

Furthermore, the CPU starts the process of FIG. 24 from step 2400 when the time for execution of this routine is reached, and proceeds to step 2410 to determine whether the acquisition of data for use in evaluation of the air/fuel ratio sensor 55 is completed. More specifically, the CPU determines in step 2410 whether the value of the rich data acquisition completion flag XR is "1" and whether the value of the lean data acquisition completion flag XL is "1".

At this point in time, the value of the rich data acquisition flag XR and the value of the lean data acquisition completion flag XL are both "0". Accordingly, the CPU makes a negative decision (NO) in step 2410, and directly proceeds to step 2495 to complete the current cycle of the routine.

As the above-described condition continues, the CPU repeatedly executes step 2220, step 1915 through step 1945 of FIG. 22. Thus, after a lapse of a certain time, the value of the counter CER reaches the threshold value CERth. In this case, when the CPU proceeds to step 2230 of FIG. 22, the CPU makes an affirmative decision (YES) in step 2230. Then, the CPU proceeds to step 2240 to set the value of the forced lean imbalance condition occurrence flag XLT to "1", and proceeds to step 2250 to set the value of the counter CER to "0".

Then, the CPU proceeds to step 1950. At this time, the value of the counter CR is smaller than the threshold value CRth except for the case where the threshold value CRth and the threshold value CERth are set to the same value. Thus, the CPU makes a negative decision (NO) in step 1950, and directly proceeds to step 2295 to complete the current cycle of the routine.

As a result, when the CPU executes step 2210 of FIG. 22 after a lapse of a certain time, the CPU makes a negative decision (NO) in step 2210, and directly proceeds to step 2295. Thus, the operation of step 1915 of FIG. 22 is not carried out.

On the other hand, if the CPU executes step 2310 of FIG. 23, the CPU makes an affirmative decision (YES) in step 2310, and proceeds to step 2320 to determine whether the acquisition of forced lean imbalance data has not been completed. More specifically, the CPU determines in step 2320 whether the value of the forced lean imbalance data acquisition completion flag XL (lean data acquisition completion flag XL) is "0". The value of the lean data acquisition completion flag XL is set to "0" in the above-described initial routine.

Since the acquisition of the forced lean imbalance data has not been completed at this point in time, the value of the lean data acquisition completion flag XL is "0". Accordingly, the CPU makes an affirmative decision (YES) in step 2320, and proceeds to step 2330 to increase the value of a counter CEL for counting the number of frequencies of occurrence of the forced lean imbalance condition by "1". The value of the counter CEL is set to "0" in the above-described initial routine.

Then, the CPU sequentially executes step 2005 through step 2035. As a result, the value "N" is set to "1", and the value of the forced imbalance condition flag XEN is set to "1", while the value "$\alpha$" is set to a negative value "$\alpha m$". Further, the detected air/fuel ratio change rate $\Delta AF$ is obtained in step 2025, and the value of the counter CL is increased by "1" in step 2030. Then, the absolute value ($|\Delta AF|$) of the detected air/fuel ratio change rate $\Delta AF$ obtained in step 2025 is stored in step 2035 as "the CL-th piece of forced lean imbalance data $\Delta AFL(CL)$".

Then, the CPU proceeds to step 2340 to determine whether the value of the forced lean imbalance condition frequency counter CEL is equal to or larger than a given threshold value CELth. The threshold value CELth is determined in advance so that the total amount of excessive oxygen that flows into the upstream catalyst 43 in the engine that is kept in the forced lean imbalance condition until the value of the counter CEL reaches the threshold value CELth is smaller than the maximum oxygen storage amount Cmax of the upstream catalyst 43. The threshold value CELth is a natural number including "1".

If the value of the forced lean imbalance condition frequency counter CEL is smaller than the given threshold value CELth, the CPU makes a negative decision (NO) in step 2340, and directly proceeds to step 2370 to determine whether the acquisition of the forced lean imbalance data is completed (i.e., whether the value of the counter CL is equal to or larger than a given threshold value CLth). The threshold value CLth is set to a value that is equal to or larger than the threshold value CELth.

At this point in time, the value of the counter CL is smaller than the threshold value CLth, except for the case where the threshold value CLth and the threshold value CELth are set to the same value. Therefore, the CPU makes a negative decision (NO) in step 2370, and directly proceeds to step 2395 to complete the current cycle of the routine. As a result, the value of the forced lean imbalance condition occurrence flag XLT is kept at "1". Also, the value of the lean data acquisition completion flag is kept at "0".

Therefore, if the CPU proceeds to step 2410 of FIG. 24, the CPU makes a negative decision (NO) in step 2410, and directly proceeds to step 2495 to complete the current cycle of the routine.

As the above-described condition continues, the CPU repeatedly executes step 2330, step 2005-step 2035 of FIG. 23. Thus, after a lapse of a certain time, the value of the counter CEL reaches the threshold value CELth. In this case, when the CPU proceeds to step 2340 of FIG. 23, the CPU makes an affirmative decision (YES) in step 2340. Then, the CPU proceeds to step 2350 to set the value of the forced lean imbalance condition occurrence flag XLT to "0", and proceeds to step 2360 to set the value of the counter CEL to "0".

Then, the CPU proceeds to step 2370. At this time, the value of the counter CL is smaller than the threshold value CLth, except for the case where the threshold value CLth and the threshold value CELth are set to the same value. Accordingly, the CPU makes a negative decision (NO) in step 2370, and directly proceeds to step 2395 to complete the current cycle of the routine.

When the CPU executes step 2310 of FIG. 23 after a lapse of a certain time, the CPU makes a negative decision (NO) in step 2310, and directly proceeds to step 2395. Thus, the operation of step 2005 of FIG. 23 is not carried out.

If on the other hand, the CPU executes step 2210 of FIG. 22, the CPU makes an affirmative decision (YES) in step 2210, and executes step 1910, step 2220, and step 1915-step 1945.

In the manner as described above, the CPU terminates the forced rich imbalance condition "when the number of pieces of data ΔAFR(CR) equal to the threshold value CERth have been acquired (i.e., the number of pieces of data ΔAFR(CR) obtained reaches the threshold value CERth)", and creates the forced lean imbalance condition. Also, the CPU terminates the forced lean imbalance condition "when the number of pieces of data ΔAFL(CL) equal to the threshold value CELth have been acquired (i.e., the number of pieces of data ΔAFL (CL) obtained reaches the threshold value CELth)", and creates the forced rich imbalance condition.

As the above-described condition continues, the value of the counter CR reaches the threshold value CRth. In this case, when the CPU proceeds to step 1950 of FIG. 22, the CPU makes an affirmative decision (YES) in step 1950, and proceeds to step 1955 to set the value of the rich data acquisition completion flag XR to "1", and set the value of the forced lean imbalance condition occurrence flag XLT to "1". As a result, when the CPU proceeds to step 1910 of FIG. 22, the CPU makes a negative decision (NO) in step 1910, and directly proceeds to step 2295 to complete the current cycle of the routine. Accordingly, the forced rich imbalance condition ceases to be created.

Similarly, as the above-described condition continues, the value of the counter CL reaches the threshold value CLth. In this case, when the CPU proceeds to step 2370 of FIG. 23, the CPU makes an affirmative decision (YES) in step 2370, and proceeds to step 2380 to set the value of the lean data acquisition completion flag XL to "1", and set the value of the forced lean imbalance condition occurrence flag XLT to "0". As a result, when the CPU proceeds to step 2320 of FIG. 23, the CPU makes a negative decision (NO) in step 2320, and directly proceeds to step 2295 to complete the current cycle of the routine. Accordingly, the forced lean imbalance condition ceases to be created.

In addition, if the CPU proceeds to step 2410 of FIG. 24 when the value of the rich data acquisition completion flag XR is set to "1" and the value of the lean data acquisition completion flag XL is set to "1", the CPU makes an affirmative decision (YES) in step 2410, and proceeds to step 2420 to set the value of the forced imbalance condition flag XEN to "0".

Then, the CPU executes step 2050 through step 2060, and step 2065 or step 2070, so as to determine whether the air/fuel ratio sensor 55 is "adequate for making a cylinder-to-cylinder A/F imbalance condition". Thereafter, the CPU sets the value of the rich data acquisition completion flag XR to "0" in step 2430, and sets the value of the lean data acquisition completion flag XL to "0" in step 2440. Then, the CPU proceeds to step 2495 to complete the current cycle of the routine.

When the value of the determination permission flag Xkyoka is "0", the CPU makes a negative decision (NO) in step 1610 of FIG. 22, proceeds to step 2260 to set the value of the counter CER to "0", and proceeds to step 2270 to set the value of the counter CEL to "0". Then, the CPU executes step 1960 through step 1975, and proceeds to step 2280 to set both of the value of the rich data acquisition completion flag XR and the value of the lean data acquisition completion flag XL to "0". Then, the CPU executes step 1985 and completes the current cycle of the routine.

Similarly, when the value of the determination permission flag Xkyoka is "0", the CPU makes a negative decision (NO) in step 1610 of FIG. 23, executes step 2260, step 2270, step 1960-step 1975, step 2280 and step 1985, and completes the current cycle of the routine.

Also, if the CPU proceeds to step 1605 of FIG. 23 when the sensor adequacy determination termination flag XSOK has a value other than "0", the CPU makes a negative decision (NO) in step 1605, and directly proceeds to step 2395 to complete the current cycle of the routine.

As described above, like the second determination system, the third determination system includes a forced imbalance condition creating device that is configured to change the amount(s) of fuel injected from one or more fuel injection valves, so as to create a forced rich imbalance condition and a forced lean imbalance condition such that the duration of the forced rich imbalance condition does not overlap the duration of the forced lean imbalance condition (see step 1915 of FIG. 22, step 2005 of FIG. 23 and other steps). To create the forced rich imbalance condition, the air/fuel ratio of an air-fuel mixture supplied to one cylinder (in this case, the first cylinder) is set to a first air/fuel ratio that is richer than the air/fuel ratio of air-fuel mixtures supplied to the other plural cylinders (the second through fourth cylinders). To create the forced lean imbalance condition, the air/fuel ratio of an air-fuel mixture supplied to one cylinder (in this case, the first cylinder) is set to a second air/fuel ratio that is leaner than the air/fuel ratio of air-fuel mixtures supplied to the other plural cylinders (the second through fourth cylinders).

Furthermore, in the forced rich imbalance condition, the forced imbalance condition creating device sets the first air/fuel ratio to an air/fuel ratio that is richer than the stoichiometric air/fuel ratio (i.e., an air/fuel ratio obtained by multiplying the fuel injection amount required to provide the stoichiometric ratio by a fuel correction coefficient Ken(=1+αp)), and sets the air/fuel ratio of the air-fuel mixtures supplied to the other plural cylinders to "a third air/fuel ratio that is equal to or leaner than the stoichiometric ratio (i.e., an air/fuel ratio obtained from the fuel injection amount required to provide the stoichiometric ratio or obtained by correcting (reducing) the fuel injection amount with an air/fuel ratio feedback amount DFi). With the air/fuel ratio of the first cylinder and the air/fuel ratio of the other cylinders thus set, the average air/fuel ratio of the air-fuel mixtures supplied to the engine 10 as a whole will be richer than the stoichiometric air-fuel ratio. In addition, the forced imbalance condition creating device limits the duration of the forced rich imbalance condition, so that excessive unburned substances in the exhaust gas emitted during the duration of the forced rich imbalance condition does not exceed the first amount as an amount of unburned substances that can be oxidized by an amount of oxygen which is smaller than the maximum oxygen storage amount of the three-way catalyst 43 (see step 2210, step 2220, and step 2230-step 2250 of FIG. 22, for example). In the forced lean imbalance condition, the forced imbalance condition creating device sets the second air/fuel ratio to an air/fuel ratio that is leaner than the stoichiometric air/fuel ratio (i.e., an air/fuel ratio obtained by multiplying the fuel injection amount required to provide the stoichiometric ratio by a fuel correction coefficient Ken(=1+αm)), and sets the air/fuel ratio of the air-fuel mixtures supplied to the other plural cylinders to "a fourth air/fuel ratio that is equal to or richer than the stoichiometric ratio (i.e., an air/fuel ratio obtained from the fuel injection amount required to provide the stoichiometric ratio or obtained by correcting (increasing) the fuel injection amount with an air/fuel ratio feedback amount DFi). With the air/fuel ratio of the first cylinder and the air/fuel ratio of the other cylinders thus set, the average air/fuel ratio of the air-fuel mixtures supplied to the engine 10 as a whole will be leaner than the stoichiometric air-fuel ratio. In addition, the forced imbalance condition creating device limits the duration of the forced lean imbalance condition, so that excessive oxygen in the exhaust gas emitted during the duration of the forced lean imbalance condition does not exceed the second amount that is smaller than the maximum oxygen storage amount of the three-way catalyst (see step 2310, step 2330, and step 2340-step 2360 of FIG. 23, for example).

With the above arrangement, even when the output characteristics of the air/fuel ratio sensor 55 differ between the case where the air/fuel ratio detected is richer than the stoichiometric air/fuel ratio and the case where the air/fuel ratio is leaner than the stoichiometric ratio, the adequacy of the air/fuel ratio sensor can be determined with further improved accuracy.

Furthermore, in this embodiment, the total amount of excessive unburned substances that flow into the three-way catalyst 43 in the forced rich imbalance condition can be set so as not to exceed the amount of unburned substances that can be treated (i.e., removed or converted into harmless substances) by the three-way catalyst 43. In addition, in this embodiment, the total amount of excessive oxygen that flows into the three-way catalyst 43 in the forced lean imbalance condition can be set so as not to exceed the amount of oxygen that can be adsorbed or stored by the three-way catalyst 43 (the maximum oxygen storage amount Cmax). Accordingly, it is possible to prevent emissions from deteriorating when the forced imbalance conditions are established.

The CPU of the third determination system may estimate the maximum oxygen storage amount Cmax and instantaneous oxygen storage amount OSA of the three-way catalyst 43, and may limit the duration of the forced rich imbalance condition and the duration of the forced lean imbalance condition, so that the oxygen storage amount OSA falls within a range between a first predetermined value that is larger than "0", and a second predetermined value that is larger than the first predetermined value and smaller than the maximum oxygen storage amount Cmax.

Also, the CPU of the third determination system may set the fuel correction coefficient Ken to "1−αp/3", without depending on the air/fuel ratio feedback amount DFi, and may obtain the amount of fuel injected into each of the non-forced-imbalance cylinders by multiplying the basic fuel injection amount Fbase by the thus set fuel correction coefficient Ken, thereby to set the third air/fuel ratio to an air/fuel ratio that is leaner than the stoichiometric air-fuel ratio.

Similarly, the CPU of the third determination system may set the fuel correction coefficient Ken to "1−αm/3", without depending on the air/fuel ratio feedback amount DFi, and may obtain the amount of fuel injected into each of the non-forced-imbalance cylinders by multiplying the basic fuel injection amount Fbase by the thus set fuel correction coefficient Ken, thereby to set the fourth air/fuel ratio to an air/fuel ratio that is richer than the stoichiometric air-fuel ratio.

Also, the CPU of the third determination system may increase the counter CER by "1" each time the crankshaft rotates 720° (namely, each time the engine goes through one unit combustion cycle equivalent to 720° CA) while the forced rich imbalance condition is established. Similarly, the CPU of the third determination system may increase the counter CEL by "1" each time the crankshaft rotates 720° (namely, each time the engine goes through one unit combustion cycle equivalent to 720° CA) while the forced lean imbalance condition is established.

Next, a cylinder-to-cylinder air/fuel ratio (A/F) imbalance determination system (which will be simply called "fourth determination system") according to a fourth embodiment of the invention will be described. If the air/fuel ratio of a particular cylinder (forced imbalance cylinder), which deviates from the air/fuel ratio of the remaining cylinders in a normal condition where no forced imbalance condition occurs, is shifted to the rich or lean side so as to create a forced imbalance condition, a parameter for evaluation of the air/fuel ratio sensor obtained in the forced imbalance condition may involve an influence of the deviation in the normal condition. In this case, it may not be possible to obtain an evaluation parameter with which the air/fuel ratio sensor 55 can be correctly evaluated.

In view of the above situation, the fourth determination system sequentially designates at least two, mutually different cylinders (N1-*th* cylinder and N2-*th* cylinder) as forced imbalance cylinders, when the system obtains a parameter for evaluation of the air/fuel ratio sensor 55. In addition, the fourth determination system acquires a plurality of pieces of original data A1 used for obtaining a provisional evaluation parameter when the forced imbalance cylinder is "the N1-*th* cylinder (e.g., the first cylinder)", and acquires a plurality of pieces of original data A2 used for obtaining a provisional evaluation parameter when the forced imbalance cylinder is "the N2-*th* cylinder (e.g., the fourth cylinder)". Thus, the fourth determination system acquires original data for the provisional evaluation parameters such that each set of the original data is associated with the cylinder set as the forced imbalance cylinder.

Upon completion of the acquisition of original data of a provisional evaluation parameter with respect to each of the forced imbalance cylinders, the fourth determination system calculates a provisional evaluation parameter for each of the forced imbalance cylinders from "a plurality of pieces of original data for obtaining the provisional evaluation parameter for each cylinder". Namely, the fourth determination system obtains the average value of the plurality of pieces of original data A1 acquired when the N1-*th* cylinder is the forced imbalance cylinder, as a provisional evaluation parameter ΔAFev(N1) of the air/fuel ratio sensor 55, and obtains the average value of the plurality of pieces of original data A2 acquired when the N2-*th* cylinder is the forced imbalance cylinder, as a provisional evaluation parameter ΔAFev(N2) of the air/fuel ratio sensor 55.

Then, the fourth determination system determines whether the provisional evaluation parameter ΔAFev(N1) obtained with respect to the N1-*th* cylinder and the provisional evaluation parameter ΔAFev(N2) obtained with respect to the N2-*th* cylinder are substantially equal to each other (more specifically, whether the absolute value |ΔAFev(N1)−ΔAFev(N2)| of a difference between these parameters is equal to or smaller than a very small threshold value αth). If the provisional evaluation parameters are substantially equal to each other, the fourth determination system regards the air/fuel ratios of the respective cylinders as being substantially equal to each other when no forced imbalance condition is created (namely, determines that both the N1-*th* cylinder and the N2-*th* cylinder are inherently non-imbalance or normal cylinders). In this case, the system then obtains one of the provisional evaluation parameter ΔAFev(N1) for the N1-*th* cylinder and the provisional evaluation parameter ΔAFev(N2) for the N2-*th* cylinder, or the average value thereof, as a parameter (final evaluation parameter) ΔAFev for use in evaluation of the air/fuel ratio sensor.

Thereafter, if the absolute value of a difference between the final evaluation parameter ΔAFev and a reference parameter ΔAFst exceeds a threshold value Dth, the fourth determination system determines that "the output characteristics of the air/fuel ratio sensor 55 are not adequate for making an A/F imbalance determination", and inhibits itself from making an A/F imbalance determination, as in the first through third determination systems. On the other hand, if the absolute value of the difference between the final evaluation parameter ΔAFev and the reference parameter ΔAFst is equal to or smaller than the threshold value Dth, the fourth determination system determines that "the output characteristics of the air/fuel ratio sensor 55 are adequate for making an A/F imbalance determination", and is allowed to make an A/F imbalance determination.

If the provisional evaluation parameter ΔAFev(N1) for the N1-*th* cylinder and the provisional evaluation parameter ΔAFev(N2) for the N2-*th* cylinder are not substantially equal to each other, the fourth determination system determines that there is an imbalance between the air/fuel ratios of these cylinders (the air/fuel ratio of an air-fuel mixture supplied to the N1-*th* cylinder and the air/fuel ratio of an air-fuel mixture supplied to the N2-*th* cylinder) in a condition where no forced imbalance condition is created. In this case, the fourth determination system does not make a determination (air/fuel ratio sensor adequacy determination) as to whether "the output characteristics of the air/fuel ratio sensor 55 are adequate for making an A/F imbalance determination", and also inhibits itself from making an A/F imbalance determination.

Figure 25:
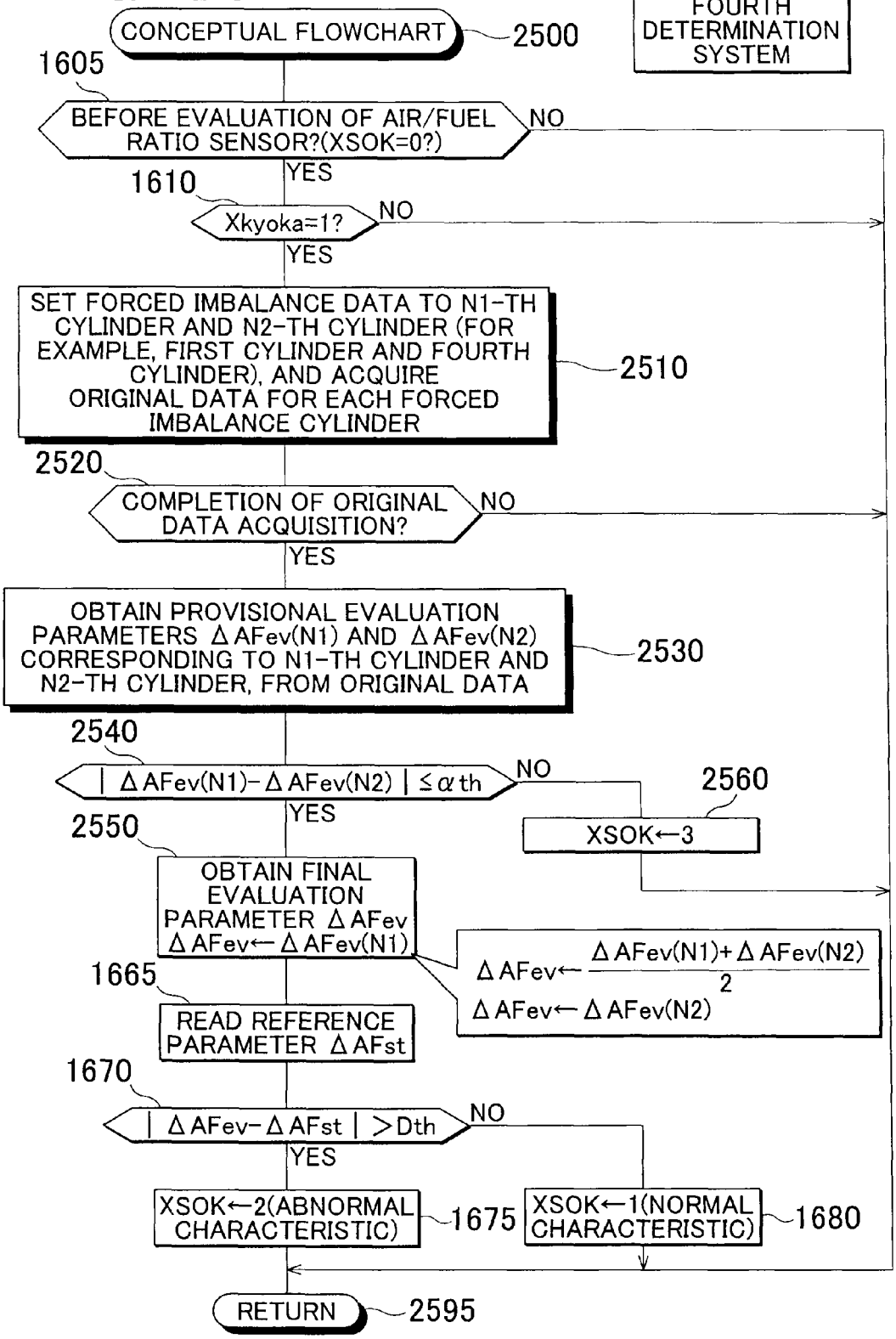
FIG. 25 is a flowchart illustrating a routine executed by CPU of a cylinder-to-cylinder air/fuel ratio imbalance determination system (fourth determination system) according to a fourth embodiment of the invention.

The CPU of the fourth determination system makes an A/F imbalance determination by executing the routine as illustrated in FIG. 18. Furthermore, the CPU of the fourth determination system evaluates the output characteristics of the air/fuel ratio sensor 55 by executing a routine as illustrated in the flowchart of FIG. 25. More specifically described, the CPU starts the routine of FIG. 25 from step 2500 when the time for execution of the routine is reached, and proceeds to step 1605 to determine whether the value of the sensor adequacy determination termination flag XSOK is "0", thereby to determine whether "the adequacy of the air/fuel ratio sensor 55 has not been determined". If the sensor adequacy determination termination flag XSOK has a value other than "0" at this time (namely, if a sensor adequacy determination has been made), the CPU directly proceeds to step 2595 to complete the current cycle of the routine.

If the value of the sensor adequacy determination termination flag XSOK is "0", the CPU makes an affirmative decision (YES) in step 1605, and proceeds to step 1610 to determine whether the value of the determination permission flag Xkyoka is "1". If the value of the determination permission flag Xkyoka is not equal to "1" at this time, the CPU makes a negative decision (NO) in step 1610, and directly proceeds to step 2595 to complete the current cycle of the routine.

If, on the other hand, the value of the determination permission flag Xkyoka is "1", the CPU makes an affirmative decision (YES) in step 1610, and proceeds to step 2510 to initially set the forced imbalance cylinder to the N1-*th* cylinder (the first cylinder in this embodiment), acquires an absolute value of a detected air/fuel ratio change rate ΔAF (original data for a provisional evaluation parameter) each time a given time elapses, and stores the absolute values while associating each of the absolute values with the N1-*th* cylinder and the order of acquisition of the absolute value. Namely, if the absolute value is obtained as the Cn-th piece of data as counted from the time at which the N1-*th* cylinder is set as the forced imbalance cylinder, the absolute value is stored as original data ΔAF(N1, Cn) (=ΔAF(1, Cn)).

When the number of pieces of the original data ΔAF(N1, Cn) obtained reaches a given threshold value Cnth, the CPU sets the forced imbalance cylinder to the N2-*th* cylinder (the fourth cylinder in this embodiment), acquires an absolute value of a detected air/fuel ratio change rate ΔAF (original data for a provisional evaluation parameter) each time a given time elapses, and stores the absolute values while associating each of the absolute values with the N2-*th* cylinder and the order of acquisition of the absolute value. Namely, if the absolute value is obtained as the Cn-th piece of data as counted from the time at which the N2-*th* cylinder is set as the forced imbalance cylinder, the absolute value is stored as original data ΔAF(N2, Cn) (=ΔAF(4, Cn)). When the number of pieces of the original data ΔAF(N2, Cn) obtained reaches the threshold value Cnth, the CPU proceeds to step 2520. In this connection, the CPU sets the correction amount (the above-indicated value α) of the amount of fuel injected into the forced imbalance cylinder to a fixed or constant value (the above-indicated value αp or αm), no matter which cylinder is set as the forced imbalance cylinder.

Then, in step 2520, the CPU confirms that the number of pieces of the original data ΔAF(N1, i) obtained with respect to the N1-*th* cylinder is equal to the threshold value Cnth, and the number of pieces of the original data ΔAF(N2, i) obtained with respect to the N2-*th* cylinder is equal to the threshold value Cnth, and proceeds to step 2530.

In step 2530, the CPU obtains the average value of the plural pieces of the original data ΔAF(N1, i) for the N1-*th* cylinder as "a provisional evaluation parameter ΔAFev(N1) for the N1-*th* cylinder", and obtains the average value of the plural pieces of the original data ΔAF(N2, i) for the N2-*th* cylinder as "a provisional evaluation parameter ΔAFev(N2) for the N2-*th* cylinder".

Then, the CPU proceeds to step 2540 to determine whether the absolute value |ΔAFev(N1)−ΔAFev(N2)| of a difference between the provisional evaluation parameter ΔAFev(N1) for the N1-*th* cylinder and the provisional evaluation parameter ΔAFev(N2) for the N2-*th* cylinder is smaller than a threshold value αth, thereby to determine whether the provisional evaluation parameter ΔAFev(N1) and the provisional evaluation parameter ΔAFev(N2) are substantially equal to each other.

If the absolute value ΔAFev(N1)−ΔAFev(N2)| is smaller than the threshold value αth at this time, it is determined that "the air/fuel ratio of the air-fuel mixture supplied to the N1-*th* cylinder and the air/fuel ratio of the air-fuel mixture supplied to the N2-*th* cylinder are substantially equal to each other" in a condition where no forced imbalance condition is created. Therefore, the CPU makes an affirmative decision (YES) in step 2540, and proceeds to step 2550 to adopt the provisional evaluation parameter ΔAFev(N1) as "a final parameter (final evaluation parameter) for use in evaluation of the air/fuel ratio sensor 55".

In step 2550, the CPU may adopt the provisional evaluation parameter ΔAFev(N2) as the final evaluation parameter ΔAFev, or may adopt "the average value of the provisional evaluation parameter ΔAFev(N1) and the provisional evaluation parameter ΔAFev(N2)" as the final evaluation parameter ΔAFev.

Then, the CPU reads the reference parameter ΔAFst from the ROM as described above in step 1665, and proceeds to step 1670 and subsequent steps to make a determination (sensor adequacy determination) as to whether the output characteristics of the air/fuel ratio sensor 55 are adequate for making an A/F imbalance determination, depending on whether "the absolute value D of the difference between the final evaluation parameter ΔAFev and the reference parameter ΔAFst" is larger than the threshold value Dth.

Then, if it is determined that the output characteristics of the air/fuel ratio sensor 55 are adequate for making an A/F imbalance condition, the CPU sets the value of the sensor adequacy determination termination flag XSOK to "1" in step 1680. As a result, the CPU makes an affirmative decision (YES) in step 1802 of FIG. 18, and makes an A/F imbalance determination.

On the other hand, if it is determined that the output characteristics of the air/fuel ratio sensor 55 are not adequate for making an A/F imbalance condition, the CPU sets the value of the sensor adequacy determination termination flag XSOK to "2" in step 1675. As a result, the CPU makes a negative decision (NO) in step 1802 of FIG. 18, and does not make an A/F imbalance determination.

If the absolute value |ΔAFev(N1)−ΔAFev(N2)| of the above-mentioned difference is larger than the threshold value αth at the time when the CPU executes step 2540, it is determined that "the air/fuel ratio of the air-fuel mixture supplied to the N1-*th* cylinder is different from the air/fuel ratio of the air-fuel mixture supplied to the N2-*th* cylinder) in a condition where no forced imbalance condition is created. Namely, it can be determined that either of the N1-*th* cylinder and the N2-*th* cylinder is an inherent imbalance cylinder.

Thus, when the absolute value |ΔAFev(N1)−ΔAFev(N2)| of the above-mentioned difference is larger than the threshold value αth, the CPU makes a negative decision (NO) in step 2540, and proceeds to step 2560 to set the value of the sensor adequacy determination termination flag XSOK to "3". Then, the CPU directly proceeds to step 2595 to complete the current cycle of the routine. In other words, the value "3" of the sensor adequacy determination termination flag XSOK indicates that the CPU made an attempt to determine the adequacy of the air/fuel ratio sensor 55, but aborted or cancelled the process of determining the sensor adequacy.

In this case (where the value of the sensor adequacy determination termination flag XSOK is set to "3"), the CPU makes a negative decision (NO) in step 1802 of FIG. 18, and therefore, does not make an A/F imbalance determination. Namely, when the CPU determines that "the air/fuel ratio of the air-fuel mixture supplied to the N1-*th* cylinder and the air/fuel ratio of the air-fuel mixture supplied to the N2-*th* cylinder are different from each other", it is inhibited from making an A/F imbalance determination.

As explained above, the fourth determination system includes a forced imbalance condition creating device (see step 2510 of FIG. 25) which sets "a forced imbalance cylinder for which the amount of injected fuel is changed" so as to create a forced imbalance condition, to a first cylinder (N1-*th* cylinder) for a certain period of time, and then sets the forced imbalance cylinder to a second cylinder (N2-*th* cylinder) for a certain period of time. In the above-mentioned forced imbalance condition, the air/fuel ratio of an air-fuel mixture supplied to one of at least three cylinders provided in the engine 10 deviates by a certain value from the air/fuel ratio of air-fuel mixtures supplied to the other cylinders.

Furthermore, the fourth determination system includes an evaluation parameter obtaining device that is configured to obtain the air/fuel ratio sensor evaluation parameter during a first forced imbalance period in which the forced imbalance cylinder is set to the first cylinder, as a first provisional evaluation parameter (ΔAFev(N1)), and obtains the air/fuel ratio sensor evaluation parameter during a second forced imbalance period in which the forced imbalance cylinder is set to the second cylinder, as a second provisional evaluation parameter (ΔAFev(N2)) (see step 2510 and step 2530 of FIG. 25). If the absolute value of a difference between the first provisional evaluation parameter ΔAFev(N1) and the second provisional evaluation parameter ΔAFev(N2) is equal to or smaller than a given threshold value αth, the evaluation parameter obtaining device obtains a parameter corresponding to at least one of the first provisional evaluation parameter ΔAFev(N1) and the second provisional evaluation parameter ΔAFev(N2) as a final air/fuel ratio sensor evaluation parameter ΔAFev used when making a sensor adequacy determination (see step 2540 and step 2550 of FIG. 25). If the absolute value of the difference between the first provisional evaluation parameter ΔAFev(N1) and the second provisional evaluation parameter ΔAFev(N2) is larger than the given threshold value αth, the evaluation parameter obtaining device inhibits the air/fuel ratio sensor evaluation device from making a sensor adequacy determination (see step 2540 and step 2560 of FIG. 25).

When the value of the sensor adequacy determination termination flag XSOK is set to "3" in step 2560 of FIG. 25, the fourth determination system may be configured to execute step 2550 and step 1665 through step 1680 of FIG. 25, but maintain the value of the sensor adequacy determination termination flag XSOK at "3" irrespective of the result of determination in step 1670, so as to make the result of the sensor adequacy determination invalid.

With the above arrangement, only when both of the first provisional evaluation parameter and the second provisional evaluation parameter represent "the output characteristics of the air/fuel ratio sensor" with high accuracy, without being influenced by an inherent A/F imbalance condition, a sensor adequacy determination is made based on the final evaluation parameter that is obtained based on at least one of the first provisional evaluation parameter and the second provisional evaluation parameter. Consequently, the air/fuel ratio sensor 55, when it is normal, is prevented from being erroneously determined as "an inadequate air/fuel ratio sensor".

Next, a cylinder-to-cylinder air/fuel ratio (A/F) imbalance determination system (which will be simply called "fifth determination system") according to a fifth embodiment of the invention will be described. The fifth determination system sequentially changes the forced imbalance cylinder when it obtains a parameter for use in evaluation of the air/fuel ratio sensor 55. Namely, the fifth determination system sequentially sets each of all of the cylinders from which exhaust gases reach the air/fuel ratio sensor 55, as the forced imbalance cylinder. Furthermore, the fifth determination system obtains a provisional evaluation parameter with respect to each of the forced imbalance cylinders, in the same manner as in the fourth determination system.

Then, the fifth determination system compares the provisional evaluation parameters for the respective cylinders with one another, and selects two provisional evaluation parameters that are closest to each other, from those parameters. This is based on the fact that a provisional evaluation parameter obtained when an inherent imbalance cylinder is set as the forced imbalance cylinder is different from a provisional evaluation parameter obtained when an inherent non-imbalance (or normal) cylinder is set as the forced imbalance cylinder. In other words, since two or more cylinders cannot practically become imbalance cylinders at the same time (or any of the cylinders is detected first as an imbalance cylinder), two cylinders for which the closest two provisional evaluation parameters are obtained can be both determined as normal (non-imbalance) cylinders, and therefore, the provisional evaluation parameters for the two cylinders represent the output characteristics of the air/fuel ratio sensor 55 with high accuracy.

Furthermore, the fifth determination system obtains a final evaluation parameter using the selected "two provisional evaluation parameters ΔAFev that are closest to each other". For example, the final evaluation parameter may be one of the "two provisional evaluation parameters ΔAFev that are closest to each other", or may be the average value of the "two provisional evaluation parameters ΔAFev that are closest to each other". Then, the fifth determination system compares the thus obtained final evaluation parameter with a reference parameter, and determines whether the output characteristics of the air/fuel ratio sensor 55 are adequate for making an A/F imbalance determination.

Figure 26:
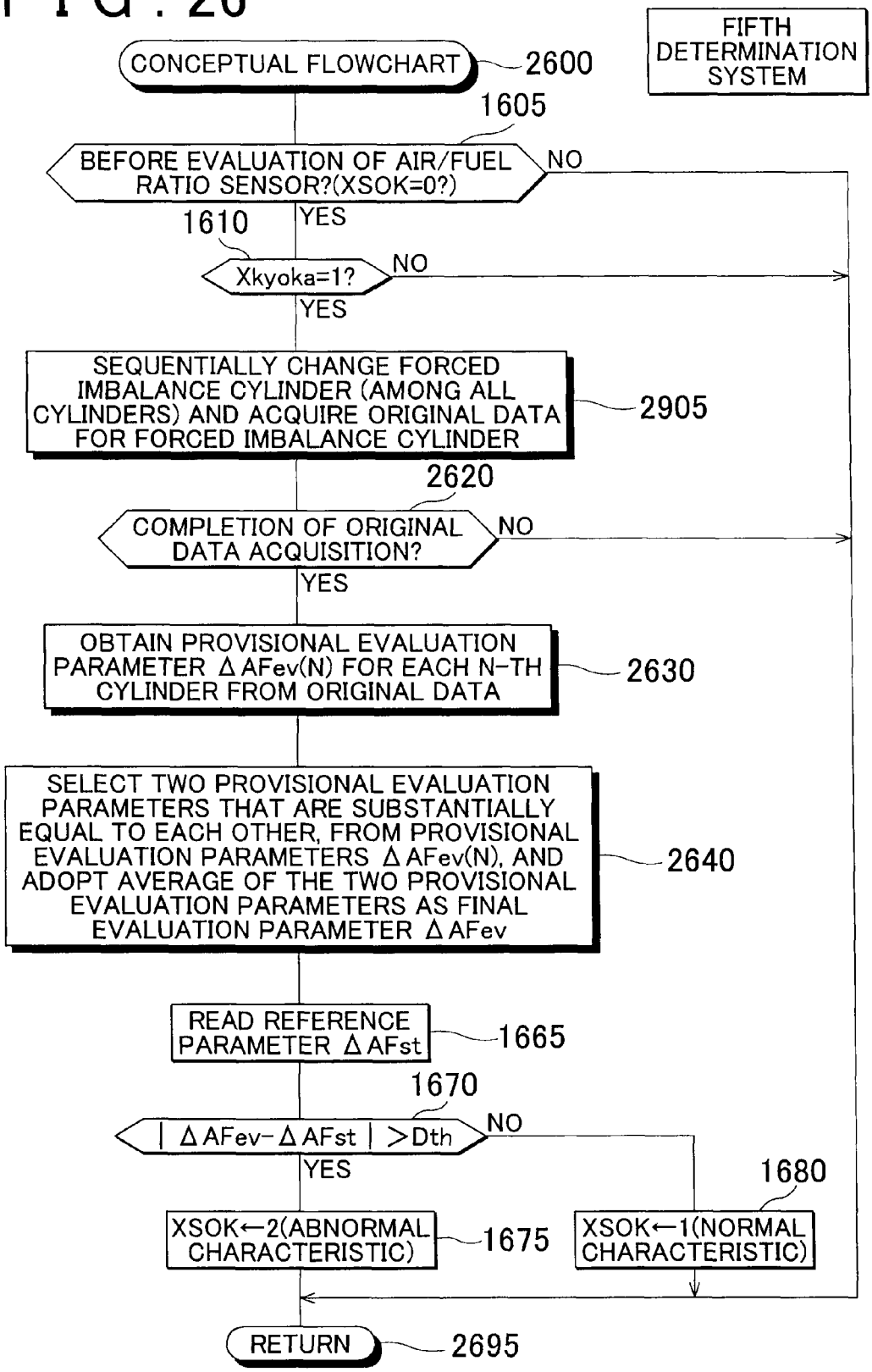
FIG. 26 is a flowchart illustrating a routine executed by CPU of a cylinder-to-cylinder air/fuel ratio imbalance determination system (fifth determination system) according to a fifth embodiment of the invention.

The CPU of the fifth determination system is different from the CPU of the fourth determination system only in that the output characteristics of the air/fuel ratio sensor 55 are evaluated by executing a routine as illustrated in the flowchart of FIG. 26. More specifically described, the CPU of the fifth determination system starts the routine of FIG. 26 from step 2600 at an appropriate time, and proceeds to step 1605 to determine whether the value of the sensor adequacy determination termination flag XSOK is "0", thereby to determine whether "a determination on the adequacy of the air/fuel ratio sensor 55 has not been made". If the sensor adequacy determination termination flag XSOK has a value other than "0" at this time (namely, if a sensor adequacy determination has been made), the CPU directly proceeds to step 2695 to complete the current cycle of the routine.

If the value of the sensor adequacy determination termination flag XSOK is "0", the CPU makes an affirmative decision (YES) in step 1605, and proceeds to step 1610 to determine whether the value of the determination permission flag Xkyoka is "1". If the value of the determination permission flag Xkyoka is not "1" at this time, the CPU makes a negative decision (NO) in step 1610, and directly proceeds to step 2695 to complete the current cycle of the routine.

If, on the other hand, the value of the determination permission flag Xkyoka is "1", the CPU makes an affirmative decision (YES) in step 1610, and initially sets the forced imbalance cylinder to the first cylinder for a set period of time, acquires an absolute value of a detected air/fuel ratio change rate ΔAF (original data for obtaining a provisional evaluation parameter) each time a given sampling time elapses, and stores the absolute values while associating each of the absolute values with the first cylinder and the order of acquisition of the absolute value. Namely, if the absolute value is the C(N)-th piece of data as counted from the time at which the first cylinder is set as the forced imbalance cylinder, the absolute value is stored as original data ΔAF(1, C(N)).

If the number of pieces of the original data ΔAF(1, C(N)) thus obtained reaches a threshold value C(N)th, the CPU sets the forced imbalance cylinder to the second cylinder for the set period of time, and stores the absolute value of the detected air/fuel ratio change rate ΔAF obtained each time a given time elapses as original data ΔAF(2, C(N)). Then, if the number of pieces of the original data ΔAF(2, C(N) thus obtained reaches the threshold value C(N)th, the CPU sets the forced imbalance cylinder to the third cylinder for the set period of time, and stores the absolute value of the detected air/fuel ratio change rate ΔAF obtained each time a given time elapses as original data ΔAF(3, C(N)).

Then, if the number of pieces of the original data ΔAF(3, C(N)) thus obtained reaches the threshold value C(N)th, the CPU sets the forced imbalance cylinder to the fourth cylinder for the set period of time, and stores the absolute value of the detected air/fuel ratio change rate ΔAF obtained each time a given time elapses as original data ΔAF(4, C(N)). The order in which the four cylinders are set as the forced imbalance cylinder may be determined as desired (for example, in the firing or ignition order of the engine, which is 1-3-4-2). The set period of time in which the N-th cylinder (N=1, 2, 3, 4) is set as the forced imbalance cylinder will also be called "N-th forced imbalance period".

Namely, the CPU increases value "N" from "1" by "1" each time the set period of time expires, and sets the N-th cylinder as the forced imbalance cylinder over "the set N-th forced imbalance period", while setting the cylinders other than the N-th cylinder as non-forced-imbalance cylinders. Then, the CPU acquires absolute values of a plurality of detected air/fuel ratio change rates ΔAF over the N-th forced imbalance period. No matter which cylinder is currently set as the forced imbalance cylinder, the CPU sets the correction amount (the above-indicated value α) of the amount of fuel injected into the forced imbalance cylinder to a fixed value (the above-indicated value αp or αm).

Then, the CPU proceeds to step 2620 to confirm that the number of pieces of original data ΔAF(N, i) is equal to the threshold value C(N)th with respect to all of the N-th cylinders (N=1, 2, 3, 4), and proceeds to step 2630.

In step 2630, the CPU obtains the average value of the plural pieces of original data ΔAF(N, i) obtained with respect to each of the N-th cylinders (N=1, 2, 3, 4) as "a provisional evaluation parameter ΔAFev(N) for the N-th cylinder". Namely, the CPU calculates the average value of the absolute values of the detected air/fuel ratio change rates ΔAF obtained over the N-th forced imbalance period, as a provisional evaluation parameter ΔAFev(N) for the N-th cylinder. In this manner, a provisional evaluation parameter ΔAFev(1) for the first cylinder, provisional evaluation parameter ΔAFev (2) for the second cylinder, provisional evaluation parameter ΔAFev(3) for the third cylinder, and a provisional evaluation parameter ΔAFev(4) for the fourth cylinder are obtained.

Then, the CPU proceeds to step 2640 to select two parameters (ΔAF(M1), ΔAF(M2) where M1, M2 are different natural numbers selected from 1-4) whose values are closest to each other, from the provisional evaluation parameters ΔAFev(N). Then, the CPU adopts the average value (=(ΔAF (M1)+ΔAF(M2))/2) of the two provisional evaluation parameters as a final evaluation parameter ΔAFev. Alternatively, the CPU may adopt one of the selected two provisional evaluation parameters (e.g., the larger one or the smaller one) as the final evaluation parameter ΔAFev.

Then, the CPU proceeds to step 1665, and reads a reference parameter ΔAFst from the ROM. If "the absolute value D of a difference between the final evaluation parameter ΔAFev and the reference parameter ΔAFst" is larger than "a given threshold value Dth for evaluation", the CPU proceeds from step 1670 to step 1675, and sets the value of the sensor adequacy determination termination flag XSOK to "2". On the other hand, if the absolute value D is equal to or smaller than the threshold value Dth, the CPU proceeds from step 1670 to step 1680, and sets the value of the sensor adequacy determination termination flag XSOK to "1". The summary of the operation of the fifth determination system has been explained.

Figure 27:
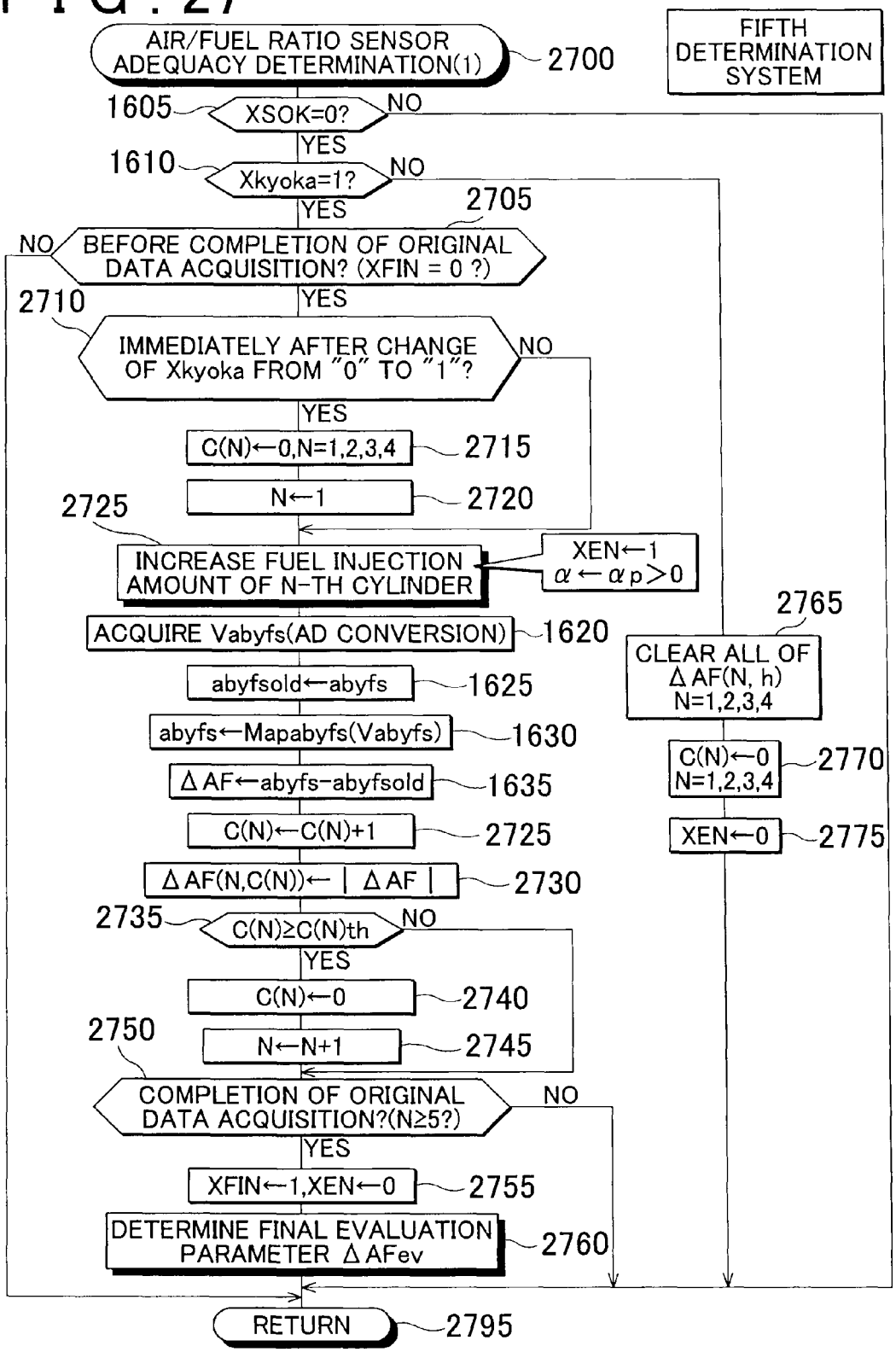
FIG. 27 is a flowchart illustrating a routine executed by CPU of the fifth determination system.

FIG. 27 illustrates a detailed routine of "air/fuel ratio sensor adequacy determination" which is executed by the CPU of the fifth determination system. A brief explanation of the routine will be provided. After the CPU confirms that the value of the sensor adequacy determination termination flag XSOK is "0" and the value of the determination permission flag Xkyoka is "1" in step 1605 and step 1610, the CPU determines in step 2705 "whether the acquisition of the original data has not been completed (a value of an original data acquisition completion flag XFIN is "0")". If the value of the original data acquisition completion flag XFIN is "1" at this time, the CPU directly proceeds to step 2795 to complete the current cycle of the routine. The value of the original data acquisition completion flag XFIN is set to "0" in the above-described initial routine.

If the value of the original data acquisition completion flag is "0", the CPU executes step 2710 through step 2720 to set all of the values of counters C(N) (where N=1, 2, 3, 4) to "0" only when this point in time is immediately after the value of the determination permission flag Xkyoka changes from "0" to "1", and set the value "N" to "1".

Then, the CPU proceeds to step 2725 to perform an operation to increase the amount of fuel injected into the N-th cylinder as a particular cylinder, to be larger than that of fuel injected into the other cylinders. More specifically described, the CPU sets the value of the forced imbalance condition flag XEN to "1", and sets the value "α" to a predetermined positive value αp (e.g., 0.45). As a result, the fuel injection amount of the N-th cylinder is increased by an amount corresponding to the value α, as compared with the fuel injection amount of the other cylinders (see step 1410-step 1440 of FIG. 14).

Then, the CPU executes step 1620 through step 1635 so as to obtain a detected air/fuel ratio change rate ΔAF. Then, the CPU proceeds to step 2725 to increase the value of the N-th cylinder counter C(N) by "1". If it is immediately after step 2715 and step 2720 are executed, the N-th cylinder counter C(N) is the first cylinder counter C(1), and its value becomes "1".

Then, the CPU proceeds to step 2730 to store the absolute value (|ΔAF|) of the detected air/fuel ratio change rate ΔAF obtained in step 1635, as "the C(N)-th piece of original data ΔAF(N, C(N)) for the N-th cylinder". For example, if the current "N" value is "1", and the value of the N-th cylinder counter C(N) is "1", the absolute value (|ΔAF|) of the detected air/fuel ratio change rate ΔAF obtained in step 1635 is stored as the first piece of original data ΔAF(1, 1) for the first cylinder".

Then, the CPU proceeds to step 2735 to determine whether the N-th cylinder counter C(N) is equal to or larger than a threshold value C(N)th. If the N-th cylinder counter C(N) is smaller than the threshold value C(N)th, the CPU directly proceeds to step 2750. If, on the other hand, the N-th cylinder counter C(N) is equal to or larger than the threshold value C(N)th, the CPU proceeds from step 2735 to step 2740 to set the value of the N-th cylinder counter C(N) to "0", and increases the value "N" by "1" in step 2745. Then, the CPU proceeds to step 2750. Step 2735 is a step for determining whether a sufficiently large number of pieces of data indicative of the absolute values |ΔAF| of the detected air/fuel ratio change rates ΔAF have been acquired when the N-th cylinder is set as the forced imbalance cylinder.

Then, the CPU proceeds to step 2750 to determine whether the value "N" is 5 or larger, thereby to determine whether the absolute values (original data) of the detected air/fuel ratio change rates ΔAF have been acquired with respect to all of the cylinders, each of which is set as the forced imbalance cylinder. If the acquisition of the original data has not been completed (N<5) at this time, the CPU directly proceeds from step 2750 to step 2795 to complete the current cycle of the routine.

In the subsequent cycles of the routine of FIG. 27, a cylinder that is different from the cylinder set as the forced imbalance cylinder in the previous cycle is set as the forced imbalance cylinder (for example, the second cylinder is set as the forced imbalance cylinder if the first cylinder was set as the forced imbalance cylinder in the last cycle), and original data for the newly set forced imbalance cylinder is stored.

On the other hand, if the value "N" reaches "5" at the time when the CPU executes 2750, the CPU proceeds from step 2750 to step 2755 to set the value of the original data acquisition completion flag XFIN to "1", and set the value of the forced imbalance condition flag XEN to "0". Then, the CPU proceeds to step 2760 to determine a final evaluation parameter ΔAFev in the same manner as in step 2640 of FIG. 26 as described above.

Namely, the CPU obtains the average value of ΔAF(N, C(N)) (where C(N) is a natural number from 1 to C(N)th) for each value "N" as a provisional evaluation parameter for the N-th cylinder, and selects two values that are closest to each other (two values having the smallest difference therebetween) from the provisional evaluation parameters obtained for all of the cylinders. The CPU adopts the average of the selected two values as the final evaluation parameter ΔAFev. Thereafter, the CPU proceeds to step 2795 to complete the current cycle of the routine.

If the value of the determination permission flag Xkyoka is "0" at the time when the CPU executes step 1610, the CPU executes step 2765 through step 2775. As a result, all of the original data ΔAF(N, natural number h), all of the N-th cylinder counters C(N), and the value of the forced imbalance condition flag XEN are set to "0".

Figure 28:
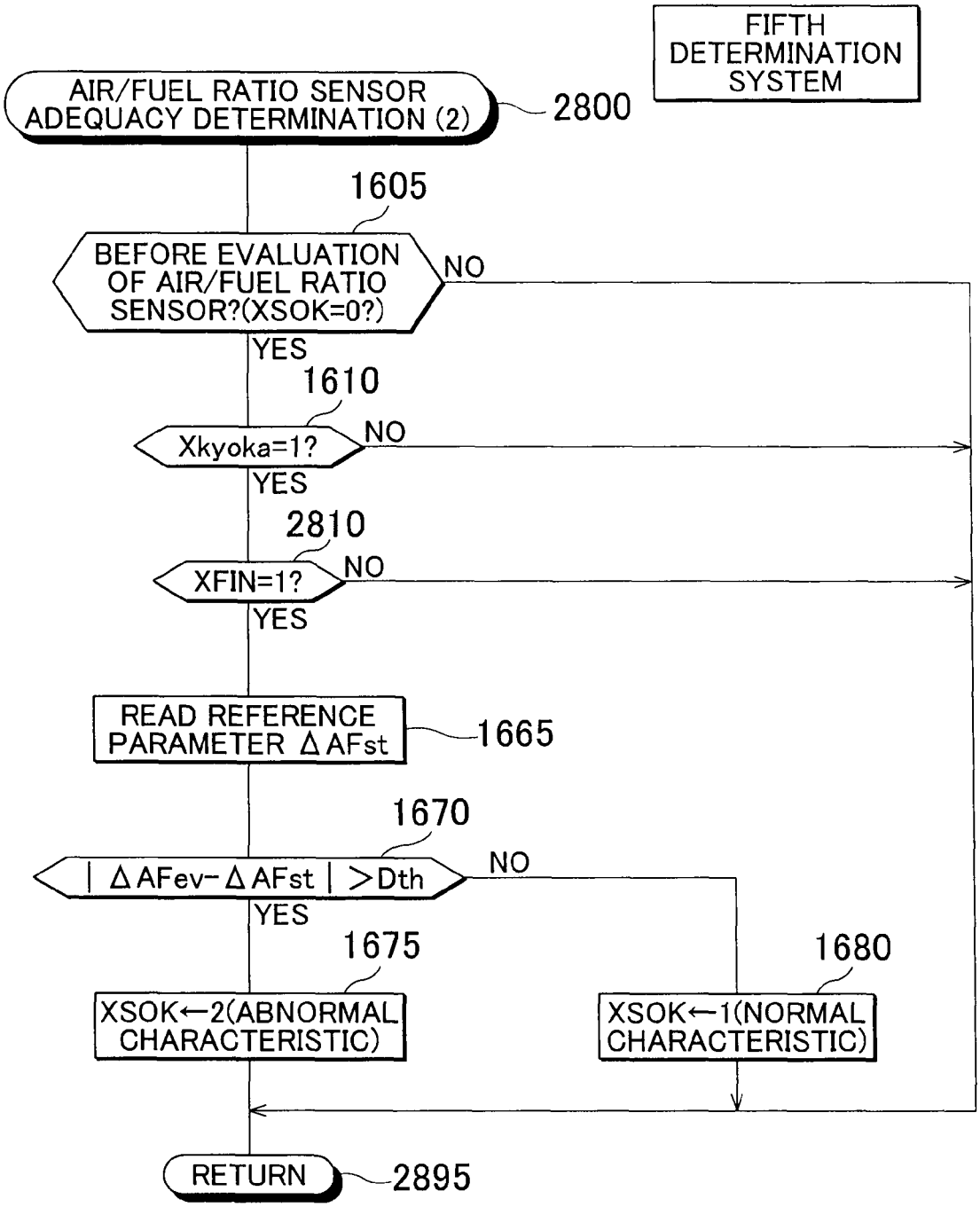
FIG. 28 is a flowchart illustrating a routine executed by CPU of the fifth determination system.

Furthermore, the CPU executes a routine as illustrated in FIG. 28 each time a given time elapses. Thus, the CPU starts the process from step 2800 of FIG. 28 when the time for execution of the routine is reached. If the CPU confirms that "the value of the sensor adequacy determination termination flag XSOK is "0", and the value of the determination permission flag Xkyoka is "1", while the value of the original data acquisition completion flag XFIN is "1"" in step 1605, step 1610 and step 2810, respectively, the CPU executes step 1665 and subsequent steps. Namely, the CPU determines whether the air/fuel ratio sensor 55 is "adequate for making a cylinder-to-cylinder A/F imbalance determination", based on the absolute value of the difference between the final evaluation parameter ΔAFev obtained in step 2760 of FIG. 27 and the reference parameter ΔAFst.

As explained above, the fifth determination system sequentially sets the forced imbalance cylinder to all of the cylinders from which exhaust gases reach the air/fuel ratio sensor 55, so as to obtain the provisional evaluation parameters corresponding to the respective forced imbalance cylinders, and obtains the final evaluation parameter ΔAFev based on two provisional evaluation parameters whose values are closest to each other. The thus obtained final evaluation parameter ΔAFev is less likely or unlikely to be influenced by an inherent imbalance cylinder, if any, and represents the output characteristics of the air/fuel ratio sensor 55 with high accuracy, thus making it possible to accurately determine the adequacy of the air/fuel ratio sensor. Consequently, an A/F imbalance determination can be made with high accuracy.

Next, a cylinder-to-cylinder air/fuel ratio (A/F) imbalance determination system (which will be simply called "sixth determination system") according to a sixth embodiment of the invention will be described. Like the fifth determination system, the sixth determination system sequentially changes the forced imbalance cylinder. Further, each time a given sampling time elapses, the sixth determination system acquires a detected air/fuel ratio change rate ΔAF while associating it with the N-th cylinder set as the forced imbalance cylinder, as original data ΔAF(N, C(N)).

Then, the sixth determination system terminates the forced imbalance condition when the original data for all of the cylinders has been obtained, and obtains a detected air/fuel ratio change rate ΔAF each time a given time elapses in a condition after termination of the forced imbalance condition. Furthermore, the sixth determination system detects and identifies a sign of imbalance, using the detected air/fuel ratio change rates ΔAF obtained in this condition.

The identification of a sign of imbalance includes making a determination as to whether the air/fuel ratio of an air-fuel mixture supplied to any one of the cylinders deviates by a certain degree or more from the air/fuel ratio of air-fuel mixtures supplied to the remaining cylinders. It is, however, to be noted that the case where it is determined that there is a sign of imbalance includes the case where a difference between the air/fuel ratio of the imbalance cylinder and the air/fuel ratio of the non-imbalance (normal) cylinders is not increased to such an extent that it should be determined that "there is a cylinder-to-cylinder air/fuel ratio (A/F) imbalance condition". Furthermore, when it is determined that there is a sign of imbalance, the identification of the sign of imbalance further includes making a determination as to whether the sign of imbalance is "a sign of shift-to-rich imbalance" or "a sign of shift-to-lean imbalance".

Thereafter, the sixth determination system determines a final evaluation parameter from the acquired original data ΔAF(N, C(N)), and the result of identification of the sign of imbalance. More specifically described, the sixth determination system, when it determines that there is no sign of imbalance, selects data having negative values from the original data ΔAF(N, C(N)), and adopts the average value of the selected values as the final evaluation parameter ΔAFev.

If, on one hand, the sixth determination system determines that there is a sign of shift-to-rich imbalance, the system selects "data having negative values from the original data ΔAF(N, C(N))" with respect to each N-th cylinder, obtains the absolute value X of the average value (or the average value of the absolute values) of the selected values with respect each N-th cylinder, and adopts the minimum value of the values X thus calculated for the respective cylinders, as the final evaluation parameter ΔAFev.

The air/fuel ratio of exhaust gas that reaches the air/fuel ratio sensor 55 when an imbalance cylinder that cause a shift-to-rich imbalance condition to occur in a condition where no forced imbalance condition is created is set as the forced rich imbalance cylinder has a tendency of being rapidly reduced, as compared with the air/fuel ratio of exhaust gas that reaches the air/fuel ratio sensor 55 when any of the other cylinders (non-imbalance cylinders, normal cylinders) is set as the forced imbalance cylinder. Accordingly, the absolute values of the negative values selected from the detected air/fuel ratio change rates ΔAF are large when the imbalance cylinder that causes a shift-to-rich imbalance condition to occur is set as the forced rich imbalance cylinder. Hence, the above-indicated minimum value of the values X, which is considered as a value that is least likely to be influenced by an inherent shift-to-rich imbalance condition, is a parameter that represents the output characteristics of the air/fuel ratio sensor 55 with high accuracy, and also a parameter suitable for evaluating the output characteristics of the air-fuel ratio sensor 55.

If, on the other hand, the sixth determination system determines that there is a sign of shift-to-lean imbalance, the system selects "data having negative values from the original data ΔAF(N, C(N))" with respect to each N-th cylinder, obtains the absolute value X of the average value (or the average value of the absolute values) of the selected values with respect to each N-th cylinder, and adopts the maximum value of the values X thus calculated for the respective cylinders, as the final evaluation parameter ΔAFev.

The air/fuel ratio of exhaust gas that reaches the air/fuel ratio sensor 55 when an imbalance cylinder that cause a shift-to-lean imbalance condition to occur in a condition where no forced imbalance condition is created is set as the forced rich imbalance cylinder has a tendency of being gently or slowly reduced, as compared with the air/fuel ratio of exhaust gas that reaches the air/fuel ratio sensor 55 when any of the other cylinders (non-imbalance cylinder, normal cylinders) is set as the forced imbalance cylinder. Accordingly, the absolute values of the negative values selected from the detected air/fuel ratio change rates ΔAF are small when the imbalance cylinder that causes a shift-to-lean imbalance condition to occur is set as the forced rich imbalance cylinder. Hence, the above-indicated maximum value of the values X, which is considered as a value that is least likely to be influenced by an inherent shift-to-lean imbalance condition, is a parameter that represents the output characteristics of the air/fuel ratio sensor 55 with high accuracy, and also a parameter suitable for evaluating the output characteristics of the air/fuel ratio sensor 55.

Like the other systems, the sixth determination system makes a determination as to whether the air/fuel ratio sensor 55 "is adequate for making a cylinder-to-cylinder A/F imbalance determination", based on the absolute value of a difference between the final evaluation parameter ΔAFev and the reference parameter ΔAFst.

Figure 29:
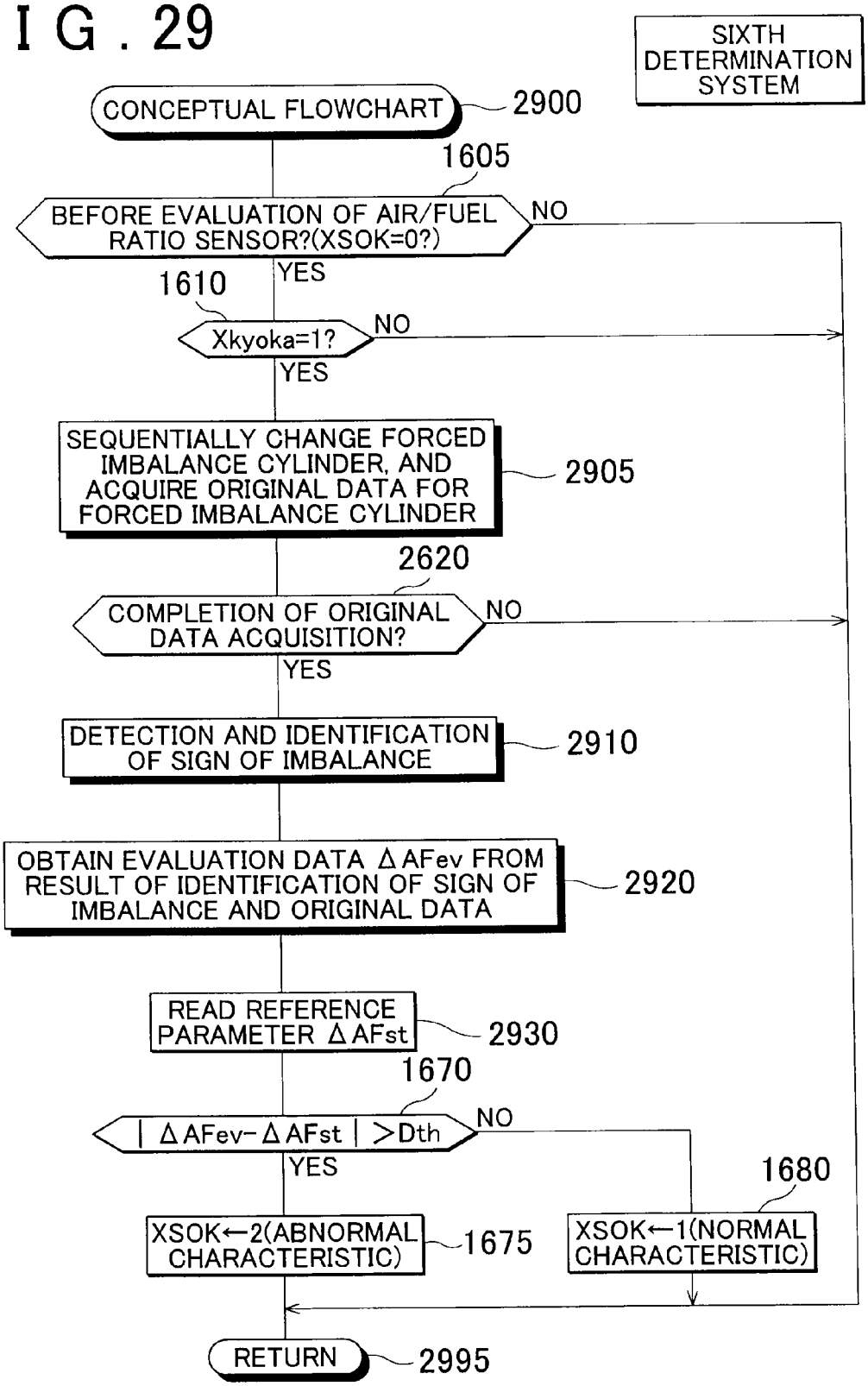
FIG. 29 is a flowchart illustrating a routine executed by CPU of a cylinder-to-cylinder air/fuel ratio imbalance determination system (sixth determination system) according to a sixth embodiment of the invention.

The CPU of the sixth determination system evaluates the output characteristics of the air/fuel ratio sensor 55 by executing a routine as illustrated in the flowchart of FIG. 29. More specifically described, the CPU starts the process from step 2900 at an appropriate time, and proceeds to step 1605 to determine whether the value of the sensor adequacy determination termination flag XSOK is "0", thereby to determine whether "a determination on the adequacy of the air/fuel ratio sensor 55 has not been made". If the sensor adequacy determination termination flag XSOK has a value (1 or 2) other than "0" at this time, the CPU directly proceeds to step 2995 to complete the current cycle of the routine.

If the value of the sensor adequacy determination termination flag XSOK is "0", the CPU makes an affirmative decision (YES) in step 1605, and proceeds to step 1610 to determine whether the value of the determination permission flag Xkyoka is "1". If the value of the determination permission flag Xkyoka is not "1", the CPU makes a negative decision (NO) in step 1610, and proceeds to step 2995 to complete the current cycle of the routine.

If, on the other hand, the value of the determination permission flag Xkyoka is "1", the CPU makes an affirmative decision (YES) in step 1610, and proceeds to step 2905 to sequentially change the forced imbalance cylinder, obtain detected air/fuel ratio change rates ΔAF for each forced imbalance cylinder, and store the change rates ΔAF as original data while associating them with each forced imbalance cylinder.

Then, the CPU determines in step 2620 whether a plurality of detected air/fuel ratio change rates ΔAF have been acquired with respect to each of all of the cylinders, which are sequentially set as the forced imbalance cylinder. If the acquisition of the original data has not been completed, the CPU directly proceeds to step 2995 to complete the current cycle of the routine.

On the other hand, if the acquisition of the original data is completed, the CPU makes an affirmative decision (YES) in step 2620, and proceeds to step 2910 to terminate the forced imbalance condition, and acquire a plurality of detected air/fuel ratio change rates ΔAF, so as to determine whether there is a sign of imbalance, based on the detected air/fuel ratio change rates ΔAF.

More specifically, if the detected air/fuel ratio change rate ΔAF varies in the manner as shown in FIG. 8A, namely, if the detected air/fuel ratio change rate ΔAF is generally constant, the CPU determines that there is no sign of imbalance. In this case, the CPU calculates the average value of the absolute values |ΔAF| of data having negative values, which are selected from the plurality of detected air/fuel ratio change rates (original data) ΔAF obtained when each of all of the cylinders is set as the forced imbalance cylinder, and adopts the average value as a final evaluation parameter ΔAFev.

If the detected air/fuel ratio change rate ΔAF varies in the manner as shown in FIG. 8B, namely, if the detected air/fuel ratio change rate ΔAF has a tendency of increasing relatively gently or slowly after decreasing relatively rapidly, the CPU determines that there is a sign of rich imbalance. In this case, the CPU calculates, for each cylinder, the average value of the absolute values of data having negative values, among the original data (detected air/fuel ratio change rates ΔAF) corresponding to each cylinder, and adopts the minimum value among the calculated average values for the respective cylinders, values as a final evaluation parameter ΔAFev.

On the other hand, if the detected air/fuel ratio change rate ΔAF varies in the manner as shown in FIG. 8C, namely, if the detected air/fuel ratio change rate ΔAF has a tendency of decreasing relatively gently or slowly after increasing relatively rapidly, the CPU determines that there is a sign of lean imbalance. In this case, the CPU calculates, for each cylinder, the average value of the absolute values of data having negative values, among the original data (detected air/fuel ratio change rates ΔAF) corresponding to each cylinder, and adopts the maximum value among the calculated average values for the respective cylinders, as a final evaluation parameter ΔAFev.

Then, the CPU proceeds to step 2930 and subsequent steps to determine the adequacy of the air/fuel ratio sensor 55 in the same manner as in the other embodiments. It is, however, to be noted that the reference parameter ΔAFst read in step 2930 is the average value of absolute values |ΔAF| of detected air/fuel ratio change rates ΔAF having negative values, which are selected from a plurality of detected air/fuel ratio change rates ΔAF obtained when the output characteristics of the air/fuel ratio sensor 55 are identical with those of the reference air/fuel ratio sensor, in the case where a forced imbalance condition is created in the engine in which there is no sign of imbalance.

In fact, the CPU of the sixth determination system executes the routine as illustrated in FIG. 27, like the CPU of the fifth determination system. In step 2730 of FIG. 27, however, the detected air/fuel ratio change rate ΔAF itself is obtained as original data ΔAF(N, C(N)). As a result, a plurality of detected air/fuel ratio change rates ΔAF(N, C(N)) for the case where the N-th cylinder is set as the forced imbalance cylinder are obtained as original data.

Figure 30:
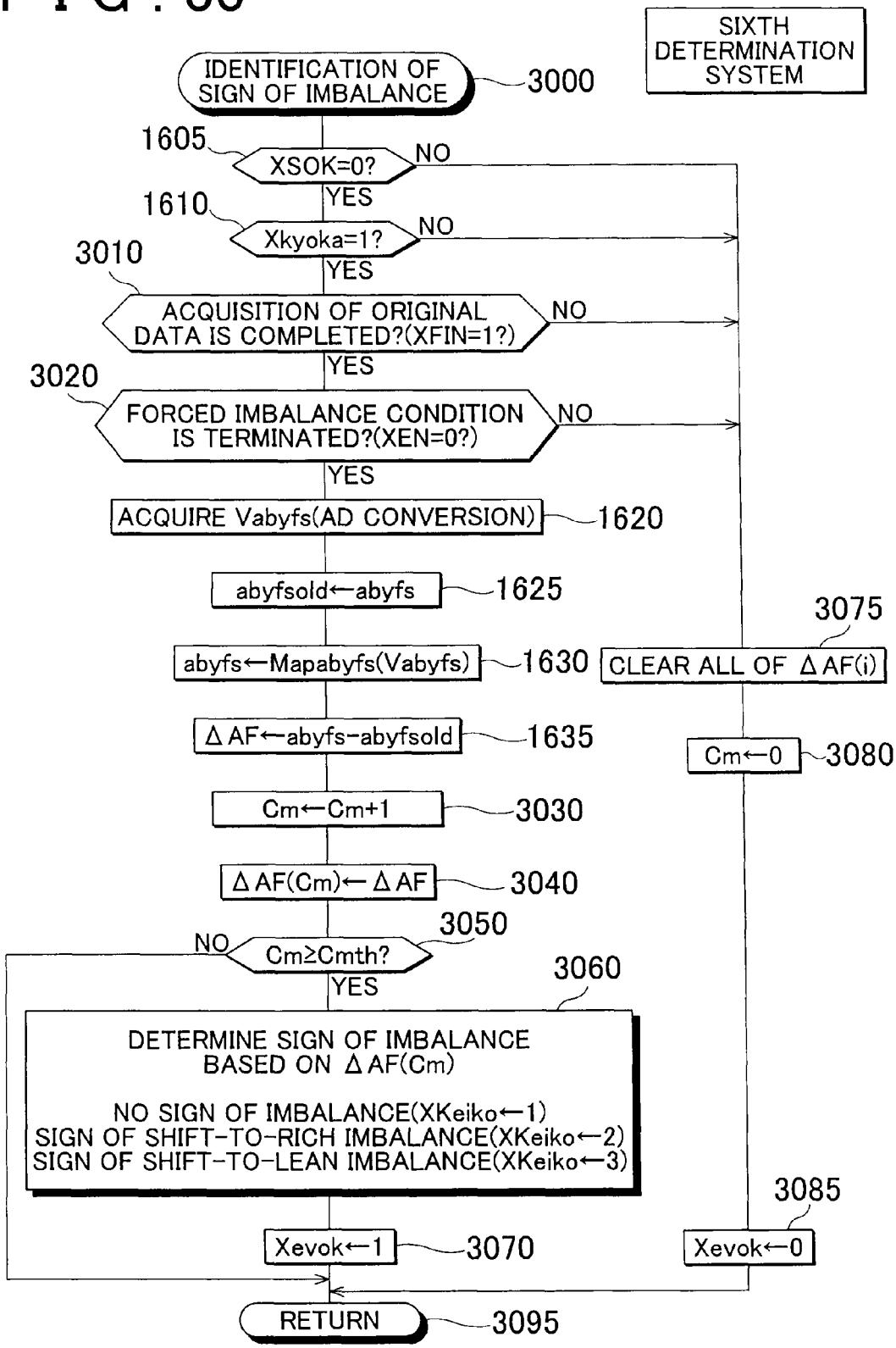
FIG. 30 is a flowchart illustrating a routine executed by CPU of the sixth determination system.

Furthermore, the CPU executes a routine as illustrated in FIG. 30 each time a given time elapses. A brief explanation of the routine will be provided. After the CPU confirms in step 1605 and step 1610 that the value of the sensor adequacy determination termination flag XSOK is "0", and the value of the determination permission flag Xkyoka is "1", the CPU determines in step 3010 "whether the acquisition of the original data is completed (whether the value of the original data acquisition completion flag XFIN is "1")".

If the value of the original data acquisition completion flag XFIN is "1" at the time when the CPU executes step 3010, the CPU makes an affirmative decision (YES) in step 3010, and proceeds to step 3020 to confirm that the value of the forced imbalance condition flag XEN is "0". If the forced imbalance condition flag XEN is "0", the CPU executes step 1620 through step 1635 to obtain a detected air/fuel ratio change rate ΔAF. Then, the CPU proceeds to step 3030 to increase the value of a counter Cm by "1".

Then, the CPU proceeds to step 3040 to store the detected air/fuel ratio change rate ΔAF obtained in step 1635 as "the Cm-th piece of original data ΔAF(Cm)". Thereafter, the CPU determines in step 3050 whether the value of the counter Cm is equal to or larger than a threshold value Cmth. The threshold value Cmth is set to a value equal to or larger than the number of the detected air/fuel ratio change rates ΔAF obtained when the engine goes through at least a plurality of unit combustion cycles.

If the value of the counter Cm is smaller than the threshold value Cmth at this time, the CPU makes a negative decision (NO) in step 3050, and directly proceeds to step 3095 to complete the current cycle of the routine. On the other hand, if the value of the counter Cm is equal to or larger than the threshold value Cmth, the CPU makes an affirmative decision (YES) in step 3050, and proceeds to step 3060 to determine (identify) a sign of imbalance, based on the plurality of detected air/fuel ratio change rates ΔAF(Cm) obtained in step 3040.

Namely, if the detected air/fuel ratio change rate ΔAF(Cm) is generally constant as shown in FIG. 8A, the CPU determines that there is no sign of imbalance, and sets the value of an imbalance sign flag Xkeiko to "1". More specifically, if the average value of the absolute values of the detected air/fuel ratio change rates ΔAF(Cm) is equal to or smaller than a predetermined value (imbalance sign identification value), the CPU determines that there is no sign of imbalance. In this connection, the imbalance sign flag Xkeiko is set to "0" in the above-described initial routine.

If, on one hand, the detected air/fuel ratio change rate ΔAF(Cm) varies as shown in FIG. 8B, namely, if the change rate ΔAF(Cm) increases relatively gently or slowly after decreasing relatively rapidly, the CPU determines that there is a sign of rich imbalance, and sets the value of the imbalance sign flag Xkeiko to "2". More specifically, the CPU determines that there is a sign of rich imbalance when the average value Fm of the absolute values of data having negative values among the detected air/fuel ratio change rates ΔAF(Cm) is larger than the average value Fp of the absolute values of data having positive values, and the average value Fm is equal to or larger than the imbalance sign identification value.

If, on the other hand, the detected air/fuel ratio change rate ΔAF(Cm) varies as shown in FIG. 8C, namely, if the change rate ΔAF(Cm) decreases relatively gently or slowly after increasing relatively rapidly, the CPU determines that there is a sign of lean imbalance, and sets the value of the imbalance sign flag Xkeiko to "3". More specifically, the CPU determines that there is a sign of lean imbalance when the average value Fm of the absolute values of data having negative values among the detected air/fuel ratio change rates ΔAF(Cm) is smaller than the average value Fp of the absolute values of data having positive values, and the average value Fp is equal to or larger than the imbalance sign identification value.

Thereafter, the CPU proceeds to step 3070 to set the value of an evaluation preparation completion flag Xevok to "1". The value of the evaluation preparation completion flag Xevok is set to "0" in the above-described initial routine.

When the CPU makes a negative decision (NO) in any of step 1605, step 1610, step 3010 and step 3020, the CPU executes step 3075 through step 3085, and proceeds to step 3095.

Step 3075: The CPU sets all of the detected air/fuel ratio change rates ΔAF(i) to "0". Step 3080: The CPU sets the value of the counter Cm to "0". Step 3085: The CPU sets the value of the evaluation preparation completion flag Xevok to "0".

Figure 31:
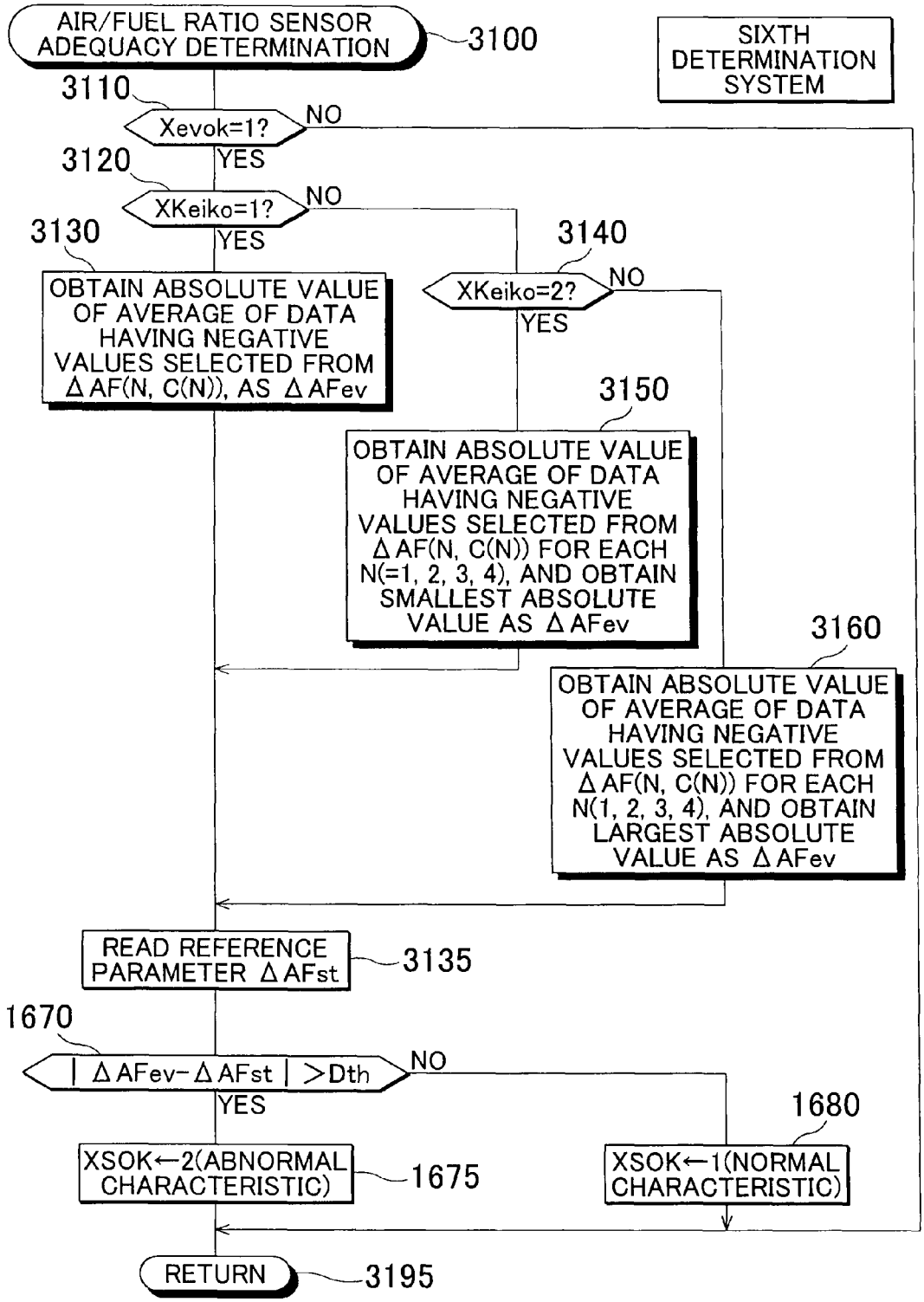
FIG. 31 is a flowchart illustrating a routine executed by CPU of the sixth determination system.

In addition, the CPU executes a routine as illustrated in the flowchart of FIG. 31 each time a given time elapses. When the time for execution of the routine of FIG. 31 is reached, the CPU starts the process from step 3100, and proceeds to step 3110 to determine whether the value of the evaluation preparation completion flag Xevok is "1". If the value of the evaluation preparation completion flag Xevk is "0", the CPU directly proceeds to step 3195 to complete the current cycle of the routine.

On the other hand, if the value of the evaluation preparation completion flag Xevok is "1", the CPU proceeds from step 3110 to step 3120, to determine whether the value of the imbalance sign flag Xkeiko is "1". If the imbalance sign flag Xkeiko is "1", the CPU proceeds from step 3120 to step 3130 to select data having negative values, from a plurality of pieces of original data ΔAF(N, C(N)) obtained in step 2730 of FIG. 27, and adopts the average value of the absolute values of the negative values (or the absolute value of the average value of the negative values), as a final evaluation parameter ΔAFev.

Thereafter, the CPU proceeds to step 3135 to read a reference parameter ΔAFst from the ROM. In this case, the reference parameter read in step 3135 is the average value of the absolute values (or the absolute value of the average value) of data having negative values, which are selected from a plurality of detected air/fuel ratio change rates ΔAF obtained based on the output values Vabyfs of the reference air/fuel ratio sensor when the reference air/fuel ratio sensor is mounted in place of the air/fuel ratio sensor 55 and the above-mentioned forced imbalance condition is created. Thereafter, the CPU proceeds to step 1670 and subsequent steps, to make a determination on the adequacy of the air/fuel ratio sensor 55 in the same manner as in the other embodiments.

If, on the other hand, the value of the imbalance sign flag Xkeiko is not "1" at the time when the CPU executes step 3120, the CPU proceeds from step 3120 to step 3140 to determine whether the value of the imbalance sign flag Xkeiko is "2".

If the value of the evaluation preparation completion flag Xevok is "2" at this time, the CPU proceeds from step 3140 to step 3150 to select "data having negative values from the original data ΔAF(N, C(N))" for each value "N" (i.e., for each cylinder), and obtains the average value AveΔAF(N) of the absolute values of the negative values as a provisional evaluation parameter for the N-th cylinder.

Namely, the CPU obtains the average value of the absolute values of data having negative values selected from the original data ΔAF(1, m) (m is a natural number from 1 to C(1)th), as the average value AveΔAF(1), and obtains the average value of the absolute values of data having negative values selected from the original data ΔAF(2, m) (m is a natural number from 1 to C(2)th), as the average value AveΔAF(2). Also, the CPU obtains the average value of the absolute values of data having negative values selected from the original data ΔAF(, m) (m is a natural number from 1 to C(3)th), as the average value AveΔAF(3), and obtains the average value of the absolute values of data having negative values selected from the original data ΔAF(4, m) (m is a natural number from 1 to C(4)th), as the average value AveΔAF(4).

Then, the CPU selects the minimum value among the average values thus obtained, and adopts the minimum value as a final evaluation parameter ΔAFev. Thereafter, the CPU proceeds to step 3135 and subsequent steps, to make a determination on the adequacy of the air/fuel ratio sensor 55.

If, on the other hand, the value of the imbalance sign flag Xkeiko is not "2" at the time when the CPU executes step 3140, the CPU proceeds from step 3140 to step 3160 to select "data having negative values from the original data ΔAF(N, C(N))" for each value "N" (i.e., for each cylinder), and obtain the average value AveΔAF(N) of the absolute values of the negative values, as a provisional evaluation parameter for the N-th cylinder.

Then, the CPU selects the maximum value among the average values thus obtained, and adopts the maximum value as a final evaluation parameter ΔAFev. Thereafter, the CPU proceeds to step 3135 and subsequent steps, to make a determination on the adequacy of the air/fuel ratio sensor 55.

As explained above, the sixth determination system detects and identifies a sign of imbalance when no forced imbalance condition is created. Then, "a parameter that is less likely or unlikely to be influenced by an inherent imbalance cylinder and most accurately represents the output characteristics of the air/fuel ratio sensor 55" is selected as the final evaluation parameter ΔAFev, based on the result of the identification of a sign of imbalance, and the provisional evaluation parameters obtained when the cylinders are sequentially set as the forced imbalance cylinder. Accordingly, the adequacy of the air/fuel ratio sensor can be determined with high accuracy. Consequently, an A/F imbalance condition can be determined with high accuracy.

The sixth determination system may select "data having positive values from the original data ΔAF(N, C(N))" for each N-th cylinder, and obtain the absolute value Y of the average value of the positive values, as a provisional evaluation parameter for each N-th cylinder, so as to determine a final evaluation parameter based on the provisional evaluation parameters for the respective cylinders and a sign of imbalance.

Namely, when the CPU determines that there is no sign of imbalance, the CPU selects data having positive values from a plurality of pieces of original data ΔAF(N, C(N)), and adopts the average value of the absolute values thereof (or the absolute value of the average value thereof), as a final evaluation parameter ΔAFev.

Also, when the CPU determines that there is a sign of rich imbalance, the CPU selects "data having positive values from the original data ΔAF(N, C(N))" for each value "N" (i.e., for each cylinder), and obtains the average value AveΔAF(N) of the absolute values of the positive values, as a provisional evaluation parameter for the N-th cylinder. Then, the CPU selects the minimum value from the average values, and adopts the minimum value as a final evaluation parameter ΔAFev.

Further, when the CPU determines that there is a sign of lean imbalance, the CPU selects "data having positive values from the original data ΔAF(N, C(N))" for each value "N" (i.e., for each cylinder), and obtains the average value AveΔAF(N) of the absolute values of the positive values, as a provisional evaluation parameter for the N-th cylinder. Then, the CPU selects the maximum value from the average values, and adopts the maximum value as a final evaluation parameter ΔAFev.

When it is determined that there is a sign of rich imbalance or there is a sign of lean imbalance, the CPU of the sixth determination system may select "data having either of positive values and negative values from the original data ΔAF(N, C(N))" for each value "N", obtain the average value of the absolute values of the positive or negative values for each cylinder, and adopt a value other than the maximum value and the minimum value, which is selected from the thus obtained average values, as a final evaluation parameter ΔAFev.

Next, a cylinder-to-cylinder air/fuel ratio (A/F) imbalance determination system (which will be simply called "seventh determination system") according to a seventh embodiment of the invention will be described. The seventh determination system corrects an output characteristic (e.g., the output value Vabyfs, detected air/fuel ratio change rate ΔAF, provisional evaluation parameters, final evaluation parameter, etc.) of the air/fuel ratio sensor 55 so that the output characteristic of the air/fuel ratio sensor 55 coincides with the output characteristic of the reference air/fuel ratio sensor, and makes a cylinder-to-cylinder A/F imbalance determination, using a final evaluation parameter obtained based on the corrected output characteristic.

Figure 32:
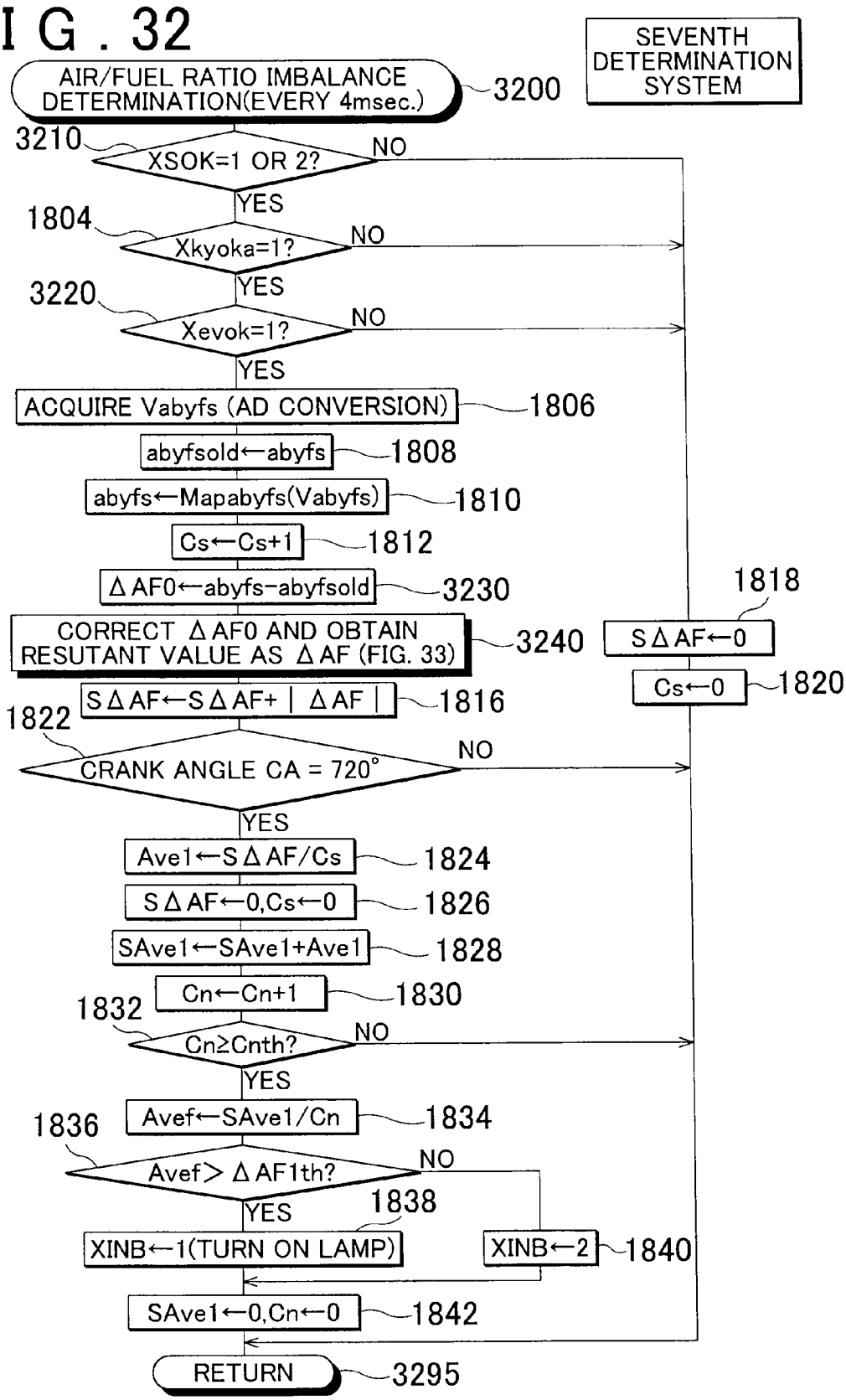
FIG. 32 is a flowchart illustrating a routine executed by CPU of a cylinder-to-cylinder air/fuel ratio imbalance determination system (seventh determination system) according to a seventh embodiment of the invention.

More specifically described, the seventh determination system makes a determination on the adequacy of the air/fuel ratio sensor 55 and makes a cylinder-to-cylinder A/F imbalance determination, by implementing the routine of FIG. 27 from which step 2760 is excluded, the routine of FIG. 30 and a routine of FIG. 32 (and FIG. 33), each of which is executed each time a given time elapses. It is, however, to be noted that, in step 2730 of FIG. 27, the CPU obtains the detected air-fuel ratio change rate ΔAF itself (rather than the absolute value thereof) as original data Δ AF(N, C(N)).

The routines of FIG. 27 and FIG. 30 have been explained above. Therefore, the routine of FIG. 32 will now be described. When the time for execution of the routine of FIG. 32 is reached, the CPU starts the process from step 3200, and proceeds to step 3210 to determine whether the value of the sensor adequacy determination termination flag XSOK is "1" or "2". Namely, the CPU determines whether the adequacy of the output characteristics of the air/fuel ratio sensor 55 has been determined. If the value of the sensor adequacy determination termination flag XSOK is "0", the CPU directly proceeds from step 3210 to step 3295 via step 1818 and step 1820 to complete the current cycle of the routine. If, on the other hand, the value of the sensor adequacy determination termination flag XSOK is "1" or "2", the CPU proceeds from step 3210 to step 1804. The CPU may determine in step 3210 whether the value of the sensor adequacy determination termination flag XSOK is "1". In this case, if the value of the sensor adequacy determination termination flag XSOK is "2", the process of making an A/F imbalance determination as described below is not carried out.

The CPU determines in step 1804 whether the value of the determination permission flag Xkyoka is "1". If the value of the determination permission flag Xkyoka is "0" at this time, the CPU directly proceeds from step 1804 to step 3295 via step 1818 and step 1820 to complete the current cycle of the routine. If the value of the determination permission flag Xkyoka is "1", on the other hand, the CPU proceeds from step 1804 to step 3220.

The CPU determines in step 3220 whether the value of the evaluation preparation completion flag Xevok is "1". If the value of the evaluation preparation completion flag Xevok is "0" at this time, the CPU directly proceeds from step 3220 to step 3295 via step 1818 and step 1820 to complete the current cycle of the routine. If the value of the evaluation preparation completion flag Xevok is "1", on the other hand, the CPU makes an affirmative decision "YES" in step 3220, and executes step 1806 through step 1812. As a result, the detected air/fuel ratio abyfs of this cycle and the detected air/fuel ratio abyfsold of the last cycle are acquired, and the value of a counter Cs is increased by "1". The value of the counter Cs is set to "0" in the above-described initial routine.

Then, the CPU proceeds to step 3230 to obtain a provisional detected air/fuel ratio change ratio ΔAF0 by subtracting the detected air/fuel ratio abyfsold of the last cycle from the detected air/fuel ratio abyfs of this cycle. Thereafter, the CPU proceeds to step 3240 to correct the provisional detected air/fuel ratio change rate ΔAF0, and adopt the corrected provisional detected air/fuel ratio change rate ΔAF0 as a detected air/fuel ratio change rate ΔAF.

Figure 33:
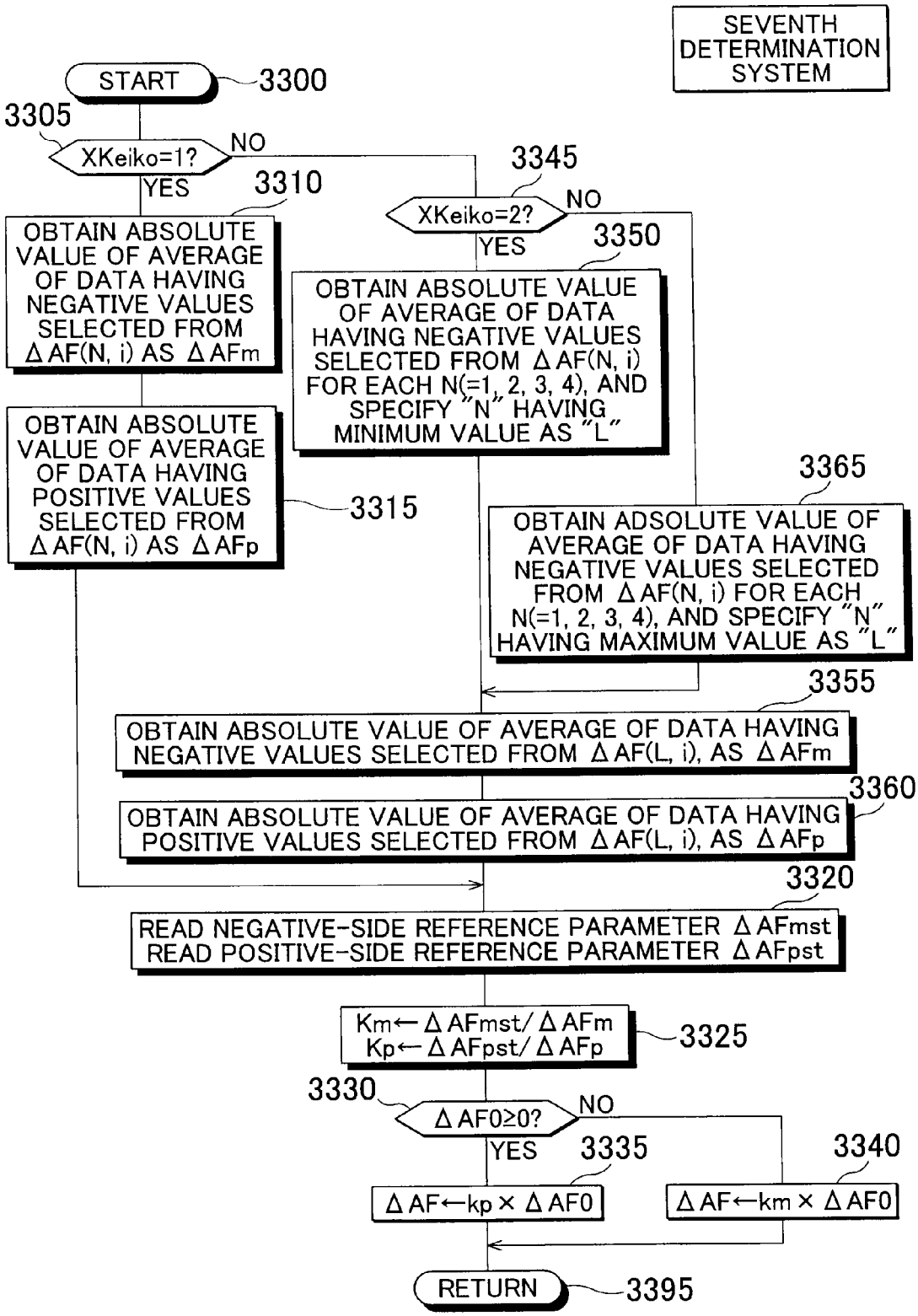
FIG. 33 is a flowchart illustrating a routine executed by CPU of the seventh determination system.

More specifically described, when the CPU proceeds to step 3240, it executes a routine of FIG. 33 for correcting the detected air/fuel ratio change rate ΔAF, which starts from step 3300. The CPU proceeds from step 3300 to step 3305 to determine whether the value of the imbalance sign flag Xkeiko to "1". Suppose the value of the imbalance sign flag Xkeiko is "1", the CPU successively executes step 3310 through step 3325 as described below, and proceeds to step 3330.

Step 3310: The CPU selects data having negative values from a plurality of pieces of original data ΔAF(N, i) obtained in step 2730 of FIG. 27, and adopts the average value of the absolute values (or the absolute value of the average value) of the negative values, as a negative-side parameter ΔAFm.

Step 3315: The CPU selects data having positive values from the plurality of pieces of original data ΔAF(N, i) obtained in step 2730 of FIG. 27, and adopts the average value of the absolute values (or the absolute value of the average value) of the positive values, as a positive-side parameter ΔAFp.

Step 3320: The CPU reads a negative-side reference parameter ΔAFmst and a positive-side reference parameter ΔAFpst from the ROM.

The negative-side reference parameter ΔAFmst is the average value of the absolute values (or the absolute value of the average values) of data having negative values, which are selected from a plurality of detected air/fuel ratio change rates ΔAF obtained based on the output value Vabyfs of the reference air/fuel ratio sensor when the reference air/fuel ratio sensor is mounted in place of the air/fuel ratio sensor 55, and the same forced imbalance condition as that created in step 2725 of FIG. 27 is created.

The positive-side reference parameter ΔAFpst is the average value (or the average value of the absolute values, or the absolute value of the average value) of data having positive values, which are selected from a plurality of detected air/fuel ratio change rates ΔAF obtained based on the output value Vabyfs of the reference air/fuel ratio sensor when the reference air/fuel ratio sensor is mounted in place of the air/fuel ratio sensor 55, and the same forced imbalance condition as that created in step 2725 of FIG. 27 is created.

Step 3325: The CPU calculates a negative-side correction coefficient km (=ΔAFmst/ΔAFm) by dividing the negative-side reference parameter ΔAFmst by the negative-side parameter ΔAFm. Also, the CPU calculates a positive-side correction coefficient kp (=ΔAFpst/ΔAFp) by dividing the positive-side reference parameter ΔAFpst by the positive-side parameter ΔAFp. Namely, the CPU calculates a value corresponding to the ratio of the reference parameter (ΔAFmst, ΔAFpst) to the provisional evaluation parameter (ΔAFm, ΔAFp), as a correction amount (km, kp).

Then, the CPU proceeds to step 3330 to determine whether the provisional detected air/fuel ratio change rate ΔAF0 obtained in step 3230 of FIG. 32 is a positive value (is equal to or larger than "0"). If the provisional detected air/fuel ratio change rate ΔAF0 is a positive value, the CPU proceeds from step 3330 to step 3335 to adopt a value obtained by multiplying the provisional detected air/fuel ratio change rate ΔAF0 by the positive-side correction coefficient kp, as a detected air/fuel ratio change rate ΔAF (=kp×ΔAF0).

On the other hand, if the provisional detected air/fuel ratio change rate ΔAF0 is a negative value, the CPU proceeds from step 3330 to step 3340 to adopt a value obtained by multiplying the provisional detected air/fuel ratio change rate ΔAF0 by the negative-side correction coefficient km, as a detected air/fuel ratio change rate ΔAF (=km×ΔAF0). Then, the CPU proceeds to step 1816 and subsequent steps of FIG. 32, via step 3395. As a result, the provisional detected air/fuel ratio change rate ΔAF0 as one of the output characteristics of the air/fuel ratio sensor 55 is made close to (or equal to) the detected air/fuel ratio change rate that would be provided by the reference air/fuel ratio sensor, and the resulting value is obtained as the detected air/fuel ratio change rate ΔAF.

The operations of step 1816 and subsequent steps are the same as those of step 1816 and subsequent steps as explained above with reference to FIG. 18. Thus, the CPU makes an A/F imbalance determination, using the detected air/fuel ratio change rate ΔAF (actually, the average value of the absolute values of a plurality of detected air/fuel ratio change rates ΔAF) corrected in step 3240.

If the value of the imbalance sign flag Xkeiko is "2" at the time when the CPU executes step 3305 of FIG. 33, the CPU makes a negative decision (NO) in step 3305, and makes an affirmative decision (YES) in step 3345 in which it is determined whether the value of the imbalance sign flag Xkeiko is "2". Then, the CPU sequentially executes step 3350 through 3360 as described below, and proceeds to step 3320 and subsequent steps.

Step 3350: The CPU selects "data having negative values from a plurality of pieces of original data ΔAF(N, i) obtained in step 2730 of FIG. 27", for each value "N", and obtains the average value AveΔAF(N) of the absolute values of the negative values, as a provisional evaluation parameter for the N-th cylinder.

Namely, the CPU obtains the average value of the absolute values of data having negative values selected from the original data ΔAF(1, i) (i is a natural number from 1 to C(1)th), as the average value AveΔAF(1), and obtains the average value of the absolute values of data having negative values selected from the original data ΔAF(2, i) (i is a natural number from 1 to C(2)th), as the average value AveΔAF(2). Also, the CPU obtains the average value of the absolute values of data having negative values selected from the original data ΔAF(3, i) (i is a natural number from 1 to C(3)th), as the average value AveΔAF(3), and obtains the average value of the absolute values of data having negative values selected from the original data ΔAF(4, i) (i is a natural number from 1 to C(4)th), as the average value AveΔAF(4).

Then, the CPU specifies the value N corresponding to the minimum value among the obtained average values AveΔAF (N), as value L. Namely, the CPU selects the minimum value from the average value AveΔAF(1), average value AveΔAF (2), average value AveΔAF(3), and the average value AveΔAF (4), and sets the value L to "1" if the selected average value is the average value AveΔAF(1). Similarly, the CPU sets the value L to "2" if the selected average value is the average value AveΔAF(2), sets the value L to "3" if the selected average value is the average value AveΔAF(3), and sets the value L to "4" if the selected average value is the average value AveΔAF(4).

Step 3355: The CPU selects data having negative values from the original data ΔAF(L, i), and obtains the absolute value of the average value (or the average value of the absolute values) of the negative values, as a negative-side parameter ΔAFm.

Step 3360: The CPU selects data having positive values from the original data ΔAF(L, i), and obtains the average value (or the average value of the absolute values) of the positive values, as a positive-side parameter ΔAFp.

If the value of the imbalance sign flag Xkeiko is "3" at the time when the CPU executes 3305, the CPU makes negative decisions (NO) in step 3305 and step 3345, and executes step 3365 as described below. Then, the CPU proceeds to step 3320 and subsequent steps via step 3355 and step 3360.

Step 3365: The CPU selects "data having negative values from a plurality of pieces of original data ΔAF(N, i) obtained in step 2730 of FIG. 27", for each value "N", and obtains the average value AveΔAF(N) of the absolute values of the negative values, as a provisional evaluation parameter for the N-th cylinder. Then, the CPU specifies the value N corresponding to the maximum value among the thus obtained average values AveΔAF(N), as value L.

As explained above, the seventh determination system includes an imbalance determination device (see the routine of FIG. 32, in particular, step 1836) that obtains an imbalance determination parameter Avef based on the output value Vabyfs of the air/fuel ratio sensor 55, and makes a determination (an A/F imbalance determination) as to whether a cylinder-to-cylinder A/F imbalance condition occurs, based on the result of comparison or determination as to whether the obtained imbalance determination parameter Avef is equal to or larger than a given threshold value ΔAF1*th* for imbalance determination.

The imbalance determination device includes a forced imbalance condition creating device (see step 2775 of FIG. 27), an evaluation parameter obtaining device (see step 2730 of FIG. 27, step 3310, step 3315, step 3350 and step 3365 of FIG. 33), a correction amount calculating device (see step 3325 of FIG. 33), and an imbalance determination parameter obtaining device (see step 3240 of FIG. 32, step 3330-step 3340 of FIG. 33, and step 1816-step 1834 of FIG. 32). The forced imbalance condition creating device changes the amount(s) of fuel injected from one or more fuel injection valves 25, so as to create a forced imbalance condition in which the air/fuel ratio of an air-fuel mixture supplied to one of three or more cylinders provided in the engine 10 deviates from the air/fuel ratio of air-fuel mixtures supplied to the other plural cylinders of the three or more cylinders, before the process of making an A/F imbalance determination is executed. The evaluation parameter obtaining device obtains an air/fuel ratio sensor evaluation parameter indicative of the output characteristics of the air/fuel ratio sensor, based on the output value of the air/fuel ratio sensor in a condition where the forced imbalance condition is established. The correction amount calculating device calculates a correction amount (km, kp) for making the obtained evaluation parameter (ΔAFm, ΔAFp) close to the predetermined reference parameter (ΔAFmst, ΔAFpst). The imbalance determination parameter obtaining device corrects at least one (the original data ΔAF0 in this embodiment) of the output value of the air/fuel ratio sensor, the original data obtained based on the output value of the air/fuel ratio sensor for determining the imbalance determination parameter, and the imbalance determination parameter, using the calculated correction amount (km, kp), so as to obtain the imbalance determination parameter Avef based on the corrected data.

With the above arrangement, the obtained imbalance determination parameter Avef becomes close to a value obtained when the air/fuel ratio sensor 55 is the reference air/fuel ratio sensor. Accordingly, an A/F imbalance determination can be made with improved accuracy.

The seventh determination system may multiply the detected air/fuel ratio abyfs obtained in step 1810 of FIG. 32 by the average value k of the negative-side correction coefficient km and the positive-side correction coefficient kp, so as to obtain a post-correction detected air/fuel ratio abyfs, and may obtain the absolute value |ΔAF| of the detected air/fuel ratio change rate ΔAF used in step 1816, based on the post-correction air/fuel ratio abyfs.

Also, the seventh determination system may obtain the imbalance determination parameter Avef by multiplying the evaluation parameter Avef obtained in step 1813 by the average value k of the negative-side correction coefficient km and the positive-side correction coefficient kp, without correcting ΔAF0 in step 3240 of FIG. 32 (but obtaining the negative-side correction coefficient km and the positive-side correction coefficient kp).

Also, the seventh determination system may obtain the maximum value Max of detected air/fuel ratios abyfs acquired within a unit combustion cycle period when a forced imbalance condition is created, while obtaining in advance the maximum value Maxst (reference parameter) of detected air/fuel ratios abyfs acquired within a unit combustion cycle period when no forced imbalance condition is created and the air/fuel ratio sensor 55 is replaced by the reference air/fuel ratio sensor, and may determine a value obtained by dividing the maximum value Maxst by the maximum value Max, as a correction amount k. Then, the seventh determination system may obtain the maximum value Maxact of detected air/fuel ratios abyfs acquired within a unit combustion cycle period when no forced imbalance condition is created, and determine a value obtained by multiplying the maximum value Maxact by the correction amount k, as an imbalance determination parameter Maxfinal. Then, the seventh determination system may determine that a cylinder-to-cylinder A/F imbalance condition occurs when the imbalance determination parameter Maxfinal is equal to or larger than a threshold value Maxth for use in imbalance determination.

Similarly, the seventh determination system may obtain the minimum value Min of detected air/fuel ratios abyfs acquired within a unit combustion cycle period when the forced imbalance condition is created, while obtaining in advance the minimum value Minst (reference parameter) of detected air/fuel ratios abyfs acquired within a unit combustion cycle period when no forced imbalance condition is created and the air/fuel ratio sensor 55 is replaced by the reference air/fuel ratio sensor, and may determine a value obtained by dividing the minimum value Minst by the minimum value Min, as a correction amount k. Then, the seventh determination system may obtain the minimum value Minact of detected air/fuel ratios abyfs acquired within a unit combustion cycle period when no forced imbalance condition is created, and determine a value obtained by multiplying the minimum value Minact by the correction amount k, as an imbalance determination parameter Minfinal. Then, the seventh determination system may determine that a cylinder-to-cylinder A/F imbalance condition occurs when the imbalance determination parameter Minfinal is equal to or smaller than a threshold value Minth for use in imbalance determination.

In the above cases, too, the seventh determination system may obtain the maximum value Max(N) and the minimum value Min(N) for each cylinder while sequentially setting each cylinder as the forced imbalance cylinder, and detects and identifies a sign of imbalance in a condition where no forced imbalance condition is established. Then, the system may select the maximum value Max(N) and the minimum value Min(N) that are least likely or unlikely to be influenced by an inherent imbalance cylinder, and may calculate the correction amount k by dividing the maximum value Max(X) and the minimum value Min(N) by the maximum value Maxst as a reference parameter and the minimum value Minst as a reference parameter, respectively.

Also, the seventh determination system may correct the threshold value for use in imbalance determination, according to a correction amount, such as the negative-side correction coefficient km and the positive-side correction coefficient kp, (e.g., by multiplying the imbalance determination threshold value by the inverse of the correction amount), thereby to determine a final threshold value for use in imbalance determination.

As explained above, the cylinder-to-cylinder A/F imbalance determination system according to each embodiment of the invention is less likely or unlikely to make an erroneous cylinder-to-cylinder A/F imbalance determination, even in the case where the output characteristics of the air/fuel ratio sensor 55 deviate from the output characteristics of the reference air/fuel ratio sensor.

It is to be understood that the invention is not limited to the above-described embodiments, but various modified examples may be adopted within the scope of the invention. For example, the imbalance determination parameter may be selected from the following parameters.

(P1) The imbalance determination parameter may be a trace length of the output value Vabyfs of the air/fuel ratio sensor 55 or that of the detected air/fuel ratio abyfs.

(P2) The imbalance determination parameter may be the maximum value of the absolute values of a plurality of detected air/fuel ratio change rates ΔAF obtained in a unit combustion cycle period.

(P3) The imbalance determination parameter may be the maximum value of the absolute values of data having negative values selected from a plurality of detected air/fuel ratio change rates ΔAF obtained in a unit combustion cycle period.

(P4) The imbalance determination parameter may be the maximum value of the absolute values of data having positive values selected from a plurality of detected air/fuel ratio change rates ΔAF obtained in a unit combustion cycle period.

(P5) The imbalance determination parameter may be the absolute value of a value (a second-order differential value of the output value Vabyfs of the air/fuel ratio sensor or the detected air/fuel ratio abyfs with respect to time) commensurate with the rate of change of the detected air/fuel ratio change rate ΔAF.

(P6) The imbalance determination parameter may be "the maximum value or minimum value of output values Vabyfs of the air/fuel ratio sensor or detected air/fuel ratios abyfs" acquired within a unit combustion cycle period.

Also, the parameter for evaluation of the air/fuel ratio sensor may be the same as the above-indicated imbalance determination parameter.

While the invention has been described with reference to the example embodiments thereof, it is to be understood that the invention is not limited to the example embodiments or constructions. To the contrary, the invention is intended to cover various modifications and equivalent arrangements. In addition, while the various elements of the example embodiments are shown in various combinations and configurations, which are exemplary, other combinations and configurations, including more, less or only a single element, are also within the scope of the invention.

What is claimed is:

1. A cylinder-to-cylinder air/fuel ratio imbalance determination system, comprising:

an air/fuel ratio sensor provided in a multi-cylinder internal combustion engine having a plurality of cylinders, said air/fuel ratio sensor being disposed in an exhaust collecting portion of an exhaust passage of the engine into which exhaust gases emitted from combustion chambers of at least three cylinders, out of said plurality of cylinders, are collected, or disposed in a portion downstream of the exhaust collecting portion;

a plurality of fuel injection valves provided in conjunction with said at least three cylinders, respectively, each of said fuel injection valves being adapted to inject a fuel contained in an air-fuel mixture supplied to each of combustion chambers of said at least three cylinders; and an imbalance determination device that obtains an imbalance determination parameter that increases or decreases as a difference between the air/fuel ratio of an air-fuel mixture supplied to one of said at least three cylinders and the air/fuel ratio of air-fuel mixtures supplied to the remaining ones of said at least three cylinders increases, based on at least an output value of the air/fuel ratio sensor, and makes an imbalance determination as to whether a cylinder-to-cylinder air/fuel ratio imbalance condition occurs, based on a result of comparison between the obtained imbalance determination parameter and a given threshold value for use in imbalance determination, wherein the imbalance determination device comprises:

a forced imbalance condition creating device that changes an amount of fuel injected from at least one of said plurality of fuel injection valves, so as to create a forced imbalance condition in which the air/fuel ratio of an air-fuel mixture supplied to one of said at least three cylinders deviates from the air/fuel ratio of air-fuel mixtures supplied to the remaining ones of said at least three cylinders, before the imbalance determination device makes an imbalance determination;

an evaluation parameter obtaining device that obtains an air/fuel ratio sensor evaluation parameter indicative of an output characteristic of the air/fuel ratio sensor, based on the output value of the air/fuel ratio sensor in a condition where the forced imbalance condition is established;

an air/fuel ratio sensor evaluation device that makes a sensor adequacy determination as to whether the output characteristic of the air/fuel ratio sensor is adequate for making an imbalance determination, by comparing the obtained air/fuel ratio sensor evaluation parameter with a predetermined reference parameter; and an imbalance determination executing/inhibiting device that inhibits the imbalance determination device from making an imbalance determination or makes the result of imbalance determination invalid when the air/fuel ratio sensor evaluation device determines that the output characteristic of the air/fuel ratio sensor is not adequate for making an imbalance determination.

2. The cylinder-to-cylinder air/fuel ratio imbalance determination system according to claim 1, wherein the forced imbalance condition creating device changes the amount of fuel injected from at least one of said plurality of fuel injection valves, so as to create a forced rich imbalance condition in which the air/fuel ratio of the air-fuel mixture supplied to said one cylinder is set to a first air/fuel ratio that is richer than the air/fuel ratio of the air-fuel mixtures supplied to the remaining cylinders, as the forced imbalance condition, and a forced lean imbalance condition in which the air/fuel ratio of the air-fuel mixture supplied to said one cylinder is set to a second air/fuel ratio that is leaner than the air/fuel ratio of the air-fuel mixtures supplied to the remaining cylinders, as the forced imbalance condition.

3. The cylinder-to-cylinder air/fuel ratio imbalance determination system according to claim 2, wherein:

a three-way catalyst having an oxygen storage function is provided in a portion of the exhaust passage downstream of the air/fuel ratio sensor;

the forced imbalance condition creating device sets the first air/fuel ratio to an air/fuel ratio richer than a stoichiometric air/fuel ratio, and sets the air/fuel ratio of the air-fuel mixtures supplied to the remaining cylinders to a third air/fuel ratio that is equal to or leaner than the stoichiometric air/fuel ratio, in the forced rich imbalance condition, while limiting a duration of the forced rich imbalance condition so that an amount of excessive unburned substances in the exhaust gases emitted during the duration of the forced rich imbalance condition does not exceed a first amount as an amount of unburned substances that can be oxidized by an amount of oxygen smaller than the maximum oxygen storage amount of the three-way catalyst; and the forced imbalance condition creating device sets the second air/fuel ratio to an air/fuel ratio leaner than the stoichiometric air/fuel ratio, and sets the air/fuel ratio of the air-fuel mixtures supplied to the remaining cylinders to a fourth air/fuel ratio that is equal to or richer than the stoichiometric air/fuel ratio, in the forced lean imbalance condition, while limiting a duration of the forced lean imbalance condition so that an amount of excessive oxygen in the exhaust gases emitted during the duration of the forced lean imbalance condition does not exceed a second amount that is smaller than the maximum oxygen storage amount of the three-way catalyst.

4. The cylinder-to-cylinder air/fuel ratio imbalance determination system according to claim 1, wherein:

said at least three cylinders include a first cylinder, and a second cylinder that is different from the first cylinder;

the forced imbalance condition creating device sets the first cylinder, for a set period of time, as a forced imbalance cylinder as one of said at least three cylinders for which the amount of fuel injected is changed so as to create the forced imbalance condition in which the air/fuel ratio of the air-fuel mixture supplied to the forced imbalance cylinder deviates by a given air/fuel ratio from the air/fuel ratio of the air-fuel mixtures supplied to the remaining cylinders, and then sets the second cylinder as the forced imbalance cylinder for a set period of time;

the evaluation parameter obtaining device obtains the air/fuel ratio sensor evaluation parameter in a first forced imbalance period in which the forced imbalance cylinder is set to the first cylinder, as a first provisional evaluation parameter, obtains the air/fuel ratio sensor evaluation parameter in a second forced imbalance period in which the forced imbalance cylinder is set to the second cylinder, as a second provisional evaluation parameter, and obtains a parameter corresponding to at least one of the first provisional evaluation parameter and the second provisional evaluation parameter, as a final air/fuel ratio sensor evaluation parameter used for making a sensor adequacy determination, when an absolute value of a difference between the first provisional evaluation parameter and the second provisional evaluation parameter is equal to or smaller than a given threshold value; and the imbalance determination executing/inhibiting device inhibits the air/fuel ratio sensor evaluation device from making a sensor adequacy determination or makes the result of the sensor adequacy determination invalid, when the absolute value of the difference between the first provisional evaluation parameter and the second provisional evaluation parameter is larger than the given threshold value.

5. The cylinder-to-cylinder air/fuel ratio imbalance determination system according to claim 4, wherein:

the evaluation parameter obtaining device obtains the first provisional evaluation parameter as the final air/fuel ratio sensor evaluation parameter, when the absolute value of the difference between the first provisional evaluation parameter and the second provisional evaluation parameter is equal to or smaller than the given threshold value; and the imbalance determination executing/inhibiting device determines whether the air/fuel ratio sensor is adequate for making an imbalance determination, based on an absolute value of a difference between the final air/fuel ratio sensor evaluation parameter and a given reference parameter.

6. The cylinder-to-cylinder air/fuel ratio imbalance determination system according to claim 4, wherein:

the evaluation parameter obtaining device obtains the second provisional evaluation parameter as the final air/fuel ratio sensor evaluation parameter, when the absolute value of the difference between the first provisional evaluation parameter and the second provisional evaluation parameter is equal to or smaller than the given threshold value; and the imbalance determination executing/inhibiting device determines whether the air/fuel ratio sensor is adequate for making an imbalance determination, based on an absolute value of a difference between the final air/fuel ratio sensor evaluation parameter and a given reference parameter.

7. The cylinder-to-cylinder air/fuel ratio imbalance determination system according to claim 4, wherein:

the evaluation parameter obtaining device obtains an average value of the first provisional evaluation parameter and the second provisional evaluation parameter as the final air/fuel ratio sensor evaluation parameter, when the absolute value of the difference between the first provisional evaluation parameter and the second provisional evaluation parameter is equal to or smaller than the given threshold value; and the imbalance determination executing/inhibiting device determines whether the air/fuel ratio sensor is adequate for making an imbalance determination, based on an absolute value of a difference between the final air/fuel ratio sensor evaluation parameter and a given reference parameter.

8. A cylinder-to-cylinder air/fuel ratio imbalance determination system according to claim 1, wherein:

the evaluation parameter obtaining device sequentially changes the forced imbalance cylinder from one of said at least three cylinders to another, obtains a provisional evaluation parameter for each of the cylinders set as the forced imbalance cylinder, selects two provisional evaluation parameters that are substantially equal to each other, from the obtained provisional evaluation parameters, and obtains an average value of the two provisional evaluation parameters as a final air/fuel ratio sensor evaluation parameter; and the imbalance determination executing/inhibiting device determines whether the air/fuel ratio sensor is adequate for making an imbalance determination, based on an absolute value of a difference between the final air/fuel ratio sensor evaluation parameter and a given reference parameter.

9. The cylinder-to-cylinder air/fuel ratio imbalance determination system according to claim 1, wherein:

the evaluation parameter obtaining device sequentially changes the forced imbalance cylinder from one of said at least three cylinders to another, obtains original data for use in sensor adequacy determination with respect to each of the cylinders set as the forced imbalance cylinder, and determines whether there is a sign of shift-to-rich imbalance or a sign of shift-to-lean imbalance, or there is no sign of imbalance, based on the output value of the air/fuel ratio sensor in a condition where no forced imbalance condition is created;

the evaluation parameter obtaining device obtains a final evaluation parameter from the original data for each of the cylinders, based on the result of detection and identification of a sign of imbalance; and the imbalance determination executing/inhibiting device determines whether the air/fuel ratio sensor is adequate for making an imbalance determination, based on an absolute value of a difference between the final evaluation parameter and a given reference parameter.

10. The cylinder-to-cylinder air/fuel ratio imbalance determination system according to claim 9, wherein:

the evaluation parameter obtaining device obtains an absolute value of an average value of data having negative values selected from the original data, as the final evaluation parameter, when there is no sign of imbalance;

the evaluation parameter obtaining device obtains an absolute value of an average value of data having negative values selected from the original data for each cylinder, and sets the minimum value of the absolute values for the respective cylinders, as the final evaluation parameter, when there is a sign of shift-to-rich imbalance; and the evaluation parameter obtaining device obtains an absolute value of an average value of data having negative values selected from the original data for each cylinder, and sets the maximum value of the absolute values for the respective cylinders, as the final evaluation parameter, when there is a sign of shift-to-lean imbalance.

11. A cylinder-to-cylinder air/fuel ratio imbalance determination system, comprising:

an air/fuel ratio sensor provided in a multi-cylinder internal combustion engine having a plurality of cylinders, said air/fuel ratio sensor being disposed in an exhaust collecting portion of an exhaust passage of the engine into which exhaust gases emitted from combustion chambers of at least three cylinders, out of said plurality of cylinders, are collected, or disposed in a portion downstream of the exhaust collecting portion;

a plurality of fuel injection valves provided for said at least three cylinders, respectively, each of said fuel injection valves being adapted to inject a fuel contained in an air-fuel mixture supplied to each of combustion chambers of said at least three cylinders; and an imbalance determination device that obtains an imbalance determination parameter that increases or decreases as a difference between the air/fuel ratio of an air-fuel mixture supplied to one of said at least three cylinders and the air/fuel ratio of air-fuel mixtures supplied to the remaining ones of said at least three cylinders increases, based on at least an output value of the air/fuel ratio sensor, and makes an imbalance determination as to whether a cylinder-to-cylinder air/fuel ratio imbalance condition occurs, based on a result of comparison between the obtained imbalance determination parameter and a given threshold value for use in imbalance determination, wherein the imbalance determining device comprises:

a forced imbalance condition creating device that changes an amount of fuel injected from at least one of said plurality of fuel injection valves, so as to create a forced imbalance condition in which the air/fuel ratio of an air-fuel mixture supplied to one of said at least three cylinders deviates from the air/fuel ratio of air-fuel mixtures supplied to the remaining ones of said at least three cylinders, before the imbalance determination device makes an imbalance determination;

an evaluation parameter obtaining device that obtains an air/fuel ratio sensor evaluation parameter indicative of an output characteristic of the air/fuel ratio sensor, based on the output value of the air/fuel ratio sensor in a condition where the forced imbalance condition is established;

a correction amount calculating device that calculates a correction amount for making the obtained evaluation parameter close to a predetermined reference parameter, based on the obtained evaluation parameter and the reference parameter; and an imbalance determination parameter obtaining device that corrects at least one of the output values of the air/fuel ratio sensor, original data obtained based on the output value of the air/fuel ratio sensor for determining the imbalance determination parameter, and the imbalance determination parameter, using the calculated correction amount, and obtains the imbalance determination parameter based on the corrected data.

12. The cylinder-to-cylinder air/fuel ratio imbalance determination system according to claim 11, wherein the correction amount calculating device calculates a value corresponding to a ratio of the reference parameter to the evaluation parameter, as the correction amount.

* * * * *